US006501011B2

(12) United States Patent
Wesley

(10) Patent No.: US 6,501,011 B2
(45) Date of Patent: Dec. 31, 2002

(54) SENSOR ARRAY MIDI CONTROLLER

(75) Inventor: William Casey Wesley, San Diego, CA (US)

(73) Assignee: Shai Ben Moshe, Malibu, CA (US)

( * ) Notice: Subject to any disclaimer, the term of this patent is extended or adjusted under 35 U.S.C. 154(b) by 0 days.

(21) Appl. No.: 09/983,466

(22) Filed: Mar. 21, 2001

(65) Prior Publication Data

US 2002/0134223 A1 Sep. 26, 2002

(51) Int. Cl.[7] ..... G10H 1/32

(52) U.S. Cl. ..... 84/719; 84/600; 84/609; 84/617; 84/649; 84/655

(58) Field of Search ..... 84/600–602, 609–613, 84/615–618, 622, 649–656, 659, 423 R, 424, 433, 442, 718–720, 723, 743–745

(56) References Cited

U.S. PATENT DOCUMENTS

| | | | | | |
|---|---|---|---|---|---|
| 2,049,564 | A | | 8/1936 | HinterMeyer | |
| 3,943,811 | A | | 3/1976 | Coles | 84/1.01 |
| 4,384,503 | A | | 5/1983 | Gunn | 84/1.01 |
| 4,966,052 | A | | 10/1990 | Shiraki | 84/715 |
| 4,972,752 | A | | 11/1990 | Van Duyne | 84/423 |
| 5,434,350 | A | | 7/1995 | Haney et al. | 84/743 |
| 5,557,057 | A | * | 9/1996 | Starr | 84/617 |
| 5,619,003 | A | | 4/1997 | Hotz | 84/615 |
| 5,741,990 | A | * | 4/1998 | Davies | 84/423 R |
| 5,841,052 | A | | 11/1998 | Stanton | 84/600 |
| 5,856,628 | A | | 1/1999 | Noguchi | 84/738 |
| 5,900,571 | A | | 5/1999 | Partovi | 84/722 |
| 6,018,119 | A | | 1/2000 | Mladek | 84/722 |

OTHER PUBLICATIONS

Helmholtz, On the Sensation of Tone, 4th ed., Appendix X1X (1877) Theo Presser, Dictionary of Music and Musicians, vol. 4, pp. 70–81 (1895).

* cited by examiner

*Primary Examiner*—Marlon T. Fletcher

(57) ABSTRACT

A MIDI controller musical instrument (80) with buttons (34) on two sensorboards (54,56) for controlling musical notes. The buttons (34) are arranged such that the most harmonious note combinations are played by fingering the most proximate button (34) combinations, and such that any given chord or scale can be played with a characteristic fingering pattern regardless of the range or key signature it is played in. The buttons (34) are placed such that the fingers and thumb of a hand can span the entire note range of the instrument (80). The buttons (34) that control the notes for any one key signature of the major scale are located within their own delimited area which does not contain buttons (34) controlling notes which are not part of that key signature. Notes are assigned to the buttons in such a way that the notes can be tuned to a wide variety of intonations without any consequent necessity to change the fingering patterns of the major scale or its modes. Separate sensorboards (54,56) are provided, which are mirror images of one another, such that fingering techniques for chords and scales can be mirrored by the two hands on the buttons (34) of the two playing surfaces. A convex playing surface is provided for each sensorboard (54,56) such that any part along the underside of a finger can be used to control a single button (34) or a row of buttons (42,44,46,48).

18 Claims, 42 Drawing Sheets

| | | | | | | | | | | | | | | | | | | | | | | | | |
|---|---|---|---|---|---|---|---|---|---|---|---|---|---|---|---|---|---|---|---|---|---|---|---|---|
| Bb Major | | | | Eb | Bb | F | C | G | D | A | | | | | | Eb | Bb | F | C | G | D | A | | |
| F Major | | | | | Bb | F | C | G | D | A | E | | | | | | Bb | F | C | G | D | A | E | |
| C Major | | | | | | F | C | G | D | A | E | B | | | | | | F | C | G | D | A | E | B |
| G Major | F# | | | | | | C | G | D | A | E | B | F# | | | | | | C | G | D | A | E | B |
| D Major | F# | C# | | | | | | G | D | A | E | B | F# | C# | | | | | | G | D | A | E | B |
| A Major | F# | C# | G# | | | | | | D | A | E | B | F# | C# | G# | | | | | | D | A | E | B |
| E Major | F# | C# | G# | D# | | | | | | A | E | B | F# | C# | G# | D# | | | | | | A | E | B |
| B Major | F# | C# | G# | D# | A# | | | | | | E | B | F# | C# | G# | D# | A# | | | | | | E | B |
| Gb Major | Gb | Db | Ab | Eb | Bb | F | | | | | | Cb | Gb | Db | Ab | Eb | Bb | F | | | | | | Cb |
| Db Major | Gb | Db | Ab | Eb | Bb | F | C | | | | | | Gb | Db | Ab | Eb | Bb | F | C | | | | | |
| Ab Major | | Db | Ab | Eb | Bb | F | C | G | | | | | | Db | Ab | Eb | Bb | F | C | G | | | | |
| Eb Major | | | Ab | Eb | Bb | F | C | G | D | | | | | | Ab | Eb | Bb | F | C | G | D | | | |

| | G♭ | D♭ | A♭ | E♭ | B♭ | F | C | G | D | A | E | B |
|---|---|---|---|---|---|---|---|---|---|---|---|---|
| Scale Intervals | | | | | | Fourth | Unison | Fifth | Second | Sixth | Third | Seventh |
| Scale Vocalizations | | | | | | FA | DO | SO | RE | LA | MI | TI |
| Scale Degrees | | | | | | Subdominant | Tonic | Dominant | Supertonic | Submediant | Mediant | Leading Tone |
| Scale Modes | | | | | | Lydian | Ionian (M) | Mixolydian | Dorian | Aeolian (m) | Phrygian | Locrian |

| | G♭ | D♭ | A♭ | E♭ | B♭ | F | C | G | D | A | E | B |
|---|---|---|---|---|---|---|---|---|---|---|---|---|
| | | | | | | | | | | | | |
| C | | | | | | | C | G | | | E | |
| Cm | | | | E♭ | | | C | G | | | | |
| Co | G♭ | | | E♭ | | | C | | | A | | |
| C+ (5) | | | A♭ | | | | C | | | | E | |
| Cm+ (5) | | | A♭ | E♭ | | | C | | | | | |
| C-5 | G♭ | | | | | | C | | | | E | |
| C-6 | | | | | | | C | G | | A | E | |
| Cm6 | | | | E♭ | | | C | G | | A | | |
| C7 | | | | | B♭ | | C | G | | | E | |
| Cm7 | | | | E♭ | B♭ | | C | G | | | | |
| Cmaj7 | | | | | | | C | G | | | E | B |
| Cm(maj7) | | | | E♭ | | | C | G | | | | B |
| Cadd9(Csus2) | | | | | | | | G | D | | E | |
| Cmadd9(Cmsus2) | | | | E♭ | | | | G | D | | | |
| C6,9 | | | | | | | | G | D | A | E | |
| Cm6,9 | | | | E♭ | | | | G | D | A | | |
| C9 | | | | | B♭ | | | G | D | | E | |
| Cm9 | | | | E♭ | B♭ | | | G | D | | | |
| Cmaj9 | | | | | | | | G | D | | E | B |
| Cm(maj9) | | | | E♭ | | | | G | D | | | B |
| C(7)-9 | | D♭ | | | B♭ | | | G | | | E | |
| C(7)+9 | | | | E♭ | B♭ | | | | | | E | |
| Csus(4)/Cmsus(4) | | | | | | F | C | G | | | | |
| C7sus(4)/Cm7sus(4) | | | | | B♭ | F | C | G | | | | |

| | G♭ | D♭ | A♭ | E♭ | B♭ | F | C | G | D | A | E | B |
|---|---|---|---|---|---|---|---|---|---|---|---|---|
| | | | | | | | | | | | | |
| Pentatonic 1st Mode | | | | | | | 1 | 4 | 2 | 5 | 3 | |
| Pentatonic 4th Mode | | | | | | 3 | 1 | 4 | 2 | 5 | | |
| Pentatonic 2nd Mode | | | | | 5 | 3 | 1 | 4 | 2 | | | |
| Pentatonic 5th Mode | | | | 2 | 5 | 3 | 1 | 4 | | | | |
| Pentatonic 3rd Mode | | | 4 | 2 | 5 | 3 | 1 | | | | | |
| Lydian Mode | 4 | | | | | | 1 | 5 | 2 | 6 | 3 | 7 |
| Major Scale (Ionian Mode) | | | | | | 4 | 1 | 5 | 2 | 6 | 3 | 7 |
| Mixolydian Mode | | | | | 7 | 4 | 1 | 5 | 2 | 6 | 3 | |
| Dorian Mode | | | | 3 | 7 | 4 | 1 | 5 | 2 | 6 | | |
| Minor Scale (Aeolian Mode) | | | 6 | 3 | 7 | 4 | 1 | 5 | 2 | | | |
| Natural minor (Phrygian Mode) | | 2 | 6 | 3 | 7 | 4 | 1 | 5 | | | | |
| Locrian Mode | 5 | 2 | 6 | 3 | 7 | 4 | 1 | | | | | |
| Whole Tone Scale | 4 | | 5 | | 6 | | 1 | | 2 | | 3 | |
| Harmonic Minor | | | 6 | 3 | | 4 | 1 | 5 | 2 | | | 7 |
| Enharmonic, or Dbl Harmonic | | 2 | 6 | | | 4 | 1 | 5 | | | 3 | 7 |
| Overtone | 4 | | | | 7 | | 1 | 5 | 2 | 6 | 3 | |
| Ascending Melodic Minor | | | | 3 | | 4 | 1 | 5 | 2 | 6 | | 7 |
| (decending use natural minor) | | | | | | | | | | | | |
| Chromatic Scale | 7 | 2 | 9 | 4 | 11 | 6 | 1 | 8 | 3 | 10 | 5 | 12 |

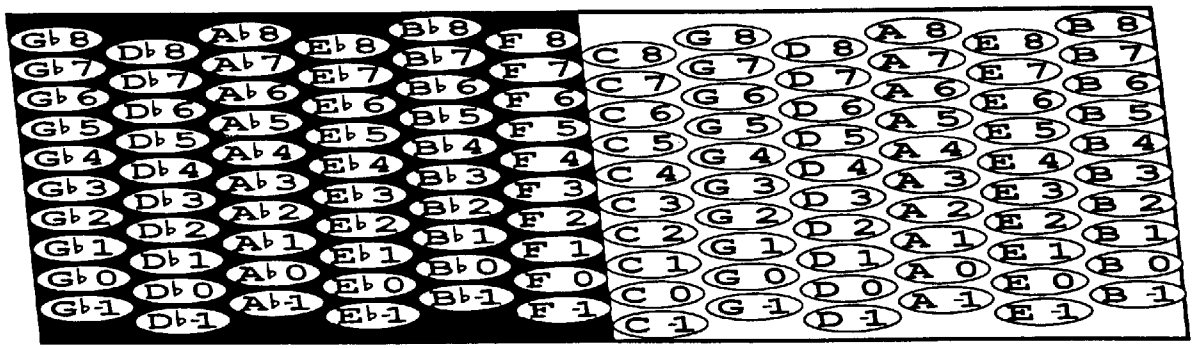

FIG. 17

| | G♭ | D♭ | A♭ | E♭ | B♭ | F | C | G | D | A | E | B |
|---|---|---|---|---|---|---|---|---|---|---|---|---|
| Pelog | | 2 | 5 | 3 | | | 1 | 4 | | | | |
| Kumoi | | | | 3 | | | 1 | 4 | 2 | 5 | | |
| Hirajoshi | | | 5 | 3 | | | 1 | 4 | 2 | | | |
| Six Tone Symmetrical | | 2 | 5 | | | 4 | 1 | | | 6 | 3 | |
| Prometheus | 4 | | | | 6 | | 1 | | 2 | 5 | 3 | |
| Prometheus / Neapolitan | 4 | 2 | | | 6 | | 1 | | | 5 | 3 | |
| A Jazz Scale | 4 | | | 2 | 6 | | 1 | 5 | | | 3 | |
| A Six Note Scale | | | | | | 4 | 1 | 5 | 2 | 6 | 3 | |
| Super Locrian | 5 | 2 | 6 | 3 | 7 | | 1 | | | | 4 | |
| Neapolitan Minor | | 2 | 6 | 3 | | 4 | 1 | 5 | | | | 7 |
| Neapolitan Major | | 2 | | 3 | | 4 | 1 | 5 | | 6 | | 7 |
| Oriental | 5 | 2 | | | 7 | 4 | 1 | | | 6 | 3 | |
| Enigmatic | 4 | 2 | 5 | | 6 | | 1 | | | | 3 | 7 |
| Hungarian Minor | 4 | | 6 | 3 | | | 1 | 5 | 2 | | | 7 |
| Major Locrian | 5 | | 6 | | 7 | 4 | 1 | | 2 | | 3 | |
| Lydian Minor | 4 | | 6 | | 7 | | 1 | 5 | 2 | | 3 | |
| Leading Wholetone | 4 | | 5 | | 6 | | 1 | | 2 | | 3 | 7 |
| Hungarian Major | 4 | | | 2 | 7 | | 1 | 5 | | 6 | 3 | |
| Symmetrical | 5 | 2 | | 3 | 8 | | 1 | 6 | | 7 | 4 | |
| 8 Tone Spanish | 6 | 2 | 7 | 3 | 8 | 5 | 1 | | | | 4 | |
| A Blues Rock Scale | 5 | 2 | | | 7 | 4 | 1 | 6 | 3 | | | 8 |
| An 8 Note Scale | 5 | | | | | 4 | 1 | 6 | 2 | 7 | 3 | 8 |

IV
I
G
D
A
E
B
F
C
G
D
A
E
B
C
C
G
A
E
C
G
D
A
E
B
F
C
G
D
A
E
B
F
C
G
D
A
E
B
F

| | | | | | | | |
|---|---|---|---|---|---|---|---|
| $Gb_7$ | | | | | | | |
| | $E_7$ | $D_7$ | $C_7$ | $Bb_6$ | $Ab_6$ | $Gb_6$ | |
| | | $B_6$ | $A_6$ | $G_6$ | $F_6$ | $Eb_6$ | $Db_6$ |
| $Gb_6$ | | | | | | | |
| | $E_6$ | $D_6$ | $C_6$ | $Bb_5$ | $Ab_5$ | $Gb_5$ | |
| | | $B_5$ | $A_5$ | $G_5$ | $F_5$ | $Eb_5$ | $Db_5$ |
| $Gb_5$ | | | | | | | |
| | $E_5$ | $D_5$ | $C_5$ | $Bb_4$ | $Ab_4$ | $Gb_4$ | |
| | | $B_4$ | $A_4$ | $G_4$ | $F_4$ | $Eb_4$ | $Db_4$ |
| $Gb_4$ | | | | | | | |
| | $E_4$ | $D_4$ | $C_4$ | $Bb_3$ | $Ab_3$ | $Gb_3$ | |
| | | $B_3$ | $A_3$ | $G_3$ | $F_3$ | $Eb_3$ | $Db_3$ |
| $Gb_3$ | | | | | | | |
| | $E_3$ | $D_3$ | $C_3$ | $Bb_2$ | $Ab_2$ | $Gb_2$ | |
| | | $B_2$ | $A_2$ | $G_2$ | $F_2$ | $Eb_2$ | $Db_2$ |
| $Gb_2$ | | | | | | | |
| | $E_2$ | $D_2$ | $C_2$ | $Bb_1$ | $Ab_1$ | $Gb_1$ | |
| | | $B_1$ | $A_1$ | $G_1$ | $F_1$ | $Eb_1$ | $Db_1$ |
| $Gb_1$ | | | | | | | |
| | $E_1$ | $D_1$ | $C_1$ | $Bb_0$ | $Ab_0$ | $Gb_0$ | |

FIG. 25

SENSOR ARRAY MIDI CONTROLLER

RELATED APPLICATION

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention is a controller with an array of sensors and their associated buttons. It is primarily used as a music controller but may be used in other applications commanded by the Musical Instrument Digital Interface (MIDI).

Throughout this specification the following terms will be used as follows:

1. Conventional keyboard: standard, traditional or conventional keyboards, such as those found on pianos, organs and harpsichords. These keyboards have keys that may be activated by touch. MIDI controllers generally have conventional keyboards.
2. Generalized keyboard: A generalized keyboard will feature a two-dimensional array of keys which are arranged such that a particular piece of music may be played with a single fingering pattern regardless of the range or key signature in which the piece is performed. Changes in the range or key signature of a piece of music are achieved solely through variation in the position at which the single fingering pattern is executed, not through changes in the fingering pattern itself.
3. Player: a musician, someone who operates a musical instrument.

2. Description of the Related Technology

The controllers used for MIDI modules have most commonly been either conventional MIDI keyboard controllers or MIDI guitar controllers. In the past, controllers which have been designed to offer advantage to the amateur generally limit the options available to the professional, while controllers which have been designed to offer advantage to the professional generally limit the options available to the amateur. Some of the constraints in controller design constitute impediments to both the amateur and the professional.

An impediment exists where the most proximate buttons do not control the most harmonious note combinations.

An impediment exists where the buttons control the notes in an arrangement that requires a different fingering for the same type of chord or scale when it is played in different ranges or key signatures.

An impediment exists where the buttons are placed in a pattern that does not allow the fingers of a hand to simultaneously span the instrument's entire range from the highest to the lowest note.

An impediment exists where the buttons that control the notes of a given major scale are not united within a common area such that notes not part of the scale are outside the boundaries of the area.

An impediment exists where the major scale must be fingered differently with different but related intonations of the notes.

An impediment exists where the two hands may not play the same type of chord or scale when fingering the buttons in mirror symmetry with respect to one another.

An impediment exists where the player cannot manipulate single buttons or rows of buttons with any part of the lengths of the undersides of her fingers.

Conventional keyboards that have been developed previously for MIDI share the above impediments and most of the following disadvantages:

1. Their design involves complex force-transfer mechanisms which are prone to breakdown and which are both costly and difficult to manufacture.
2. Each of the twelve key signatures requires memorization of a different fingering pattern, greatly increasing the complexity of playing in multiple key signatures, and necessitating a lengthy learning period.
3. In playing the same type of chord with differing root notes, one must often adopt differing playing configurations, making harmonization very complicated.
4. Differing octaves of the same note are placed in a widely separated pattern, preventing the fingers from simultaneously reaching most voicings of a chord.
5. The most-often used harmonies usually entail playing widely separated, hard to reach notes, while the least-often used harmonies usually entail playing closely spaced, easy to reach notes.
6. The most likely spatial mistakes made by the keyboard performer lead to the most noticeable dissonances.
7. There are no inert areas between keys which could decrease the likelihood of the musician inadvertently activating undesired notes, which inert areas, if provided, could also facilitate the precise expression of rests by providing the equivalent of "silent keys."
8. The conventional keyboard is the model for the standard notation system and for music theory, which are as complex and awkward to understand as the conventional keyboard is to play.
9. The playing position is not adjustable. There is a single angle of approach to the keyboard.
10. A chord form on the keyboard cannot be reoriented in multiple ways to give related chords.
11. The keyboard has an archaic geometry biased to the notes of the key signature of C major and its modes, which impedes balanced treatment of the other eleven major key signatures and their modes.
12. The practical, simultaneous input is one note per finger, making a chord of more than ten notes difficult to play.
13. It is impossible to simultaneously cover all the range of a note even when using both hands on a conventional, full-range keyboard.
14. The length of conventional and most generalized keyboards limits the number of multiple octaves of a chord that a single performer can play simultaneously.
15. The keys that must be played in sequence to allow arpeggiation are very dispersed, necessitating much coordination and physical effort, due to the need to cross hands over each other.
16. The keys cannot easily be strummed, which limits the playing rate to a single key activation per finger stroke.

17. The musician's hands are specialized in a pre-set way for the high and low ranges; and neither hand has simultaneous access to the entire range, greatly limiting rhythmic interactivity.
18. The activation of notes of the same pitch on different keys is not possible, so that in order to maximize the speed and accuracy of repetitions and trills of the same note, the player's hands are forced together where they must alternate back and forth awkwardly, striking the same key.
19. Note combinations whose tuning approximates an extended series of harmonic overtones or of subharmonic undertones are widely separated across the length of the keyboard, disallowing their simultaneous manual activation, which necessitates using organ stop drawbars to effect control over timbre.
20. Keys are designed solely as finger-activated devices; the player's other body surfaces or his implements can't easily be employed to play notes.
21. The conventional keyboard employs keys, and does not have the advantage of sensors that respond differently to being played in different areas (of the button) and from different angles.
22. Two or more persons playing the same instruments do not each have full access to all the available notes.
23. The player's moves, such as what key signature she is playing in, cannot easily be followed visually, due to the dispersed arrangement of notes for each major scale and its modes.
24. Design limitations impede real time control by the player, thereby requiring the use of sequencing technology in order to fully utilize the polyphonic capacity of most synthesizer modules.
25. The player tends to adopt a stressful body posture during performance.
26. The force transfer mechanisms of keys make mechanical noise.
27. The spaces between keys allow easy entry of foreign matter, resulting in deterioration of internal mechanisms.
28. There is no simple method of assembly because of the many moving parts, such as keys and action components.

The following Summary and Advantages sections describe how the Sensor Array MIDI Controller overcomes the above-enumerated disadvantages of the prior art.

BRIEF SUMMARY OF THE INVENTION (A note's location is equated for purposes of description and explanation with the location of the button that controls the note.)

The Sensor Array MIDI Controller is basically a new and highly advantageous arrangement of buttons and associated sensors used to control musical notes, with said buttons and associated sensors being affixed to a convex playing surface on a sensorboard. The notes are then produced by a music system including: a power cord or battery, a scanner, a MIDI cable, MIDI module, optional recording device, and optional amplifier and speakers.

The basic, nonredundant configuration of notes is called the chromatic matrix; and two or more chromatic matrices are affixed side-by-side on the top surface of a sensorboard to form a playing surface. Sensorboards vary in size and shape; and they may be attached together to form multi-instruments or may be unattached to be played separately. A sensorboard with right-hand chromatic matrices affixed to it is a right-hand sensorboard; and a sensorboard with left-hand chromatic matrices affixed to it is a left-hand sensorboard. A sensorboard can have from two to four or more chromatic matrices per playing surface and on any sensorboard there are overlapping, or mutually derivative, or coinciding rows of buttons in which adjacent buttons (within a row) give notes related by:

1. eighth intervals (octaves) in the rows of eighths
2. fourth intervals in the rows of fourths
3. fifth intervals in the rows of fifths
4. whole tone intervals in the rows of whole tones Any notes on a sensorboard excepting any note at the edge of the playing surface, is immediately surrounded by six notes that are maximally harmonious with or most closely related to it, a significant difference from keyboards.

The specific features of the invention avoid all the numerous disadvantages of the prior art and give surprising and highly useful advantages, such that the Sensor Array MIDI Controller is a significant improvement over other MIDI controllers in musical applications and can be used, as well, as a controller in non-musical applications.

ADVANTAGES OF THE INVENTION

Distinct and Novel Advantages of the Present Invention

The sensor array MIDI controller has been designed to offer advantages to both the amateur and the professional without limiting the options available to either kind of player. Whether the sensor array is played in real time, or is used as a compositional workstation it empowers the player in the following ways:

The most proximate buttons control the most harmonious and most often used note combinations. (FIGS. 14,23,24)

The buttons control the notes in an arrangement that allows the same fingering to be used to play the same type of chord or scale regardless of the range (FIGS. 15,16,17,18) or key signature (FIG. 5A) it is played in.

The buttons are arranged in a pattern that allows the fingers of a hand to simultaneously span the entire range of the instrument from the highest note to the lowest note. (FIG. 6)

The buttons that control the notes of a given major scale are united into a common area such that buttons that control the notes that are not part of that scale are located outside the borders of the area. (FIGS. 5A,14,19)

The buttons are organized so that the major scale and its modes may be fingered in the same way no matter which of a wide range of optimun intonations is used. (FIG. 23)

The two hands may finger the buttons of two boards with symmetrical playing techniques to achieve equivalent results. (FIG. 6)

Any part of a finger's length may be used to activate single buttons or rows of buttons on the curved playing surfaces of the boards. (FIG. 11)

The Sensor Array has the foregoing and also the following advantages:

1. The design involves simple transfer mechanisms which are not prone to breakdown, and which are both easy and cost effective to manufacture. (FIG. 4)
2. All twelve key signatures may be played using the same fingering patterns, which greatly reduces the complexity of playing in multiple key signatures and reduces the learning period required. (FIG. 5A)

3. To play the same type of chord with differing root notes, one may always adopt the same playing configuration, making harmonization exceptionally simple. (FIG. 5A,)
4. Differing octaves of the same note are placed in close proximity allowing the fingers to simultaneously reach most voicings of a chord. (FIGS. 15,16,17,18)
5. The most often used harmonies generally involve playing closely spaced, easy to reach notes while the least often used harmonies generally involve playing more widely separated notes. (FIGS. 14,19)
6. The most likely spatial mistakes made by a performer result in the most harmonious consonances (FIGS. 14,23,24)
7. The layout of notes offers the option of having inert areas between buttons, which inert areas decrease the likelihood of the musician inadvertently activating undesired notes, and which facilitate the precise expression of rests by providing the equivalent of "silent keys."
8. The Sensor Array serves as a visual model that makes music theory as easy to understand as the instrument is easy to play. (FIGS. 14,19,20,21,23,24)
9. The herein disclosed embodiments of the Sensor Array are playable from multiple angles of approach; and some embodiments are designed to be worn while being played. (FIG. 6)
10. The same idealized chord form can be given multiple orientations, producing different but related chords. (See FIGS. 25 and 26 for idealized tablature examples and examples of the same chord form in eight different orientations.)
11. The Sensor Array is not biased to the key signature of C major and its modes, but allows balanced treatment of the other eleven key signatures and their modes. (FIG. 5A)
12. The player of the Sensor Array is not limited to a practical simultaneous input of one note per finger. A single finger may generate many notes simultaneously by being laid across the surface of the instrument, making possible chords of up to 60 or more notes if both hands are used. (FIGS. 3,3A,3B)
13. It is possible to cover the entire range of a note simultaneously with a single finger by placing it over an entire row of eighths. (FIG. 3)
14. Because of the compactness of the note configuration, a single player can play many multiple octaves of a chord simultaneously. (FIGS. 3,15,16)
15. Arpeggiation of chords and scales may be achieved without hand crossovers, minimizing the required level of physical effort and coordination. (FIGS. 15,16,17, 18)
16. Because multiple notes may be activated per finger stroke by sliding in any direction across the playing surface, strumming is greatly facilitated, and the playing rate greatly increased. (FIGS. 3,3A,3B,3C)
17. Each of a performer's hands has simultaneous access to the entire range of notes on the Sensor Array, with neither hand necessarily being specialized for the high or low ranges, which greatly facilitates rhythmic interactivity. (FIG. 6)
18. The activation of notes of the same pitch on independent buttons is possible, so that in order to maximize the speed and accuracy of repetitions and trills of the same note, the players hands may remain separated, where they may conveniently alternate back and forth striking buttons at independent locations. (FIG. 6)
19. Button combinations which activate notes whose tuning approximates an extended series of harmonic overtones or of subharmonic undertones are never spread over an area larger than twelve adjacent octave rows, which allows the hand direct control over timbre without organ stop draw bars. (FIGS. 24A,24B)
20. The buttons on the Sensor Array are not designed for only finger activation. Such things as the palm of the hand, the arm, picks, sticks, or other implements can be used to activate buttons for special musical effects and sound nuances.
21. In some embodiments, the Sensor Array controller is supplied with sensors that are designed to respond differently to the area on which, and the directions from which, there is an activating pressure on the button. (FIG. 4)
22. Two or more persons can play the Sensor Array at the same time, even on a single playing surface, with each having mutual access to the entire range of notes. This results from the plurality of identical chromatic matrices, each with the full range of notes. (FIG. 6)
23. The player's moves, such as what key signature she is playing in can be easily followed visually due to the united arrangement of the notes of each major scale and its modes. (FIGS. 5A,14,19)
24. Design advantages facilitate real time control by the player, making optional the use of sequencing technology in order to fully utilize the polyphonic capacity of most MIDI modules.
25. The general design of the Sensor Array is conducive to a relatively relaxed body posture during performance.
26. The transfer mechanisms of the Sensor Array are designed to make less noise as compared to other MIDI controllers. (FIG. 4)
27. The buttons of the Sensor Array are designed to prevent entry of dust and debris into the interior of the instrument, which minimizes the deterioration of working parts. (FIG. 10)
28. With fewer moving parts than most conventional and generalized keyboards, the Sensor Array is relatively simple to assemble. The optional use of printed circuitry can simplify the manufacture of the Sensor Array. (FIG. 4)

Further Discussion of Sensor Array Advantages (A note's location is equated for purposes of description and explanation with the locations of the button that controls the note.)

A major advantage of the Sensor Array is that adjacent notes share more harmonics and subharmonics than non-adjacent notes. (FIGS. 24A,24B) For example, except at the edges of the sensorboard, a given C is adjacent to a higher and lower octave of C, both of which share a maximum number of harmonics and sub-harmonics with the given C, which is also adjacent to a G a fifth above and a G a fourth below as well as an F a fourth above and an F a fifth below, all of which share the next greatest number of harmonics and sub-harmonics with C. This means that in a physical sense these 6 notes are all more highly related to the given C than are any other notes. Likewise, all the other notes on the Sensor Array's playing surface are maximally harmonious with their proximate note neighbors. (FIGS. 14,23,24)

On the sensor array it is possible to slide up and down rows of notes constituting successive octaves, rows of notes constituting successive fifths, and rows of notes constituting successive fourths, with highly pleasing and dramatic results. This feature of the present invention is unique and highly advantageous. (FIGS. 3,3A,3B)

All of these advantages of the Sensor Array make it possible for the player to more effectively express or conceptualize music, improvise or recite music, explore or define music, and to teach or learn music.

BRIEF DESCRIPTION OF THE DRAWINGS

FIGS. 1 and 1A are mirror images of each other.

FIGS. 2 and 2A are mirror images of each other.

FIG. 17 is a diagram of one chromatic matrix of a right-hand sensorboard with a table listing in the leftmost column the most commonly used scales, shown in the key of C. In the boxes to the right of any given scale are the numbers that indicate the sequence of notes that needs to be played on the sensorboard so as to produce the ascending scale.

FIG. 25 is a grid with horizontal and vertical lines forming intersections of lines and, between the lines, spaces. The grid represents a portion of the present invention's array of buttons. The intersections of lines represent buttons controlling notes associated with one whole tone scale, while the spaces between the lines represent buttons controlling notes associated with the remaining whole tone scale. Any form of symbol shown over an intersection or within a space indicates both a button and the note that it controls.

REFERENCE NUMERALS IN THE DRAWINGS

30 Array of buttons 30 is the basic right-hand array of buttons used with the herein disclosed embodiments of the invention.

32 Array of buttons 32 is the basic left-hand array of buttons used with the herein disclosed embodiments of the invention.

34 Button (34) is an intermediary element that transmits an externally applied force to the Sensor Array's sensor. It's a component on the playing surface that triggers a particular note. It can be a key, lever, joystick, bump, or raised or recessed location on a board skin which (location) is in direct contact or communication with a sensor, thus serving as a button.

36 Sensor (36) is an electrically conductive element that varies its electrical properties according to an external force applied to the Sensor Array's button. The sensor may be a variable capacitance sensor, a variable inductance sensor, a variable transductance sensor, or a velocity sensing dual switch; that is, a switch which operates such that each of two switches closes at a slightly different time during the button's excursion which information may be used for controlling musical parameters such as amplitude or timbre.

38 Chromatic matrix 38 is the invention's right-hand array of buttons affixed to a rigid surface, the buttons being labeled with the notes they control, thus forming a non-redundant pattern of notes, one or more of which patterns (chromatic matrices) are used on the herein disclosed embodiments of the invention.

40 Chromatic matrix 40 is the invention's left-hand array of buttons affixed to a rigid surface, the buttons being labeled with the notes they control, thus forming a nonredundant pattern of notes, one or more of which patterns (chromatic matrices) are used on the herein disclosed embodiments of the invention.

Figure 3:
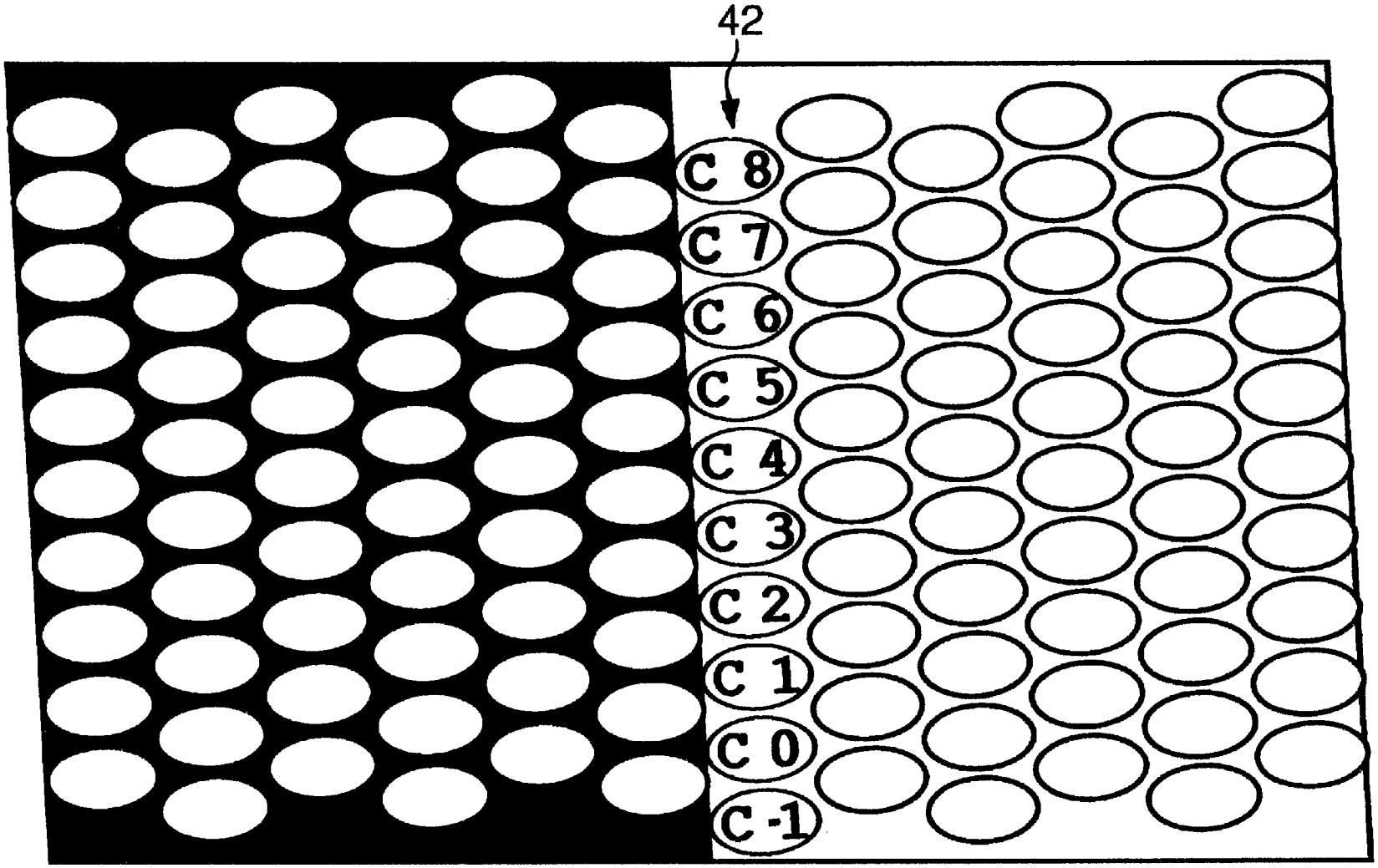
FIG. 3 is a diagram of one chromatic matrix of a right-hand sensorboard showing only a single row of eighths (octaves) in which (row) any two adjacent buttons are labeled with the notes they control, which differ from each other by an octave, or eighth interval.

42 Rows of eighths (42) are the rows of buttons and associated sensors in which the notes controlled by any two adjacent buttons differ from each other by a musical interval of an eighth (octave). Any row in FIG. 3 that is parallel with the shown row is another row of eighths. There are ten buttons per row of eighths in the embodiments shown and discussed herein; and there are twelve rows per chromatic matrix. The notes in these rows are in uniformly ascending/descending order of frequency (pitch) as shown in FIG. 3.

Figure 3A:
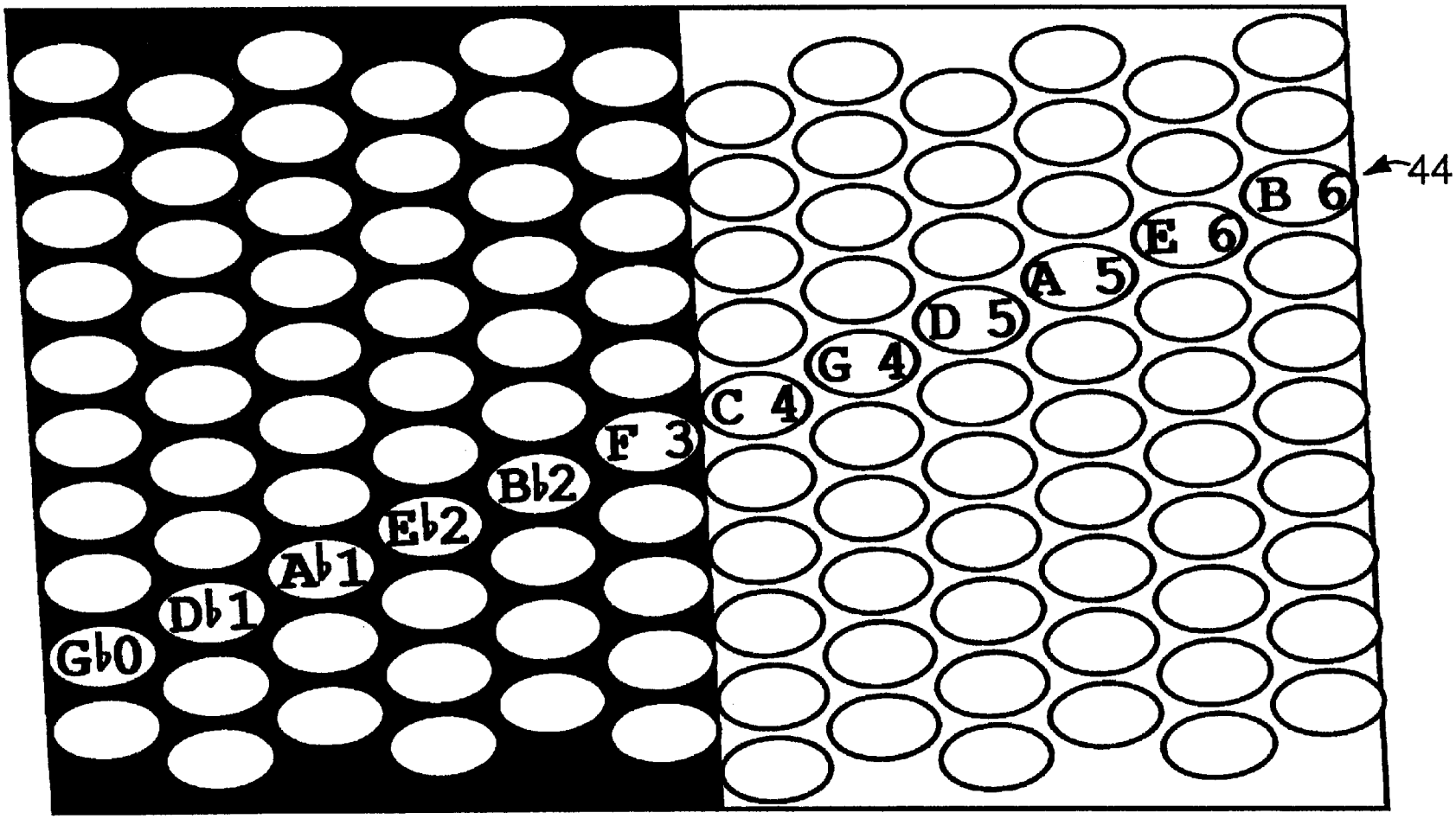
FIG. 3A is a diagram of one chromatic matrix of a right-hand sensorboard showing only a single row of fifths in which (row) any two adjacent buttons are labeled with the notes they control, which differ from each other by a fifth interval.

44 Rows of fifths (44) are the rows of buttons and associated sensors in which the notes controlled by any two adjacent buttons differ from each other by the musical interval of a fifth. Any row in FIG. 3A that is parallel with the shown row is another row of fifths.

Figure 3B:
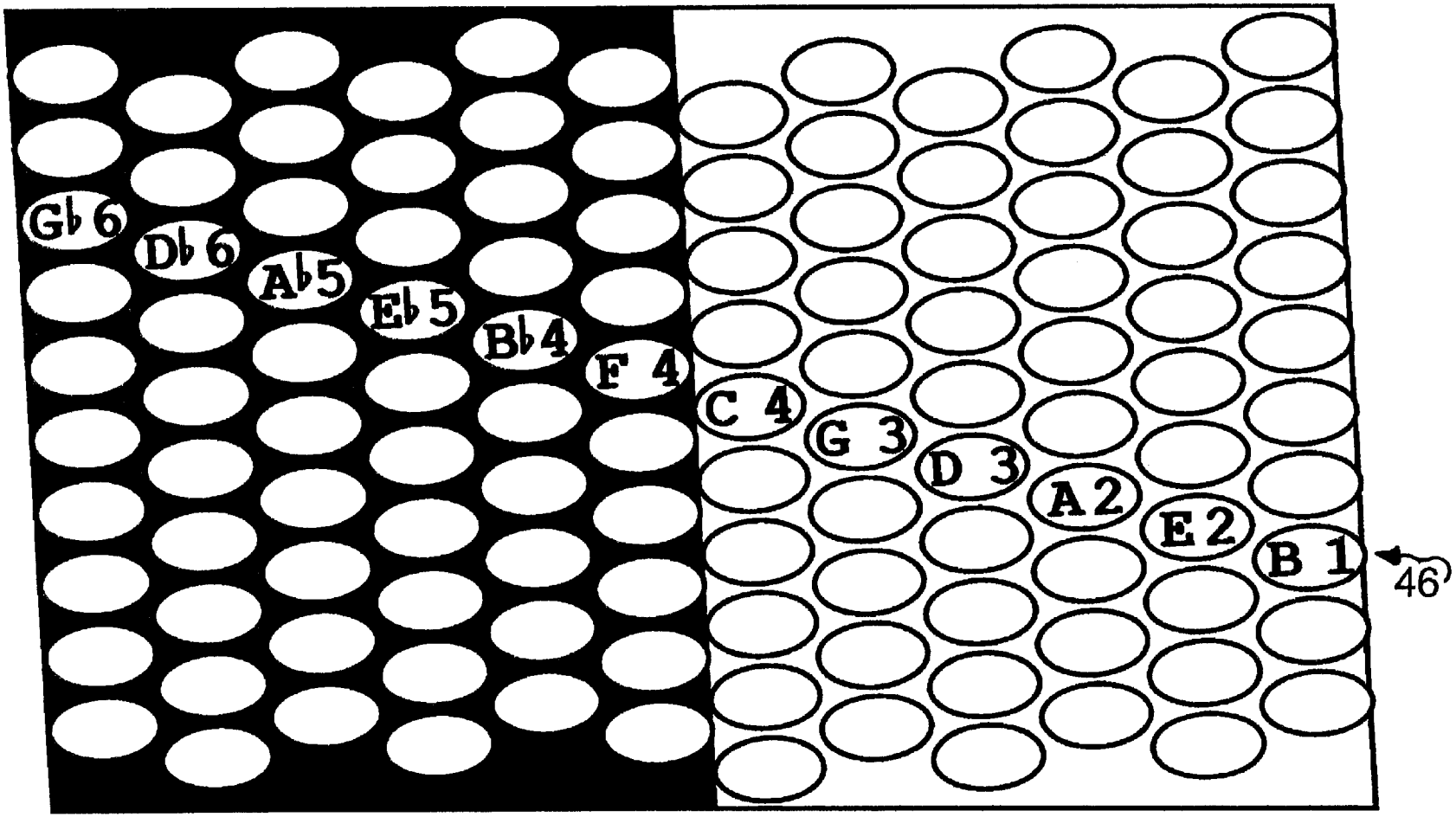
FIG. 3B is a diagram of one chromatic matrix of a right-hand sensorboard showing only a single row of fourths in which (row) any two adjacent buttons are labeled with the notes the control, which differ from each other by a fourth interval.

46 Rows of fourths (46) are the rows of buttons and associated sensors in which the notes controlled by any two adjacent buttons differ from each other by the musical interval of a fourth. Any row in FIG. 3B that is parallel with the shown row is another row of fourths.

Figure 3C:
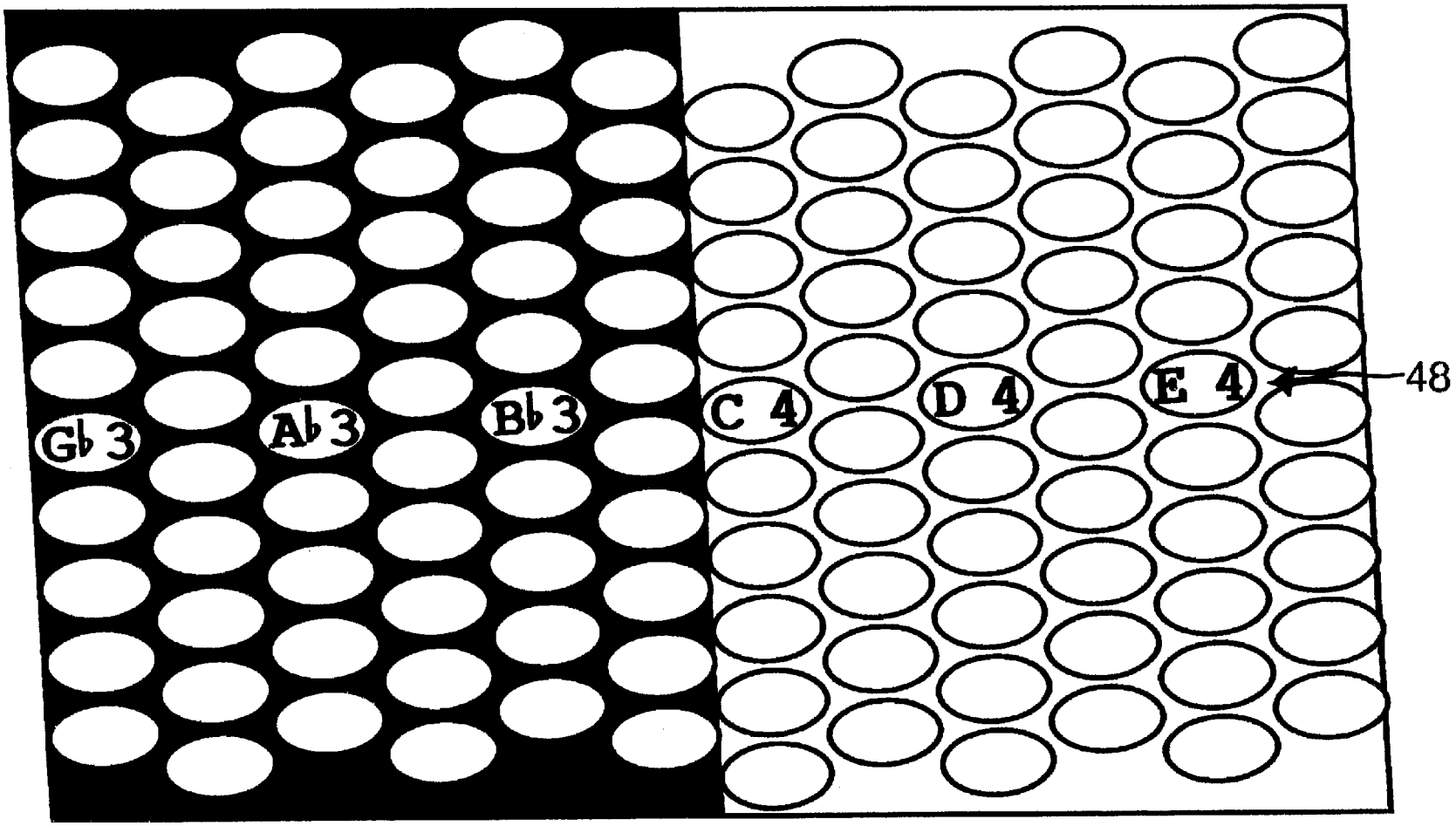
FIG. 3C is a diagram of one chromatic matrix of a right-hand sensorboard showing only a single row of whole tones in which (row) any two adjacent buttons are labeled with the notes they control, which differ from each other by a whole tone.

48 Rows of whole tones (48) are the rows of buttons and associated sensors in which the notes controlled by any two buttons in sequence along the rows differ from each other by a whole tone. Any row in FIG. 3C that is parallel with the shown row is another row of whole tones.

50 Sensorboard 50 has two identical right-hand matrices forming a convex playing surface, and is a right-hand sensorboard, which provides a playing surface with note locations arranged so as to be advantageous to a player using his right hand to play. (See section called "Operation" for discussion of right-hand sensorboards.) In the drawings herein, right-hand boards are shown below left-hand boards, for the two-sensorboard embodiments, as the directive, "below", would be understood in reference to a map or chart.

52 Sensorboard 52 presents a mirror image of sensorboard 50 and is a left-hand board, which provides a convex playing surface with note locations arranged so as to be advantageous to a player using his left hand to play. (See section called, "Operation" for discussion of left-hand sensorboards.) In the drawings herein, left-hand sensorboards are shown above right-hand sensorboards for two-sensorboard embodiments, as the directive, "above," would be understood in reference to a map or chart.

54 Sensorboard 54 (FIG. 6) has three identical right-hand chromatic matrices forming a convex playing surface.

54A Sensorboard 54A (FIG. 7) has four identical right-hand chromatic matrices forming a convex playing surface.

56 Sensorboard 56 (FIG. 6) has three identical left-hand chromatic matrices forming a convex playing surface.

56A Sensorboard 56A (FIG. 7) has four identical left-hand chromatic matrices forming a convex playing surface.

62 Bottom side (62) is a part of a housing for a sensorboard.

Long side (64) is a part of a housing for a sensorboard.

Long side (66) is a part of a housing for a sensorboard.

Short side (68) is a part of a housing for a sensorboard.

Short side (70) is a part of a housing for a sensorboard.

Connector (72) is a MIDI cable connector.

72 Connector (73) is a MIDI sustain pedal port

Connector (74) is an external power cord connector.

(deleted)

Board skin (78) is the skin, covering, layer, film, or like which in some embodiments of the invention covers the buttons or sensors and is in mechanical communication with the buttons or sensors. Any portion of the skin covering the sensors directly can effectively act as a button. This skin may be shaped to have raised or recessed areas corresponding to the location of the sensors to be activated, and may be stamped or imprinted with representations of buttons, as well as with information as note names.

80 Sensor Array 80 is an assembled instrument having sensorboards 54 and 56, both with convex playing surfaces having three chromatic matrices per playing surface. (Buttons are not shown in FIG. 11).

Figure 12:
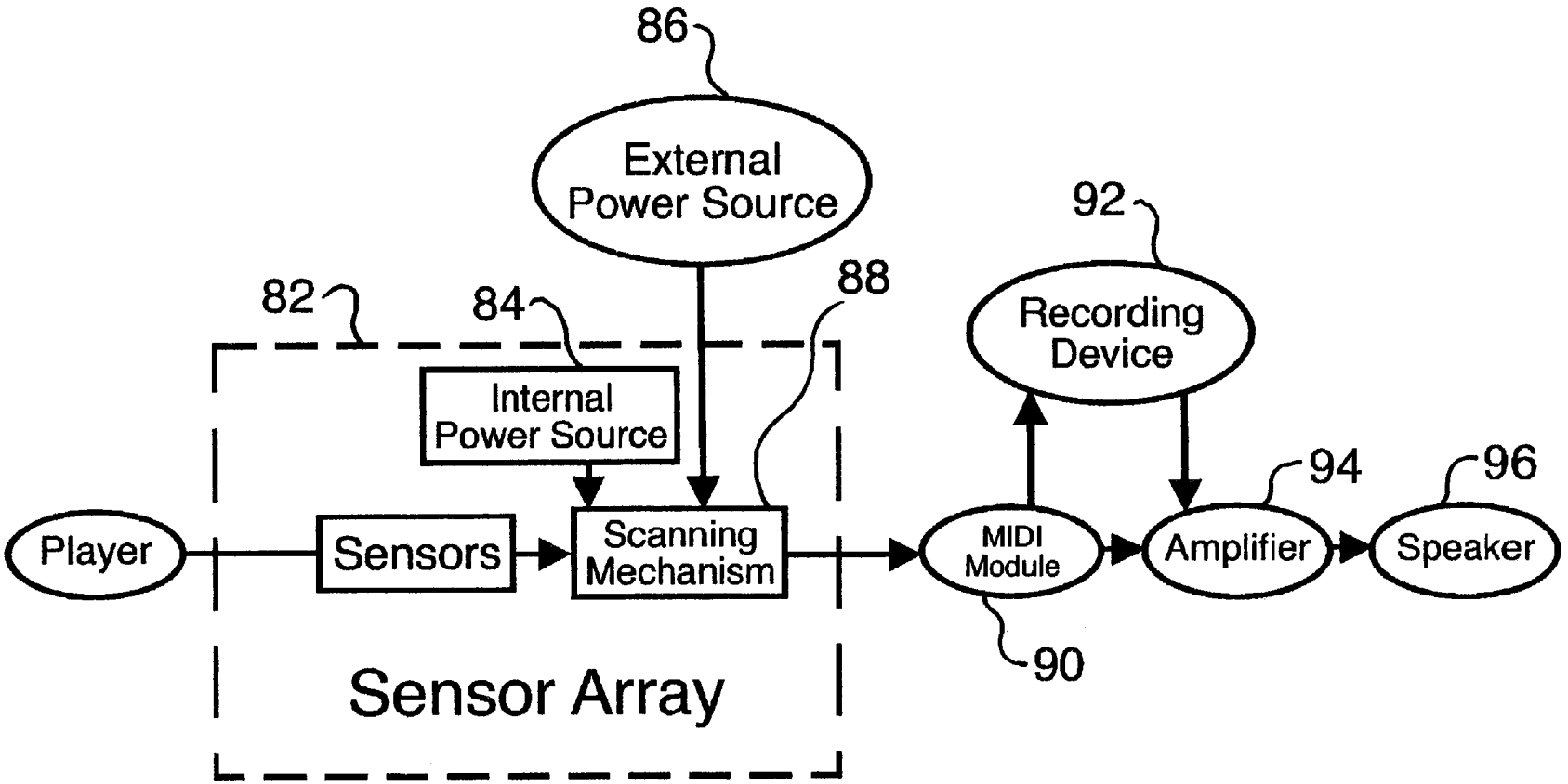
FIG. 12 is a flow chart showing the invention in combination with other devices in a music-producing system.

82 Sensor Array (82) is an abstraction indicating the present invention in communication with the music system shown in FIG. 12 or with any other music system.

84 Internal power source (84) is a battery, battery pack, AC to DC transformer, or the like, which provides power to the scanner and to other electrically powered components used in the Sensor Array.

86 External power source (86) is a wall outlet or equivalent.

88 Scanner (88) is the device that detects whether a sensor (36) has been activated, deactivated, left idle, or has otherwise changed status. The scanning mechanism used in most embodiments of the Sensor Array will be required to scan more sensors than the scanning mechanism used in most MIDI controllers. It will need to respond more quickly to changes in the state of a sensor because of the enhanced rapidity with which notes may be controlled when using the Sensor Array. The scanning mechanism used with most embodiments of the Sensor Array will ideally detect the velocity of both the activation and the release of a button. Depending on how the MIDI module is programmed to respond, the player may either initiate a note by making contact with the button and terminate the note by breaking contact; or they may initiate a note by breaking contact with a button and terminate the note by making contact with the button. The velocities at which contact with the button is made or broken can be detected by the scanner and communicated to the MIDI module where the information may be used to affect the dynamics of the note's parameters.

90 MIDI module (90) is the independent module generally used to generate signals, which are then recorded or routed through amplifiers and speakers to produce sound. (FIG. 12)

92 Recording device (92) is a DAT recorder, a cassette tape recorder, a disc recorder, or another kind of recorder. (FIG. 12)

94 Amplifier (94) is the optional amplifier used in the diagrammed music system. (FIG. 12)

96 Speaker(s) (96) is/are the optional speaker(s) used in the diagrammed music systems. (FIG. 12)

DETAILED DESCRIPTION OF THE INVENTION

Description of the Preferred Embodiment

Figure 11:
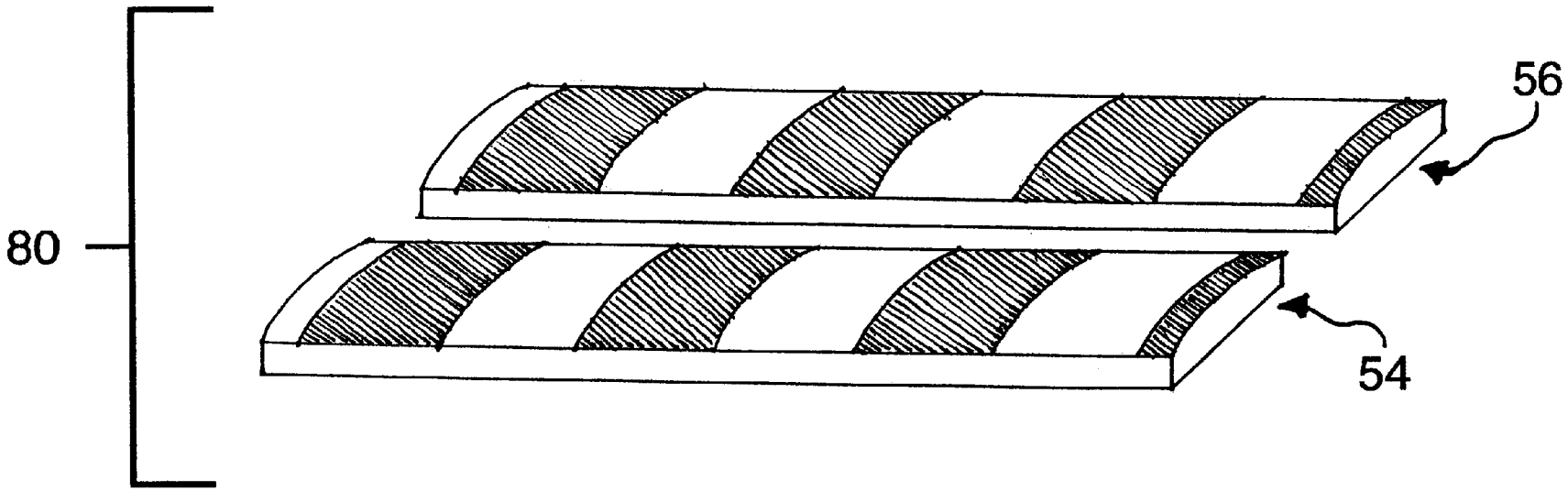
FIG. 11 is a drawing of a right-hand and a left-hand sensorboard, each with three identical chromatic matrices (right-hand on one board and left-hand on the other board), forming a convex playing surface on each board. (Buttons and sensors are not shown.) The two sensorboards may be attached together or separately placed.

The preferred embodiment of the invention comprises a right-hand sensorboard (54) and a left-hand sensorboard (56), each with three chromatic matrices (38,40). The chromatic matrices (40) on the left-hand sensorboard (56) present mirror images of the chromatic matrices (38) on the right-hand sensorboard (54). The two sensorboards (54,56) may be attached together in various ways, such as bottom-to-bottom, or may be unattached and played separately. The sensorboards (54,56) have a convex curvature on the playing surfaces, from long edge to long edge (FIG. 11.) (buttons not shown in FIG. 11).

(Sensorboard 54 will here be described, which description applies as well to sensorboard 56 except that the latter is a mirror image of the former.)

Figure 1:
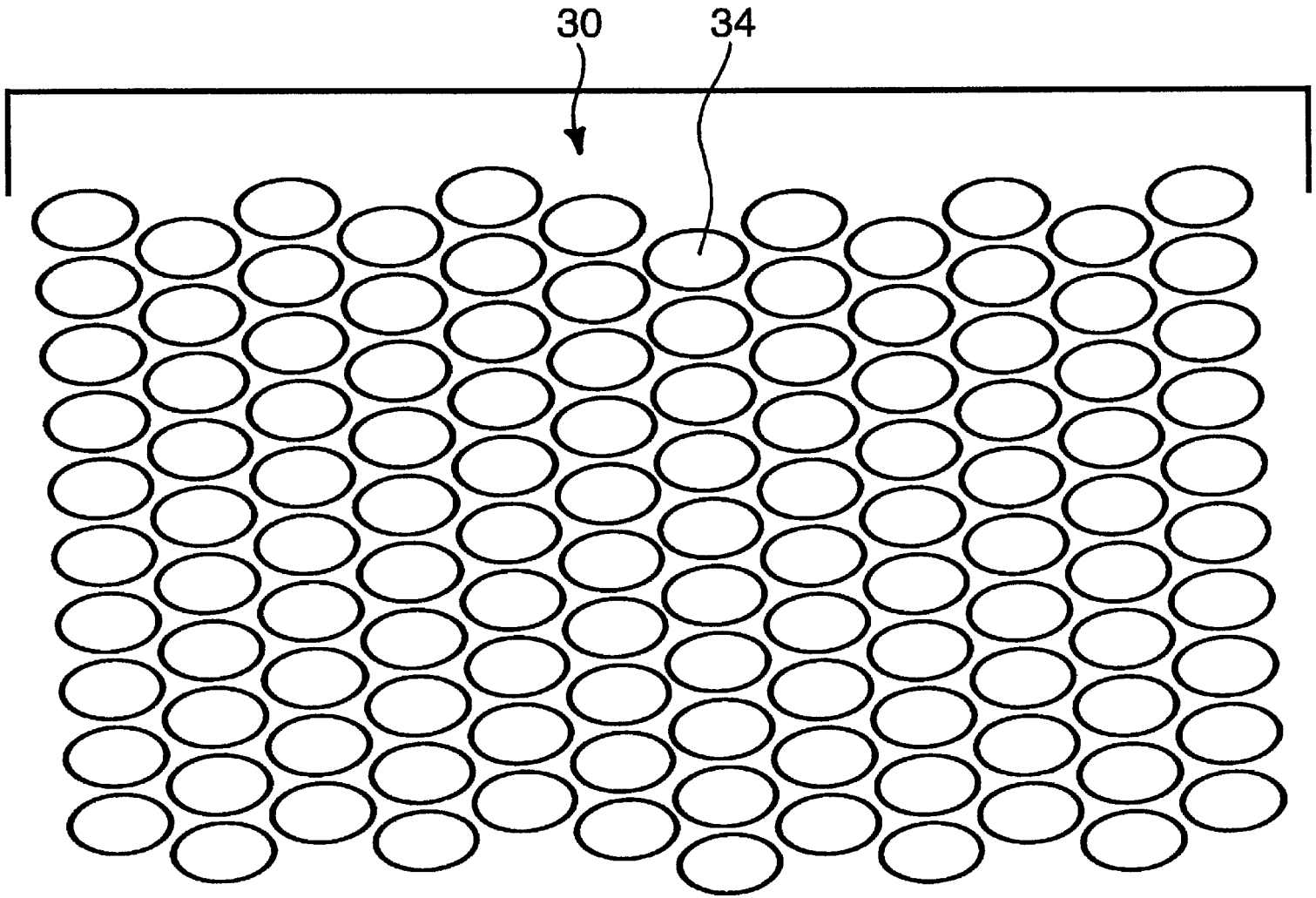
FIG. 1 is a diagram of the basic right-hand array of buttons used with the herein disclosed embodiments of the invention.
Figure 1A:
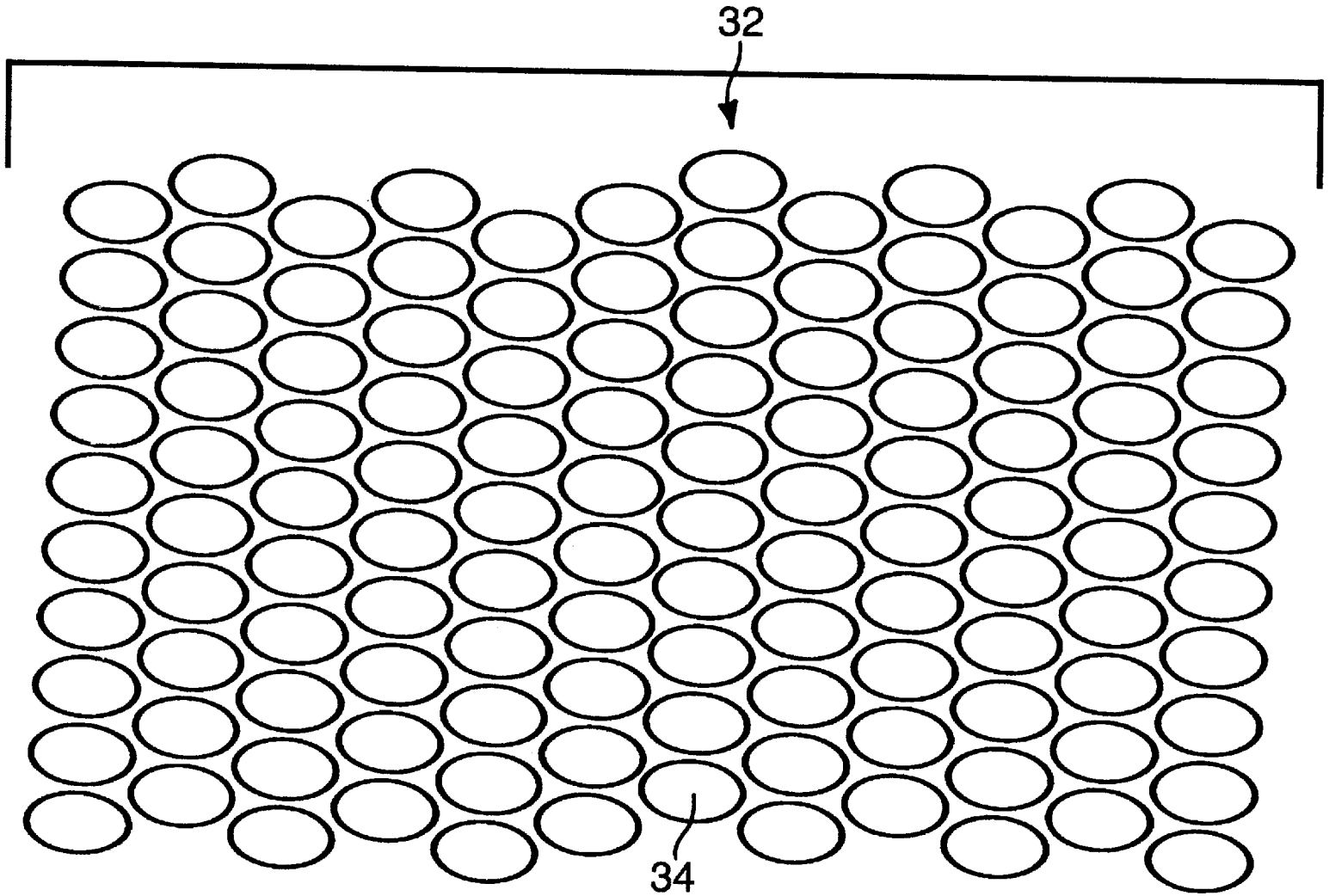
FIG. 1A is a diagram of the basic left-hand array of buttons used with the herein disclosed embodiments of the invention.
Figure 4:
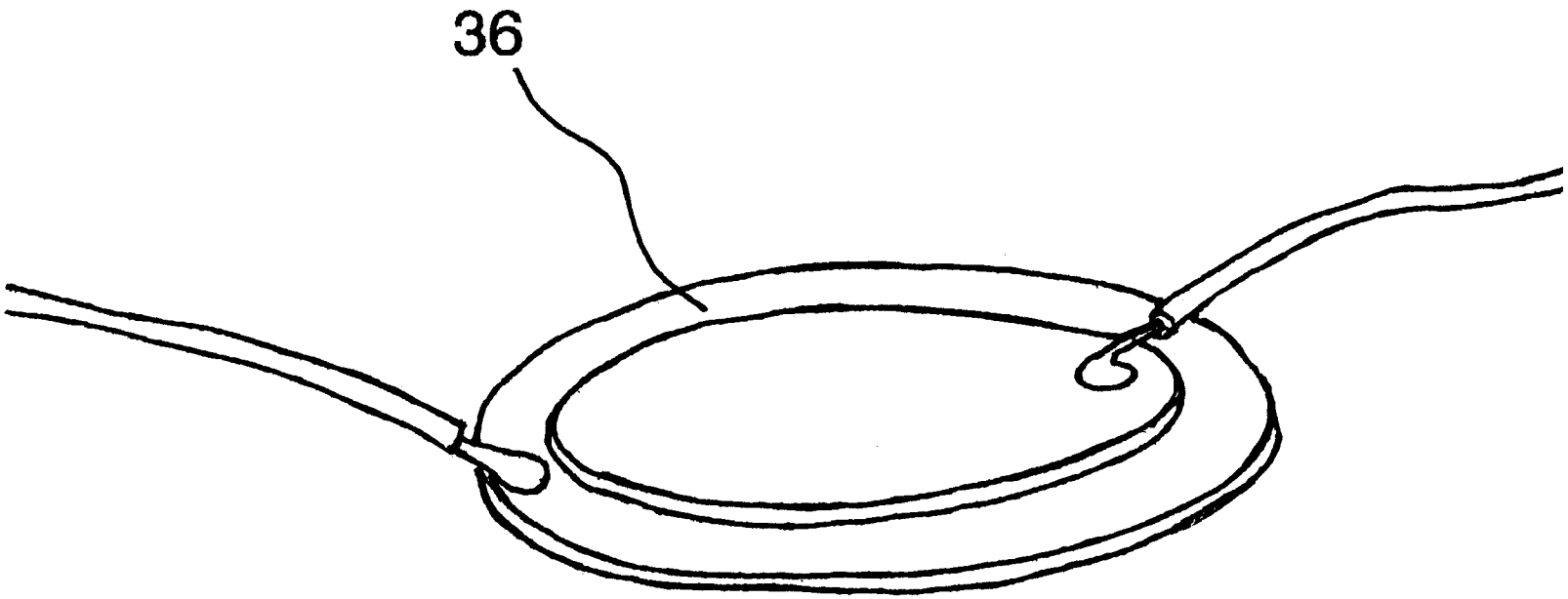
FIG. 4 is a diagram showing a sensor that may be electrically connected to a scanner to activate MIDI numbers when the sensor's button is activated.

There is an array of buttons (34, FIG. 1, FIG. 2) on the top surface of sensorboard 54, and a corresponding sensor (36, FIG. 4) for each button (34), the sensors (36) being affixed to the playing surface under the buttons (34). Alternatively, the sensors (36) are in communication with a board skin (78, FIG. 10), which (skin) may directly touch the sensors such that the skin (78) can act as buttons.

Figure 6:
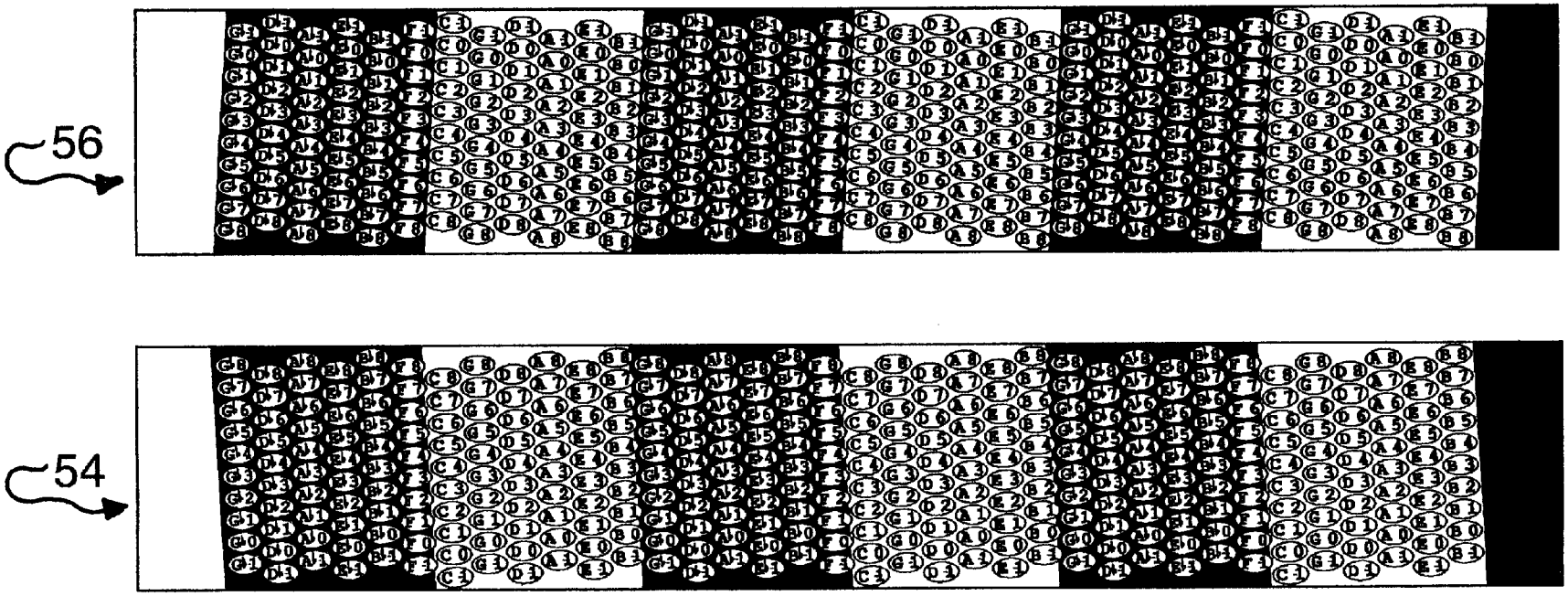
FIG. 6 is a diagram of a right-hand and a left-hand sensorboard, with buttons and associated sensors affixed to their top surfaces (sensors not shown). Each has three identical chromatic matrices (right-hand on one board and left-hand on the other board), forming a convex playing surface on each board. The two boards may be attached together or separately placed.

The buttons (34) and sensors (36) are arranged to form three chromatic matrices (38 FIG. 2) and see FIG. 6. The sensors (36) are each separately and electrically connected to scanning mechanism 88 (FIG. 12) with wiring, or with electrically conducting strips, or with an electrically conducting material such as conducting paint, or with circuits on a printed circuit board, or the like.

Figure 8:
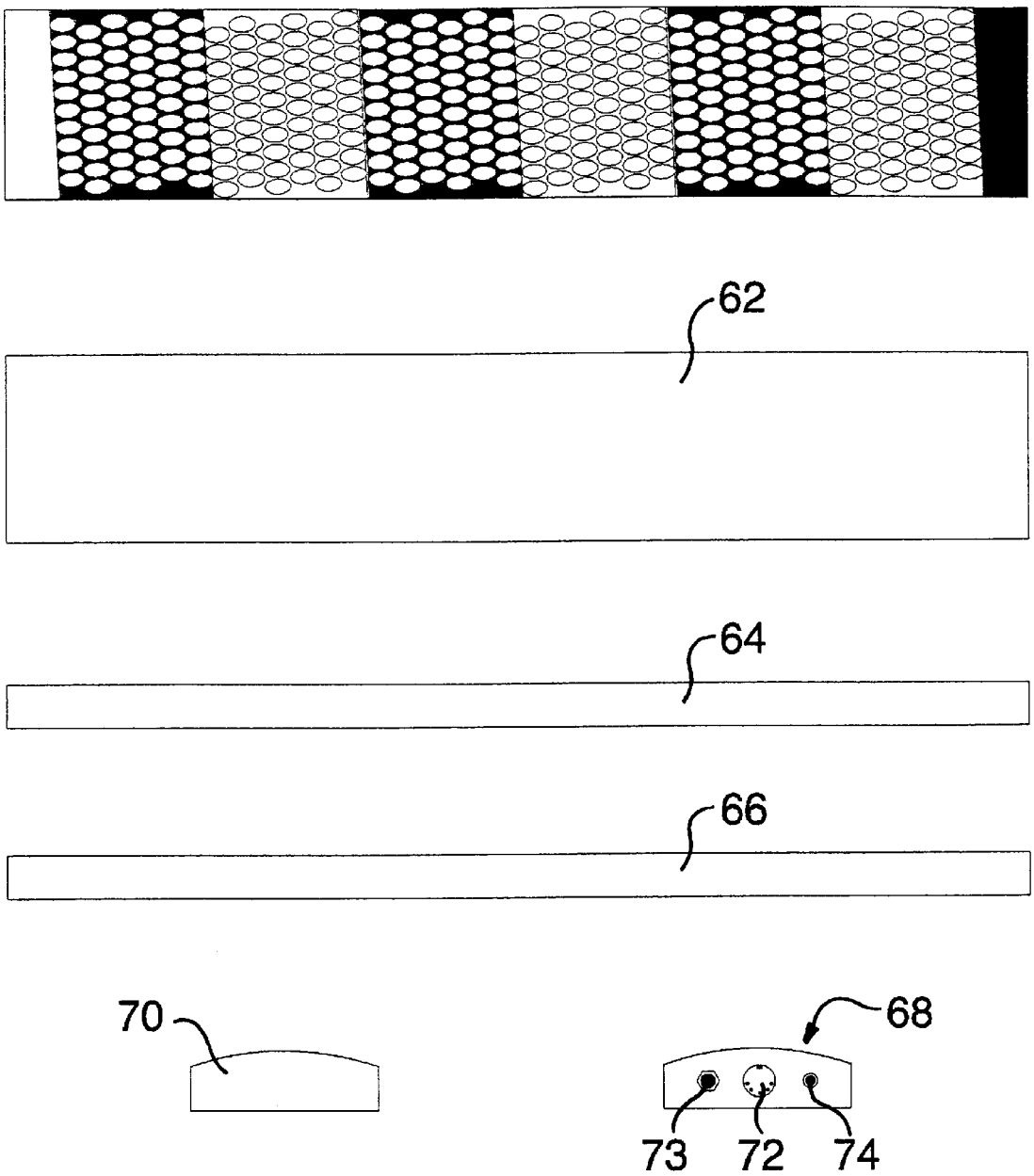
FIG. 8 is a diagram of a sensorboard and the various parts of its housing.
Figure 9:
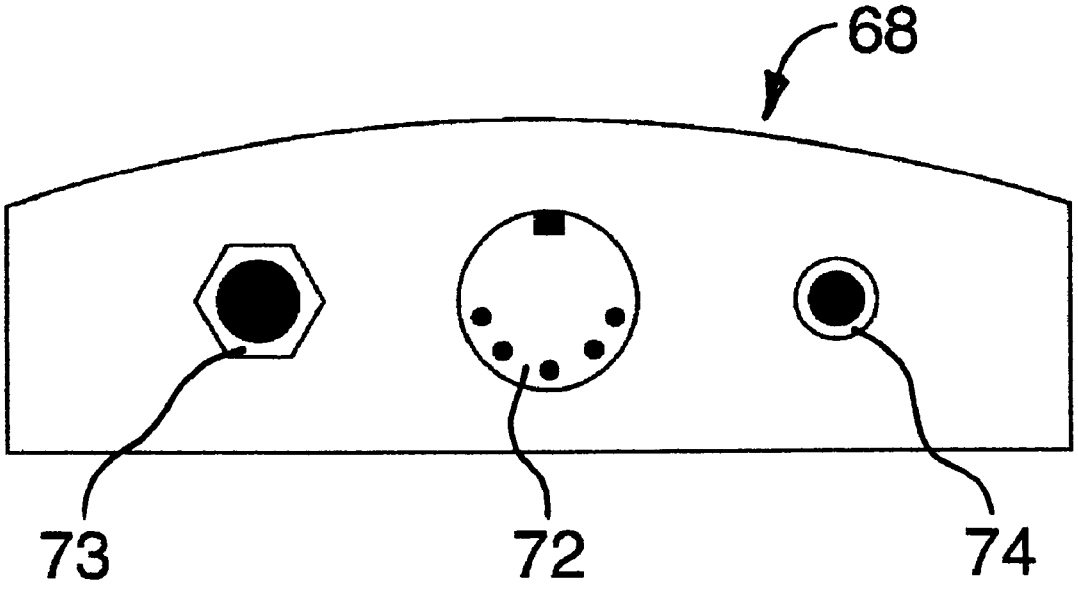
FIG. 9 is a larger view of the housing for the connectors as seen in FIG. 8.

Scanner 88 is contained within the housing of sensorboard 54 (see FIG. 8) and is connected to an external MIDI cable at MIDI cable connector (72, FIG. 8), which (connector) is built into the housing of sensorboard 54. Scanner 88 is wired to external-power cord connector (74, FIG. 8), as well as to sustain pedal port (73, FIG. 8), which are both built into the housing of sensorboard 54.

The MIDI cable is connected at its other end to MIDI module 90 (FIG. 12), which is a module commanding functions which are controlled by the Sensor Array. A radio transmitter may alternatively send the MIDI information from scanner 88 to a receiver attached to MIDI module 90 to effect an electrical communication from sensorboard 54 to the module without use of a MIDI cable.

In musical applications said module 90 is the determining component for the sound. Under the control of the Sensor Array it generates a signal that is then delivered to a recorder (92) or directly to an amplifier (94) and speakers (96) as shown in FIG. 12.

Figure 13:
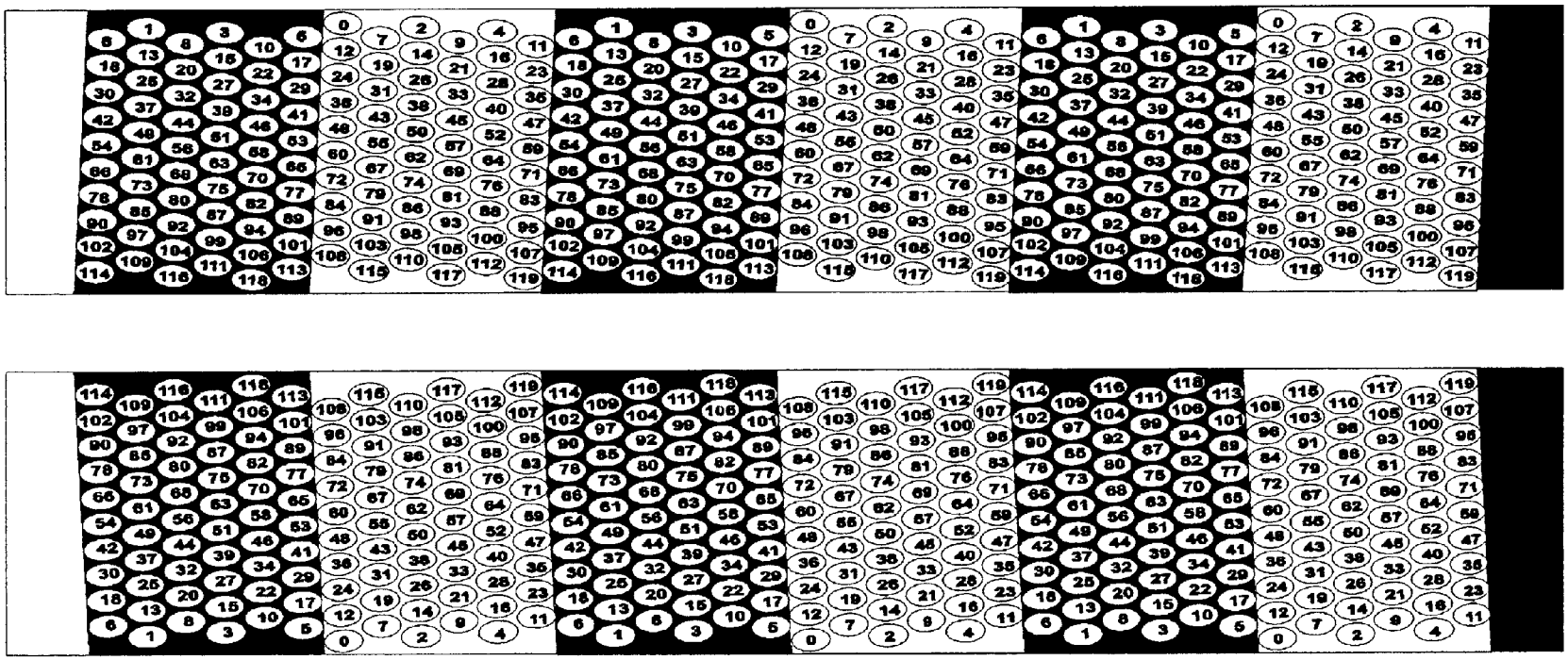
FIG. 13 is a diagram of a right-hand and a left-hand sensorboard, each with three chromatic matrices and, on the buttons, their associated MIDI numbers.

Each chromatic matrix is on a separate MIDI channel. The same set of MIDI numbers appears in each of the three chromatic matrices of sensorboard 54 and in each of the three chromatic matrices of sensorboard 56) (FIG. 13.). Therefore, with the use of standard intonation there are three locations of any given note on each of the playing surfaces. Sensor mechanisms may be resistive, capacitive, inductive, transductive, or a combination of any of these.

This preferred embodiment of the Sensor Array is defined as a generalized MIDI controller comprising two sensorboards (54, 56) with buttons (34) arranged such that the sensorboards (54, 56) are mirror images of each other. Each board comprises three identical chromatic matrices (38, 40), and each chromatic matrix (38.40) is divided into two sections, each with a different background color or shade. The two sections in each chromatic matrix each include 6 adjacent rows of eighths (42, FIG. 4). The left-to-right order of the letter names of the notes of the rows of eighths (42) in the leftmost sections of the sensorboard's chromatic matrices (FIG. 6) is: the flats of G, D, A, E, B, and the natural of F. The left-to-right order of the letter names of the notes in the rightmost sections of the sensorboard's chromatic matrices (FIG. 6) is: the naturals of C, G, D, A, E, and B.

The edges and the ends of the sensorboards in this preferred embodiment may optionally have space for additional MIDI controller functions, such as a volume controller, a pitch bend wheel, a modulations wheel, a breath controller, a bank select, or ports for additional external controllers.

Positioning Buttons on a Sensorboard (It is a given that: a square is a type of rectangle, and a rectangle is a type of parallelogram.)

Figure 5:
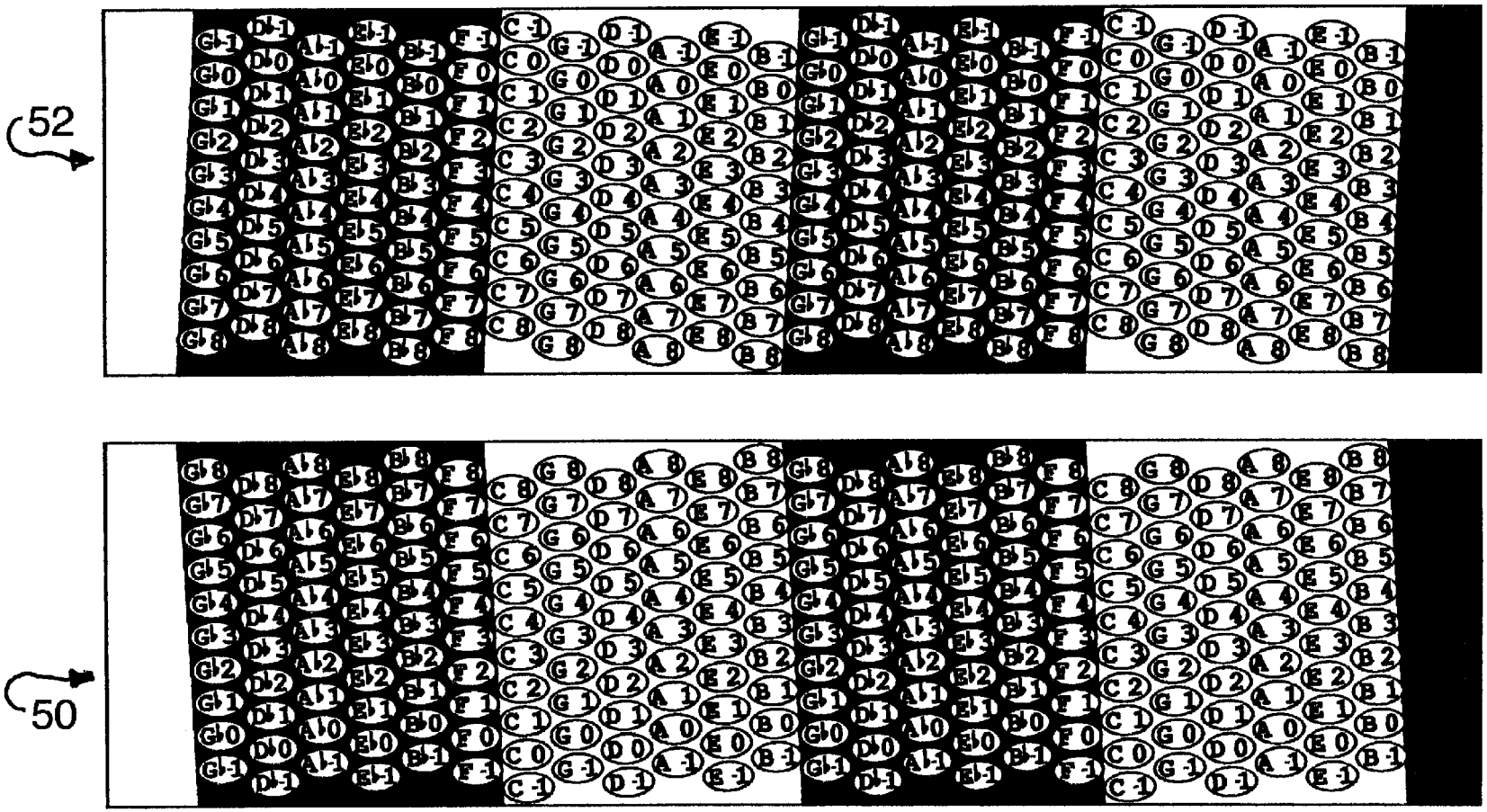
FIG. 5 is a diagram of a right-hand and a left-hand sensorboard, with buttons and associated sensors affixed to their top surfaces (sensors not shown). Each sensorboard has two identical chromatic matrices (right-hand on one sensorboard and left-hand on the other sensorboard), forming a convex playing surface on each sensorboard. The two sensorboards may be attached together or separately placed.

Two conditions must be met in positioning a button within a parallelogram-shaped area on a sensorboard. (FIG. 5B) First, buttons controlling notes differing by successive semitones must progress so as to be located on successive dividing lines between units of distance that partition the width of the parallelogram. Second, buttons controlling notes whose letter names represent successive steps in the circle of fifths must progress so as to be located on successive dividing lines between units of distance that partition the length of the parallelogram.

Modifications of the Preferred Embodiment

Figure 7:
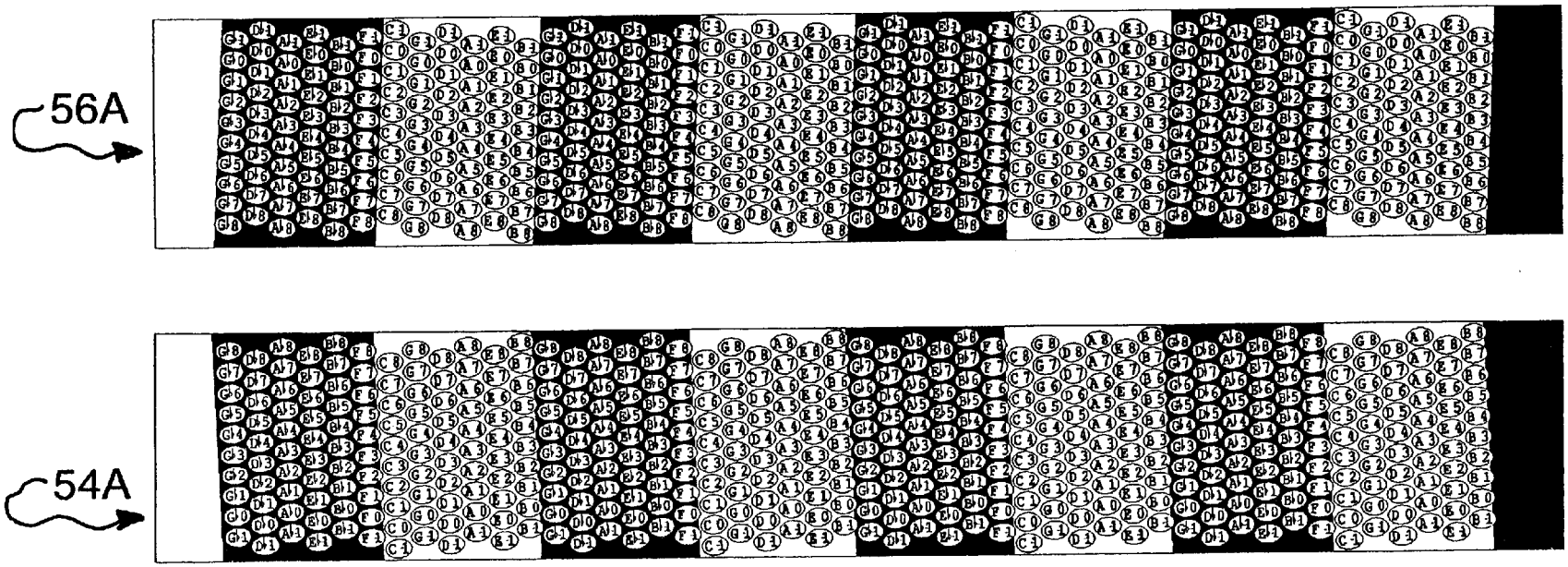
FIG. 7 is a diagram of a right-hand and a left-hand sensorboard with buttons and associated sensors affixed to their top surfaces (sensors not shown). Each has four identical chromatic matrices (right-hand on one board and left-hand on the other board), forming a convex playing surface on each board. The two boards may be attached together or separately placed.

A two-sensorboard Sensor Array may have only two chromatic matrices per playing surface, (FIG. 5), or may have four or more chromatic matrices per playing surface. (FIG. 7)

The advantages of two-chromatic matrices per sensorboard embodiments would include relatively smaller size, fewer buttons, smaller printed circuit board, and therefore lower cost to manufacture. The supportive electronics would also be somewhat simpler as there would be fewer required electrical connections, including fewer MIDI channels (one per chromatic matrix.)

Embodiments with Only One Sensorboard

Figure 5A:
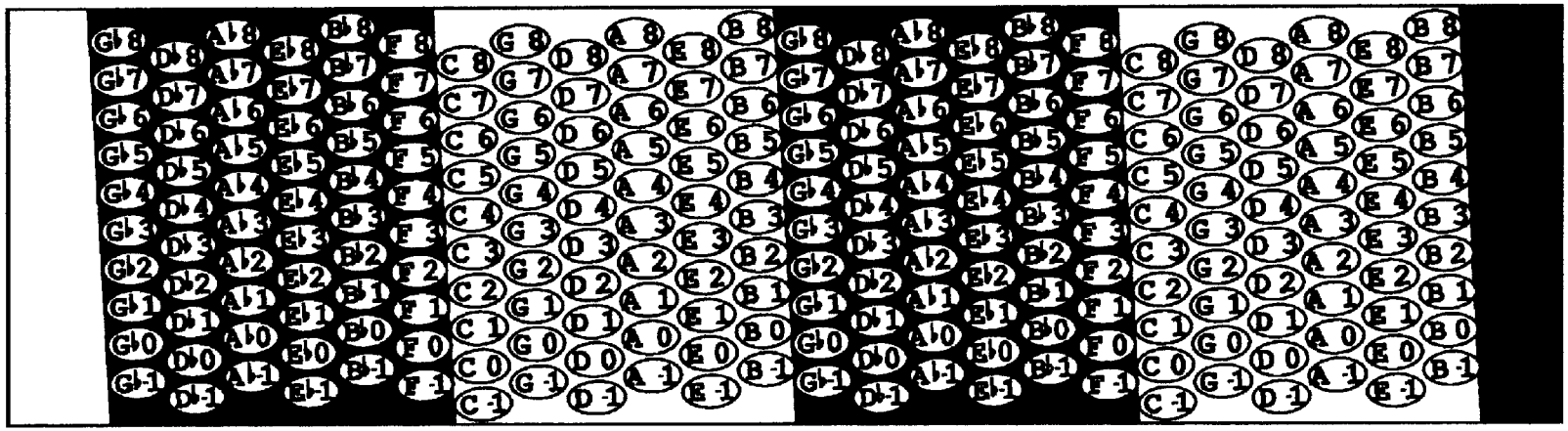
FIG. 5A is a diagram of a right-hand sensorboard, with a table listing in the leftmost column each of the key signatures of the major scale. In the boxes to the right of any given key signature are the notes that make up that key signature above their respective positions on the sensorboard. (Some of the notes shown for some key signatures are the enharmonic equivalents of the notes shown on the sensorboard.)
Figure 5B:
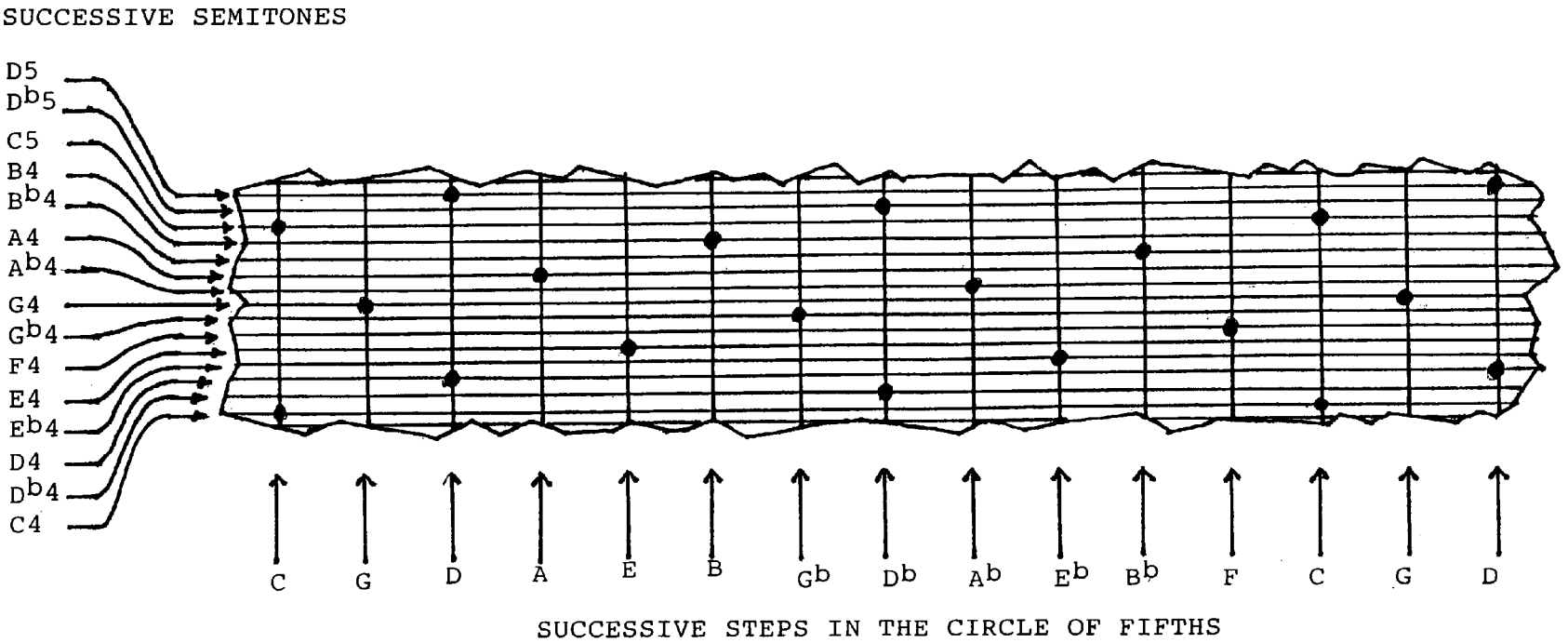
FIG. 5B shows a sensorboard with less than the minimum of two chromatic matrices necessary to construct a full capacity musical instrument. The figure is solely intended as a table demonstrating the system by which buttons may be positioned on a sensorboard.

One -sensorboard embodiments could have one or more chromatic matrices per sensorboard. While a one-chromatic matrix could be functional in control panel applications, two or more chromatic matrices are required for musical instrument applications. (FIG. 5A)

Figure 24:
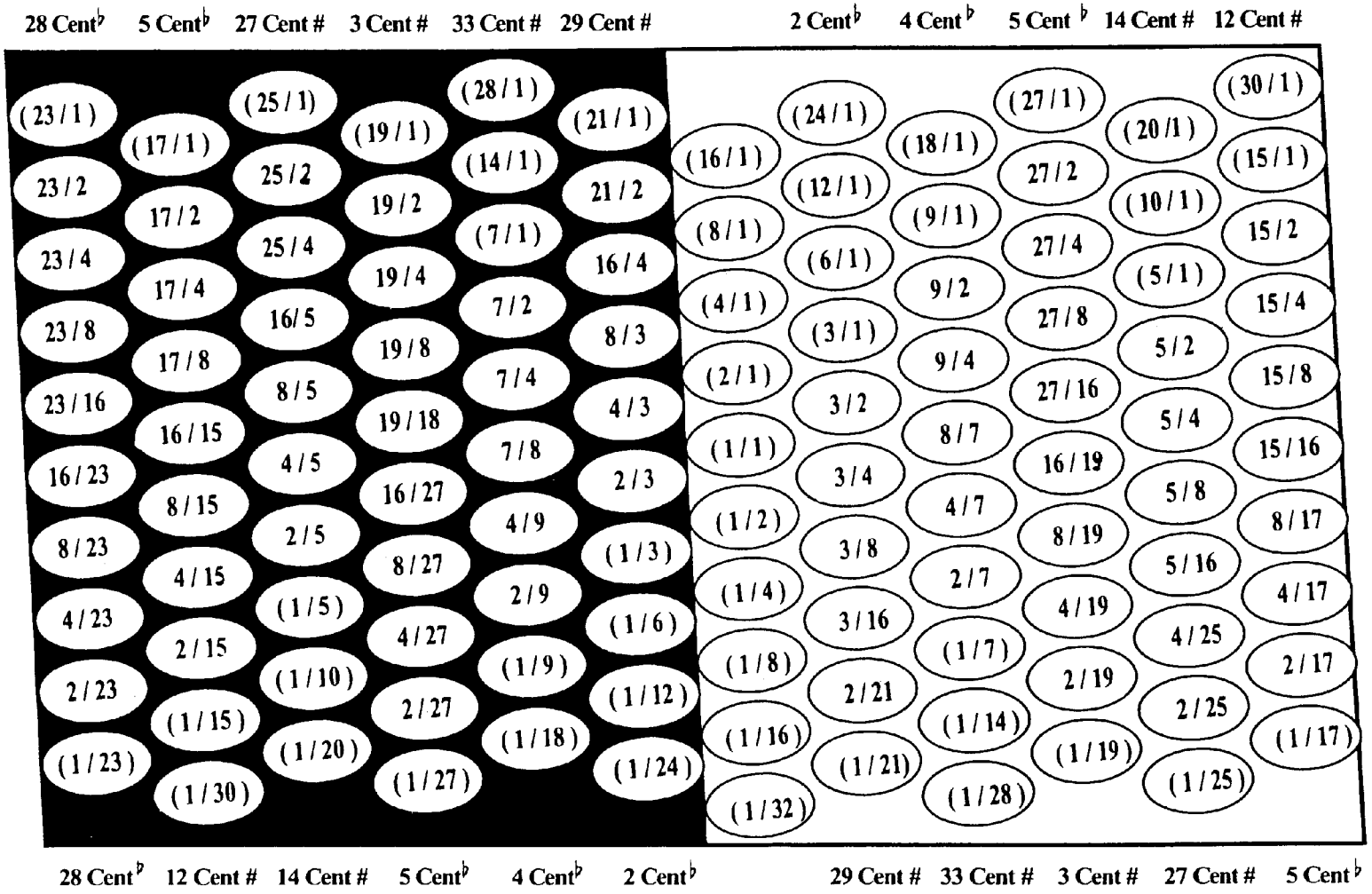
FIG. 24 is a diagram of one chromatic matrix of a right-hand sensorboard showing at each button a ratio which represents the approximate frequency ratio between the note controlled by the given button with respect to the note controlled by the button designated as "1/1". Buttons showing ratios in which the numerator is greater than the denominator control notes higher in frequency than "1/1," while buttons showing ratios in which the numerator is less than the denominator control notes lower in frequency than "1/1". Ratios shown in parentheses in which the denominator is "1" indicate notes whose tunings approximate a harmonic relationship to the note labeled "1/1"; while ratios shown in parenthesis in which the numerator is "1" indicate notes whose tunings approximate a subharmonic relationship to the note labeled "1/1".
Figure 24A:
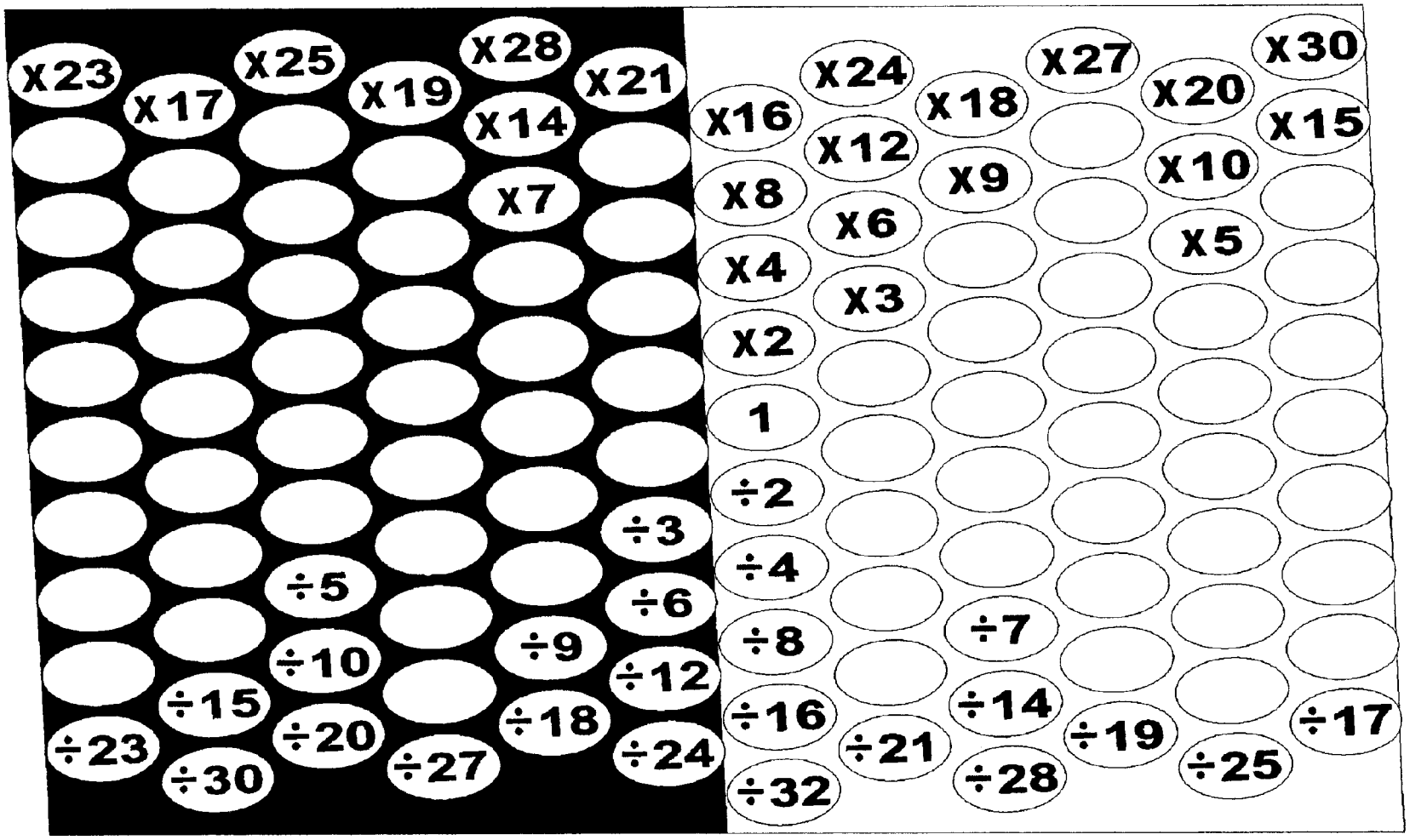
FIG. 24A is a diagram of one chromatic matrix of a right-hand sensorboard with numbers shown only on those buttons which activate notes whose tunings approximate a harmonic or subharmonic relationship to the note activated by the button indicated by the number "1". Any button shown with a multiplication sign followed by a number activates a note whose tuning approximates the harmonic that the number designates; while any button shown with a division sign followed by a number activates a note whose tuning approximates the subharmonic which the number designates.
Figure 24B:
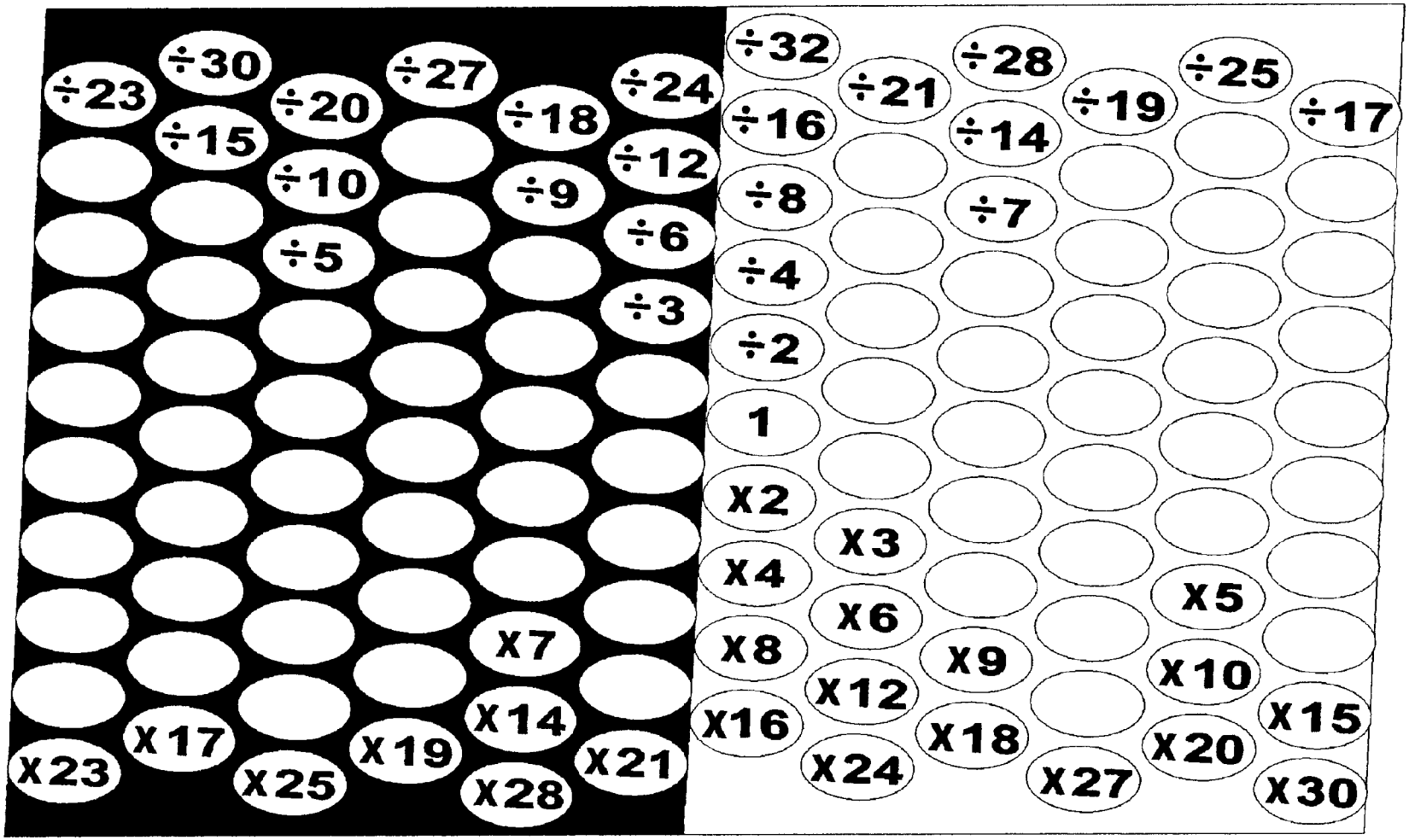
FIG. 24B is a diagram of one chromatic matrix of a left-hand sensorboard with numbers shown only on those buttons which activate notes whose tunings approximate a harmonic or a subharmonic relationship to the note activated by the button indicated by the number "1". Any button shown with a multiplication sign followed by a number activates a note whose tuning approximates the harmonic that the number designates; while any button shown with a division sign followed by a number activates a note whose tuning approximates the subharmonic which the number designates.
Figure 26:
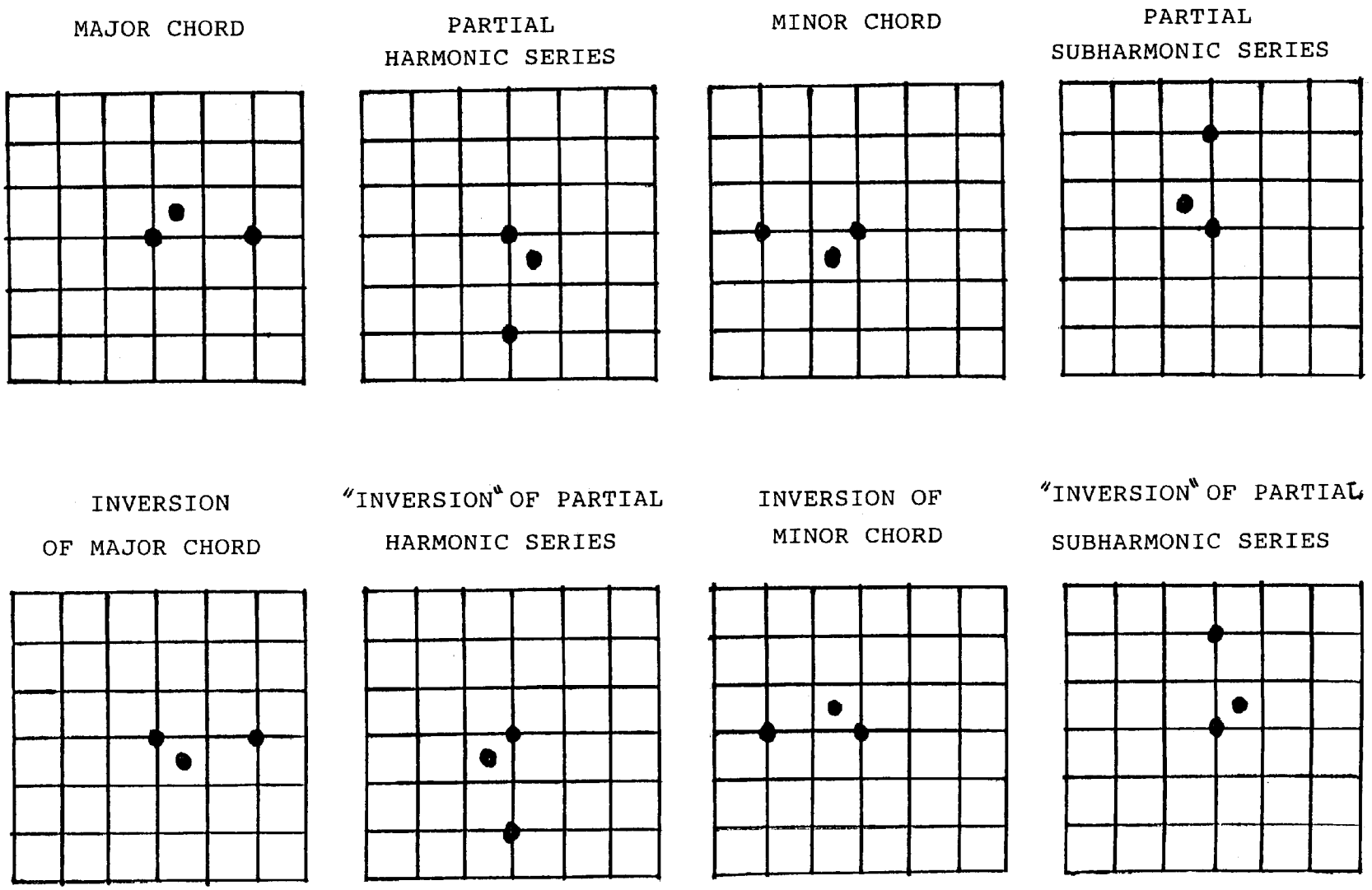
FIG. 26 is a diagram of eight identical tablature grids showing how the same notated pattern of buttons has up to eight possible orientations.

A right-handed player may prefer a single, right-hand playing surface, while a left-handed player may prefer a single, left-hand playing surface; because, in either case, the dominant hand more easily accesses the note combinations whose tuning approximates harmonic overtones or subharmonic undertones (see FIGS. 24, 24A, 24B). Such a one-sensorboard embodiment would also have less spatial area for a player to deal with, and half as many buttons as a two-sided or two-sensorboard embodiment.

A one-sensorboard embodiment with four chromatic matrices, either right-hand or left-hand, would have application when alternative tunings are used which require more notes than are possible on an embodiment having fewer than four chromatic matrices.

Various Kinds of Buttons for the Sensor Array

The dark and light backgrounds that divide each chromatic matrix into two areas, as shown in the various drawings, are optional, and other color features could be substituted, such as a solid color background but with light and dark buttons. The Sensor Array may have two shades or colors of buttons which (colors) may vary or alternate from one row of eighths (42) to the next in order to highlight the two whole tone scales. Elliptical buttons may be used with the shape of the ellipse selected according to ergonomic principles. The circle may be considered a special, unique case of an ellipse with one, rather than two, loci. Elliptical buttons may be ellipsoidal, or they may be frusto-ellipsoidal, that is, ellipsoidal and additionally with a cut-off top surface.

The Sensor Array may have egg-shaped buttons (as when viewing the top of an egg along its longest axis). This kind of button may have the smaller end of the "egg" pointing uniformly in either the rising or the falling direction of the rows of fourths (44) or the rows of fifths (46). This arrangement would be particularly useful in giving the player tactile feedback about her orientation to the board or boards she is playing on. This tactile feedback would result from the difference in size between the opposite ends of the egg-shaped buttons.

There may be frusto-conical buttons with concave top surfaces on a Sensor Array. This kind of button is essentially volcano shaped, and affords the player an enhanced grip on the button because fingertips fit into the concave depression at the top of the button, which allows sideways as well as downward pressure to be exerted on the button.

A variety of button types may be used on a given playing surface, provided that the various button mechanisms activate MIDI numbers in a pattern shown in the drawings.

Self-returning joysticks may be used instead of buttons. The joysticks may optionally have a frusto-conical shape with a concave depression at the top, which would allow easier gripping and variation in the precise angle of approach of the finger during activation. The angle or pressure at which such a joystick is held after the initial activation could be used to impart polyphonic after-touch information to the MIDI module.

Various Sensorboard Dimensions for the Sensor Array

The general size of the Sensor Array may vary considerably. One embodiment could be large enough to cover a dance floor, which embodiment could be used to allow a dancer, or a group of dancers, to produce and control music by controlling the choice and timing of the dance steps that are employed. Another embodiment might consist of a portable and self-contained unit that comes with MIDI modules, amplifiers, speakers, battery compartment, and external power port built into the housing of the sensorboard. This embodiment could be miniaturized to fit inside a small space, such as a pocket or a handbag.

The Sensor Array's relative dimensions may vary, the sizes and distances in the vertical and horizontal axes varying relative to each other. For example, buttons could be 1.25 inches apart horizontally and 0.25 apart vertically.

Possible Additional Variations in Components of the Sensor Array

Other embodiments of the Sensor Array might include a spherical or cylindrical board or another geometrically-shaped board, any of which could afford the player a particular effect or application. One, or two chromatic matrices could be wrapped around a cylinder with the highest and the lowest notes at the two ends of the cylinder in such a way that the matrix, or matrices, form a playing surface configured as a continuously generalized ring. An area could be reserved for mounting or attaching the instrument to a stand, or for the player to grip or hold the instrument.

A similar mapping of a chromatic matrix or a set of chromatic matrices onto a continuously generalized sphere would require the mapping of those buttons which control the highest and lowest notes to be closest to the "poles" of the sphere, and in closer proximity to each other than would be buttons further away from the "poles", for instance, at the "equator". A sphere could be treated as a ball and be bounced or rolled to create interesting musical effects. Some other geometrically-shaped Sensor Arrays could require similar non-linear mappings of buttons.

The Sensor Array could have more or fewer than ten buttons per row of eighths. The sensor field could extend or contract into almost any two-dimensional shape.

The Sensor Array's sensors could be mounted or installed on a flexible or semi-flexible fabric or material, rather than a rigid material.

The Sensor Array might have an area without buttons to allow for a pitch bend wheel, a volume controller, or other function controller, or for a means, such as a remote, to communicate or transmit the MIDI signals to a receiver and then to a processor. The means of communication between the cylinder, sphere, or other geometrically-shaped Sensor Array and the MIDI module may be one or more infrared or radio frequency remotes located within said cylinder, sphere, or other geometrically-shaped Sensor Array.

Figure 27:
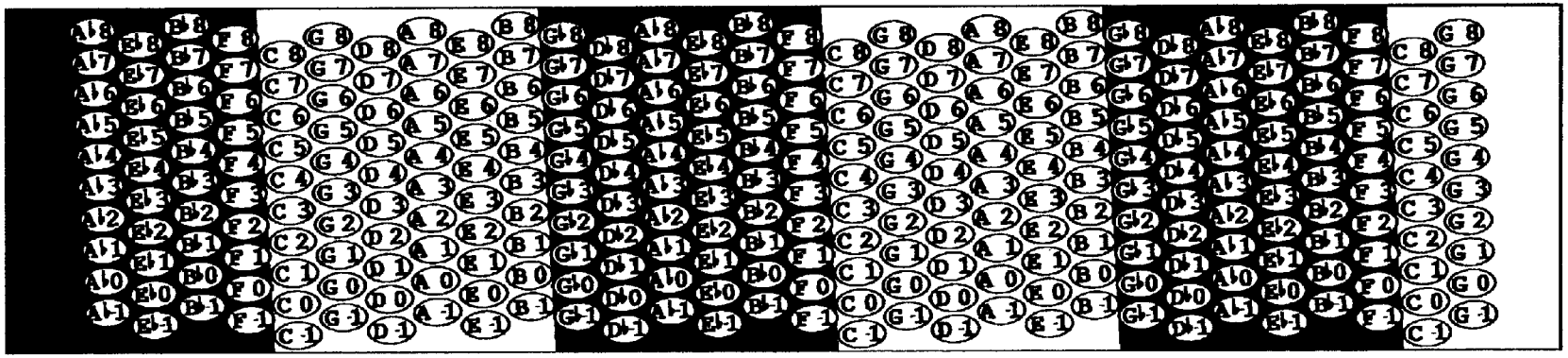
FIG. 27 is a diagram of a right-hand sensorboard with buttons and associated sensors affixed to its top surface (sensors not shown) with two complete chromatic matrices and, at each of its shorter edges, an incomplete chromatic matrix.

A Sensor Array may feature a sensor board that has been cropped so that an incomplete chromatic matrix terminates at one or both of its shorter edges (FIG. 27)

PLAYING THE SENSOR ARRAY MIDI CONTROLLER

The Sensor Array offers as many options to the composer of music as to the performer. The arrangement of the notes allows musical relationships to be visualized with optimal clarity such that music theory may provide maximal utility to both composer and performer, and may be readily taught and studied. (FIGS. 14,19,20,21,23,24) With a MIDI module that is designed to notate music the Sensor Array may serve as a musical typing and editing station. The Sensor Array may be used in conjunction with automated music production systems serving as the MIDI module, such as those that provide multi-track recording, sequencing, sampling, looping, rhythm generation, and effects processing. A MIDI module can be hardware-based; or it can be a computer loaded with appropriate software.

Because the Sensor Array Midi Controller is generalized, the fingering pattern for the same piece of music is always the same regardless of its key signature or range. This means that once a scale or chord is memorized or improvised one may simply change the location of the hand over the Sensor Array's playing surface to change the key signature or range of the chord or scale. (FIG. 5A)

Because the Sensor Array Midi Controller features rows of closely spaced buttons producing notes related by eighths, changing the range of a chord or scale by octaves involves very little movement of the hand. Arpeggiating a chord or scale involves repeating the same fingering pattern at incrementally increasing or decreasing distances across the short axis of the playing surface of the Sensor Array. (FIGS. 15,16,17,18) This completely avoids the hand crossovers necessitated by the use of the standard keyboard, which (keyboard) distributes range across the long axis rather than the short axis. Changing the key signature of a chord or scale on the Sensor Array is achieved by changing the position of the chord or scale' fingering with respect to the long axis of the playing surface, which changes are generally made infrequently. (FIG. 5A)

On the Sensor Array MIDI Controller all the notes of a major scale and its modes will be united together in a common area such that notes that are not part of the scale are outside the borders of the area. As long as the player confines her fingering to the given area she will activate only notes which belong to the scale. (FIGS. 5A,14,19) This allows a great deal of freedom to the player, such that any geometry of motion which stays inside the borders of the area may be utilized without fear of activating notes which don't belong in the scale. The player may instigate slides across buttons that control notes related by octaves, fifths, and fourths, as well as other intervals, while staying within the borders of the described area. (FIGS. 3,3A,3B,3C) The buttons within the area may be activated with a strumming motion, allowing rapid flurries of notes to be played while staying within the scale.

Fingering Techniques

Playing the Sensor Array with the fingers allows a variety of techniques to be used. One may play the instrument with the tips of the fingers, with the fingernails, with the pads of the fingers, or with the knuckles or topside of the fingers. One may play the Sensor Array with one or more fingers, and with the fingers held close together or spread apart. When the fingers are held close together and placed on the playing surface, the notes played will be more musically coherent than if the fingers are spread apart and so placed. (FIGS. 14,19,23,24) A single finger may simultaneously play a large number of adjacent notes if the player places the finger's full length along any chosen row of buttons. (FIGS. 3,3A,3B) With the full lengths of multiple fingers the player can produce chords of up to 60 or more notes. The fingers may be dragged, pushed, slid, rocked, or rolled across the playing surface to play flurries of notes, creating both a visual and a musical performance.

Playing on the Convex Surface

The convex playing surface of the Sensor Array (FIG. 11) allows any part of the underside of a player's straightened finger, not just the fingertip, to make contact with just a single button along a row of eighths (FIG. 3). The exact button within the row of eighths on which a straightened finger makes contact depend on the angle at which the finger is tilted with respect to the curve of the convex playing surface. Changing the angle at which a straightened finger is tilted to match successive parts of the curve of a row of eighths while the finger is in contact with the playing surface activates a succession of adjacent single buttons along the row of eighths. There will be greater numbers of adjacent buttons along a row of eighths simultaneously activated by the underside of a finger to the degree that the player curves his finger so that it approaches the curvature of the convex board. (FIG. 3)

Each one of a player's fingers may adopt individual postures during the activation of buttons, allowing for a wide variety of playing techniques with regard to the convexity of the playing surface. The convex curve of the playing surface allows very rapid arpeggiation of chords across a wide range of octaves to be achieved with little effort by the employment of a simple rocking motion of the hand. (FIGS. 15,16) The convexity of the playing surface provides a unique angle at the surface of each button in a row of eighths, allowing the player to identify the general octave range of a note by touch. The convexity of the playing surface aids in allowing the hand to adopt a more natural posture with the motions of the thumb opposing the motions of the fingers in activating separate notes.

Playing the Sensor Array With Other Than Fingers

The use of the thumbs is very important in playing the Sensor Array, with the thumb naturally tending toward the edge of the playing surface closest to the approach of the player's arm, and the fingers naturally tending toward the opposite edge. If the edge approached by the player's arm is the edge that is proximate to the buttons controlling the lowest pitched notes the thumb will tend toward the bass range and the fingers will tend toward the alto range. If the edge approached by the player's arm is the edge that is proximate to the buttons controlling the highest pitched notes the thumb will tend toward the alto range and the fingers will tend toward the bass range. (FIG. 6) When a note combination is played which approximates the tuning of a harmonic or of a subharmonic series it is the thumb which usually plays the pivotal note that approximates the fundamental frequency of the series. (FIGS. 24A, 24B)

The mouth may be used to play the Sensor Array, with pressure from the lips, tongue, teeth, and breath being used to play musical notes in a posture similar to that used to play a harmonica. Using the mouth and breath allows a very sensitive form of dynamic control, especially in conjunction with a Sensor Array which features polyphonic aftertouch.

Any object with a continuous surface which (object) is small enough to fit within less than one half a chromatic matrix and which is placed on the playing surface of the Sensor Array will play a swath of related notes. (FIGS. 14,19) If an object with a discontinuous surface is placed on the playing surface it will play notes in separated areas within which the notes are more related than are the notes across the gaps. In either the case of the continuous or the discontinuous surface, an object will form musical connections analogous to the object's surface characteristics. Often, visual coherence in the surface of an object used to activate the buttons leads to musical coherence in the note combinations produced; and, generally, the smoother an object and the more visually coherent it is, then the smoother and therefore musically coherent is the harmony when the object is placed upon, rolled over, or slid across the playing surface. Implements such as, slides, balls, hoops, blocks, wheels, and springs may be manipulated by the player to activate notes on the Sensor Array MIDI Controller with musically pleasing results.

Figure 10:
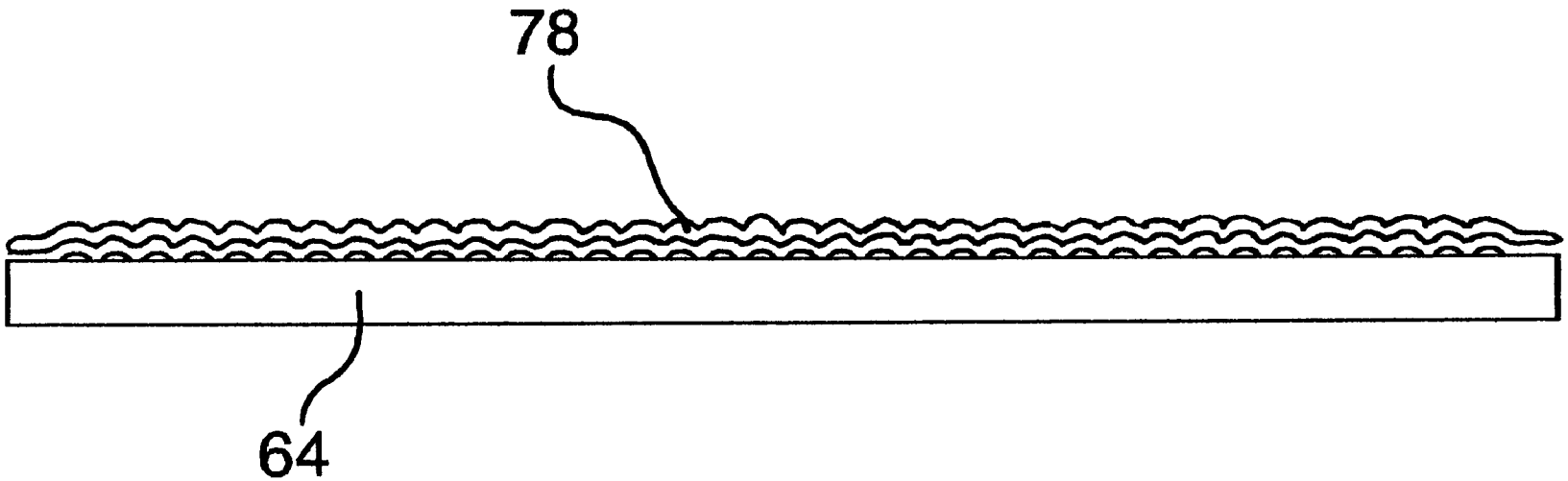
FIG. 10 is a diagram of a side view of a sensorboard in a housing and, shown above the sensorboard, an unattached board skin which may be secured over or molded to the buttons or to the sensors directly.

The Sensor Array may be played with a plectrum, particularly if the scanner and MIDI module are programmed to provide a plucking mode of note activation. Extremely rapid playing rates may be achieved by bouncing drumsticks or mallets on the sensor array's playing surface, especially when it is provided with a board skin (FIG. 10).

Activating a Note With a Strike or a Pluck

The buttons of the Sensor Array may operate so that a MIDI "Note on" is begun when a button is depressed; and a MIDI "Note Off" is begun when the same button is released, which allows the player to use a striking action to play a note. The velocity at which the button is depressed and the velocity at which it is released can be used to affect the dynamics of the note produced by the MIDI module. If a sustain pedal is plugged into the Sensor Array and the striking method of note playing is employed, depressing the pedal will cancel all "Note Off" commands, thereby sustaining played notes until the pedal is released.

The buttons of the Sensory Array may operate so that a MIDI "Note on" is begun when a button is released; and a MIDI "Note off" is begun when the same button is depressed, which allows the player to use a plucking action to play a note. The velocity a t which the button is released and depressed can be used to affect the dynamics of the note produced by the MIDI module. If a sustain pedal is plugged into the Sensor Array and the plucking method of note playing is employed, depressing the pedal will cancel all "Note on" commands, thereby damping played notes until the pedal is released.

Playing Rhythmic Progressions

Figure 22:
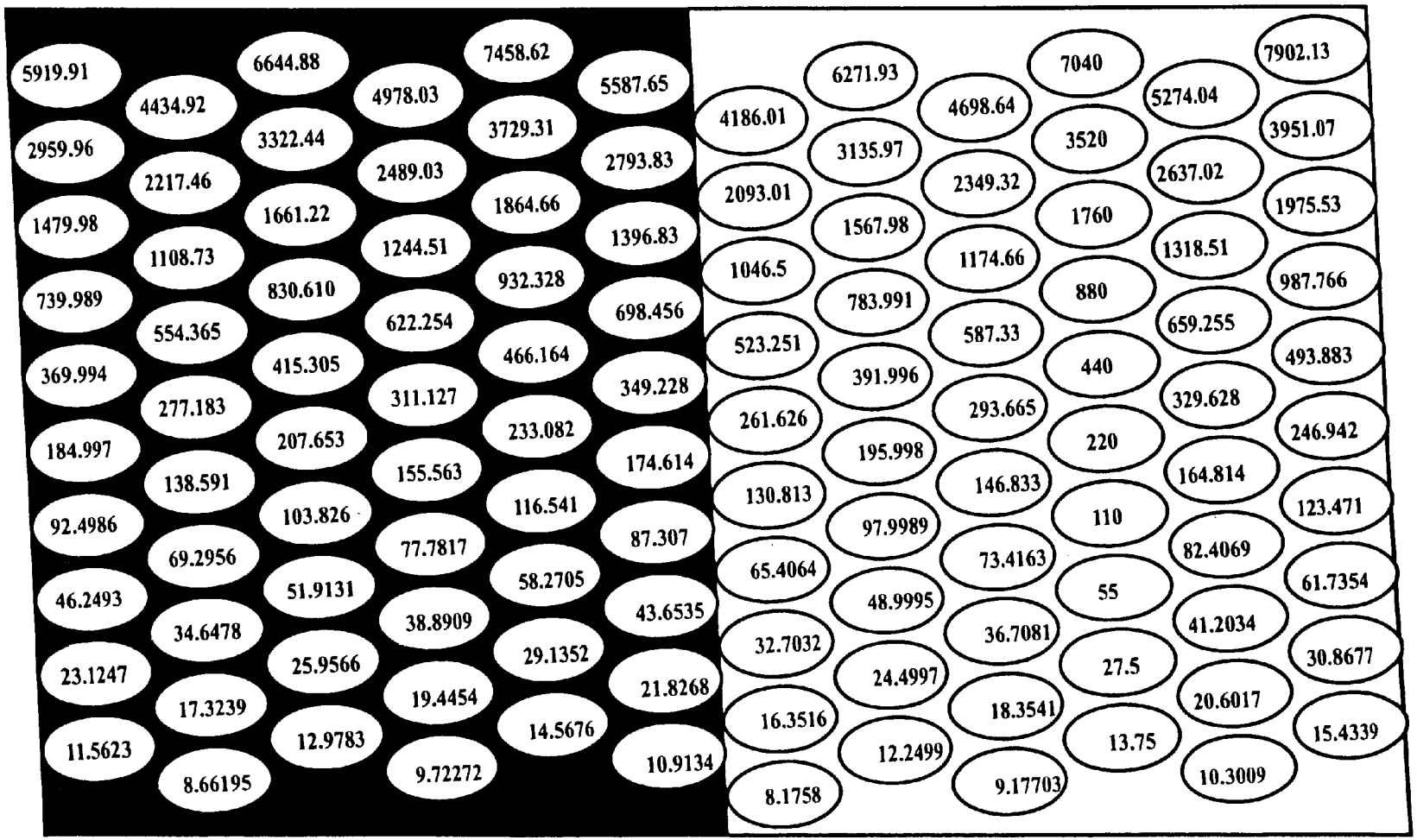
FIG. 22 is a diagram of a right-hand chromatic matrix showing at each button a number that indicates the cycles per second of the note controlled by that button (when the Sensor Array controls a MIDI module tuned to standard intonation).
Figure 23:
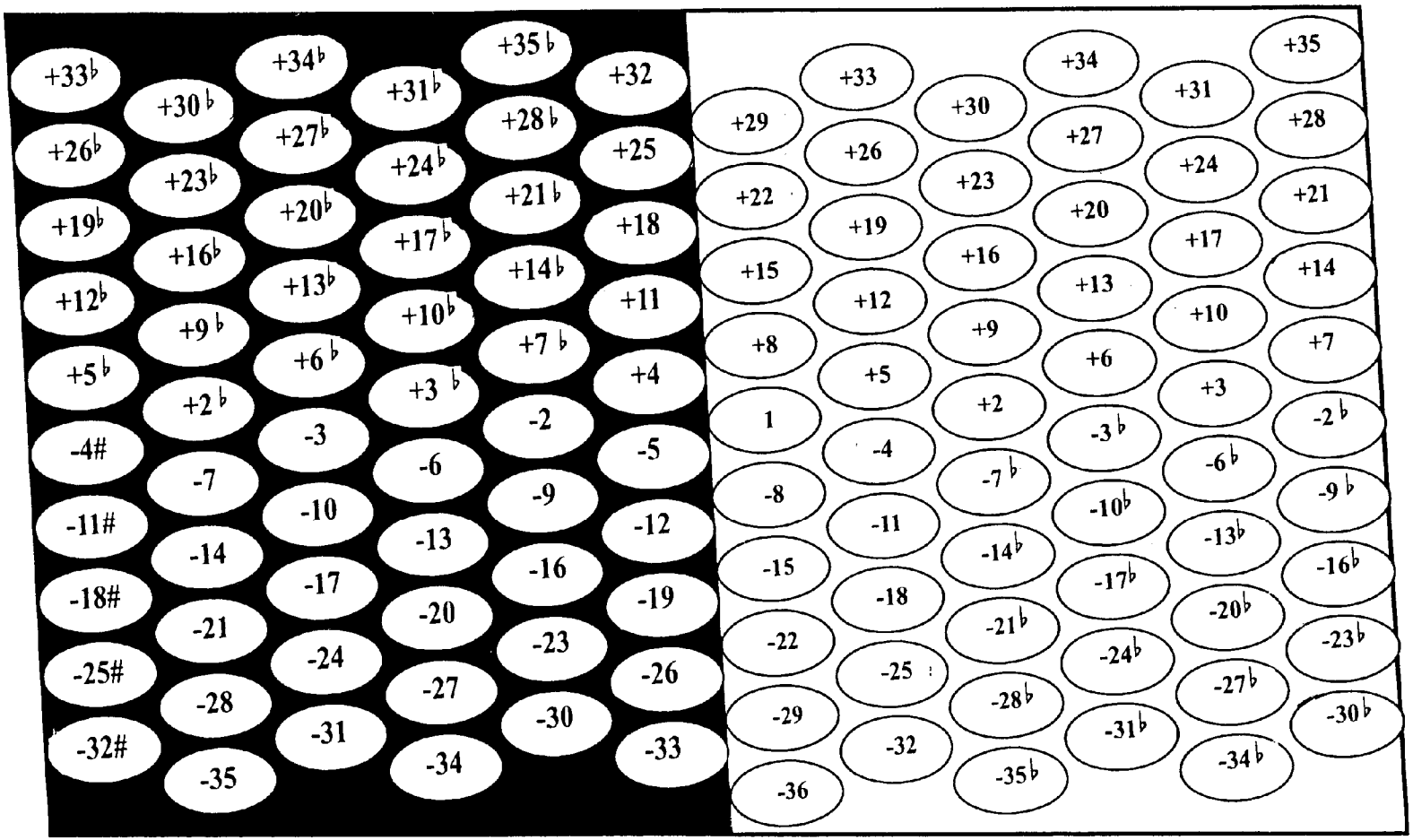
FIG. 23 is a diagram of one chromatic matrix of a right-hand sensorboard showing at each button the number which designates the name of the interval formed by the note controlled by that button with respect to the note controlled by the button designated as "1". A minus indicates an interval formed by a note lower in pitch than "1", while a plus indicates an interval formed by a note higher in pitch than "1". A flat indicates minor as well as diminished intervals, while a sharp indicates augmented intervals.

Some MIDI modules used in conjunction with the Sensor Array may be programmed to produce notes of very low frequencies such that the fundamental frequencies of these notes are within the subaudio range. (FIG. 29) The subaudio range (or rhythm range) of waveform frequencies may be arrived at by dividing each of the waveform frequencies in the audio range (or harmony range) by the number 64 (FIGS. 22,30) In the subaudio range, many periodic waveforms will be heard as cyclically reoccurring percussive sounds that repeat at a rate equal to the fundamental frequency of the waveform. In this way, the MIDI module will make it possible for each button to control a characteristic percussive tempo instead of a characteristic tonal pitch, such that fingering combinations of buttons will play rhythmic progressions rather than harmonic progressions.

All the same within described techniques for playing in the range of tonal pitch will apply as well for playing in the range of percussive tempo. The Sensor Array offers the same advantages to the player regardless whether he plays in the rhythm or the harmony range.

Positioning the Sensor Array

The player may use only a right-hand or only a left-hand hand Sensor Array. The single Sensor Array may be attached to either a microphone-type stand or a keyboard-type stand, allowing a variety of playing angles to be adopted; or a strap or harness worn by the player may be attached to the Sensor Array, allowing a variety of playing postures to be assumed. At some playing angles and in some playing postures, the two hands may be positioned so that both thumbs and fingers activate the buttons on the playing surface of the board. At other playing angles and in other playing postures, one or both hand may curve around the sides of the Sensor Array so that the thumbs grip the bottom of the Sensor Array while the fingers activate the buttons on the playing surface of the board.

The single Sensor Array may be played at angles and in postures that resemble those employed while playing keyboards, accordions, guitars, saxophones, harmonicas, pedal boards, and other instruments. Each variant of angle and posture affords unique musical opportunities to the player of the single Sensor Array.

If the player approaches the right-hand Sensor Array at the edge closest to the buttons producing the lowest notes, the note combinations that approximate the tuning of harmonic overtones are physically easy to reach, especially by the right hand. This can be understood by visualizing the positions of the fingers with the thumb of either hand placed over button "1" in FIG. 24A when the player is situated at the lower edge of the playing surface as shown in the drawing and is facing the playing surface. (See FIG. 24A in "Brief Description of Drawings".)

If the player approaches the right-handed Sensor Array at the edge closest to the buttons producing the highest notes, the note combinations that approximate the tuning of subharmonic undertones are physically easy to reach, especially by the right hand. This can be understood by visualizing the positions of the fingers with the thumb of either hand placed over button "1" in FIG. 24A, when the player is situated at the upper edge of the playing surface as shown in the drawing and is facing the playing surface. (See FIG. 24A in "Brief Description of Drawings".)

If the player approaches the left-hand Sensor Array at the edge closest to the buttons producing the lowest notes, the note combinations that approximate the tuning of a harmonic series of overtones are physically easy to reach, especially by the left hand. This can be understood by visualizing the positions of the fingers with the thumb of either hand placed over button "1" in FIG. 24B, when the player is situated at the upper edge of the playing surface as shown in the drawing and is facing the playing surface. (See FIG. 24B in "Brief Description of Drawings".)

If the player approaches the left-handed Sensor Array at the edge closest to the buttons producing the highest notes, the note combinations that approximate the tuning of subharmonic undertones are physically easy to reach, especially by the left hand. This can be understood by visualizing the positions of the fingers with the thumb of either hand placed over button "1" in FIG. 24B, when the player is situated at the lower edge of the playing surface as shown in the drawing and is facing the playing surface. (See FIG. 24B in "Brief Description of the Drawings".)

Positioning Dual Sensor Arrays

When using both a right-hand and a left-hand Sensor Array (FIG. 6) it is advantageous to locate the right-hand Sensor Array to the right of the player's body and the left-hand Sensor Array to the left of the player's body, so that note combinations which approximate the tuning of a series of harmonic overtones or of a series of subharmonic undertones may easily be activated by each of the player's hands. These note combinations tend to be perceived as especially harmonious and melodious; and therefore this is a useful feature of the dual Sensor Array MIDI Controller.

If a Sensor Array located to a player's right and a Sensor Array located to a player's left mirror their orientation to one another, a fingering pattern may then be mirrored between the player's two hands to produce the same notes on the separate Sensor Arrays, making unisons easy to activate. Unisons are the most harmonious and melodious of intervals, making this a useful feature of the dual Sensor Array MIDI Controller.

The left-hand Sensor Array and the right-hand Sensor Array may be placed on a flat surface with equivalent short sides proximate and facing one another. The right-hand and left-hand Sensor Arrays may be placed on a flat surface with equivalent long sides proximate and facing one another. The right-hand Sensor Array and the left-hand Sensor Array may be connected together along their equivalent long sides. The connected Sensor Arrays may be attached to a microphone-type stand or a keyboard-type stand, either of which allow a variety of playing angles to be adopted; or a strap or harness which is worn by the player may be attached to the connected Sensor Arrays, allowing a variety of playing postures to be assumed.

The right-hand Sensor Array and the left-hand Sensor Array may be attached together bottom-to-bottom as mirror images of one another, so that discrete notes of the same pitch are accessed in the same relative position on opposite sides of the double-sided instrument. The double-sided instrument may be attached to a microphone-type stand or a keyboard-type stand, either of which allows a variety of playing angles to be adopted; or a strap or harness which is worn by the player may be attached to the double-sided instrument, allowing a variety of playing postures to be assumed. At some playing angles and in some playing postures each hand may be segregated to separate sides of the double-sided instrument while at other playing angles and in other playing postures each hand may curve around one or both edges of the double-sided instrument so that the thumbs play notes on one side of the double-sided instrument while the fingers play notes on the other side.

THE ARITHMETIC ARRANGEMENT OF MIDI NUMBERS

The Sensor Array has an arithmetic arrangement of MIDI numbers, which means that the MIDI numbers accessed by buttons which are shown in the drawings as all intersectable through their midpoints by the same straight line will share a common arithmetic difference, as shown in FIG. 13. [See various kinds of rows (42, 44, 46, 48) in FIGS. 3, 3A, 3B, 3C; and see numerals 42, 44, 46, 48 in the section titled, "Reference Numerals in the Drawings".]

Figure 13A:
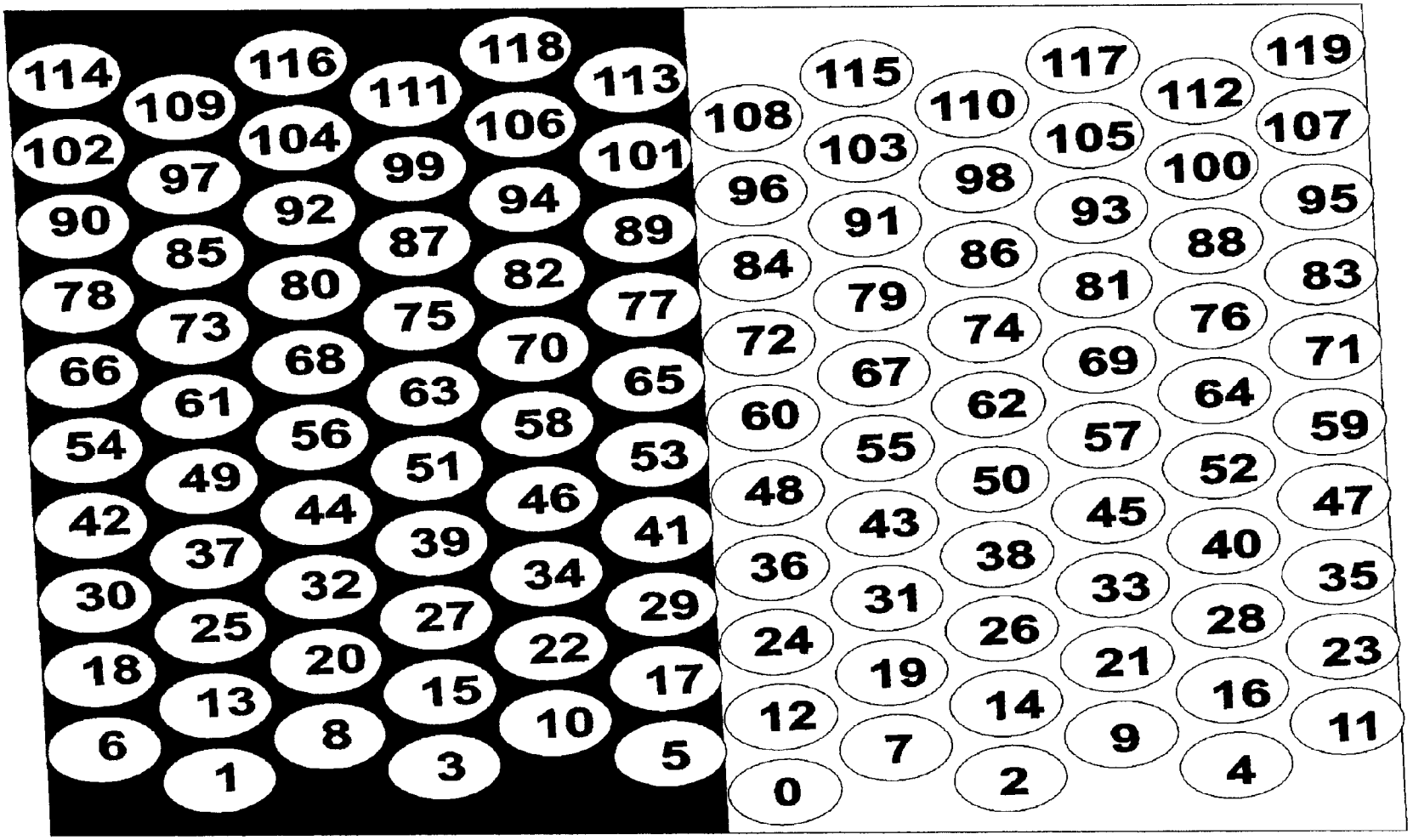
FIG. 13A is a diagram of one right-hand chromatic matrix showing at each button the MIDI number associated with the button.
Figure 13B:
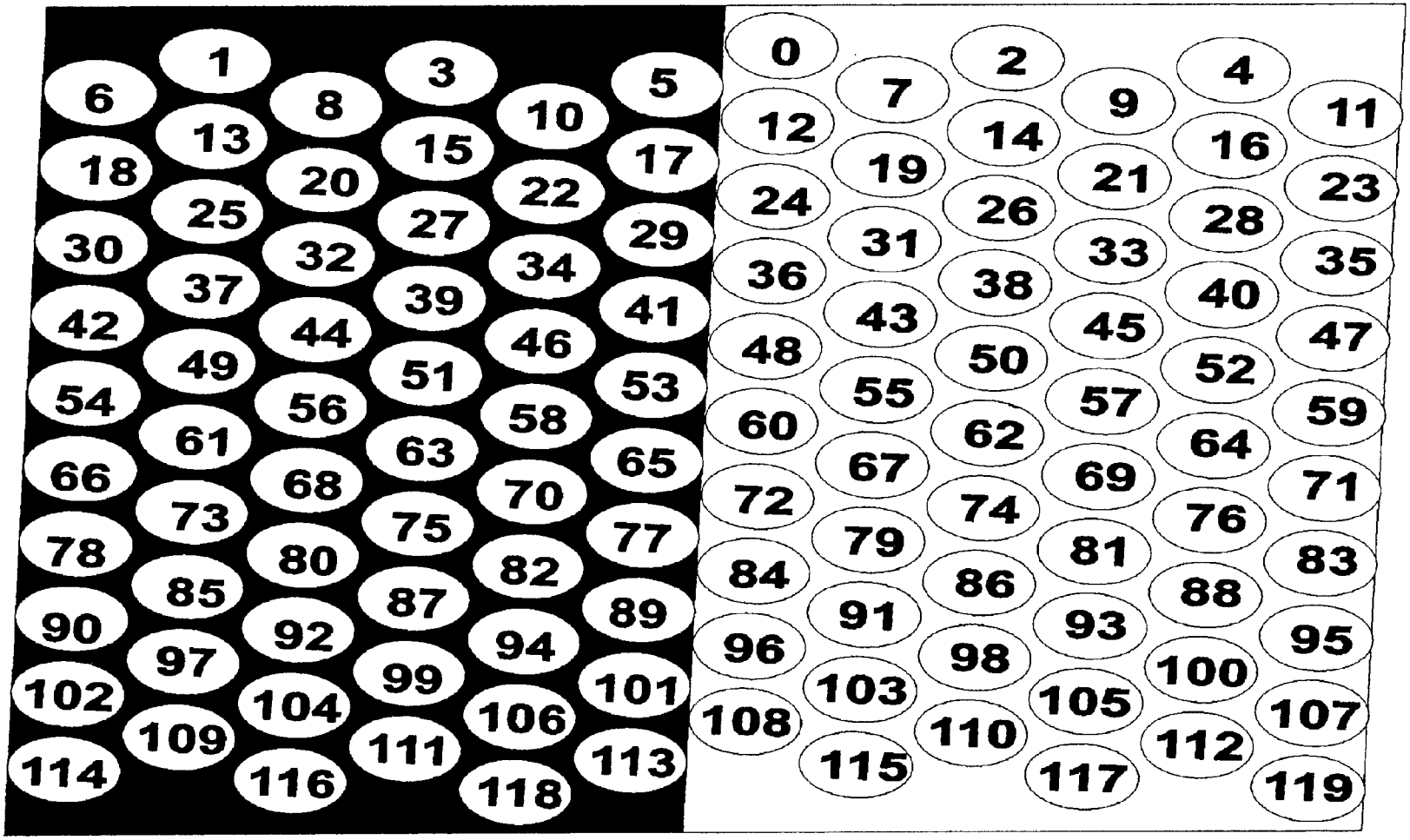
FIG. 13B is a diagram of one left-hand chromatic matrix showing at each button the MIDI number associated with the button.
Figure 14:
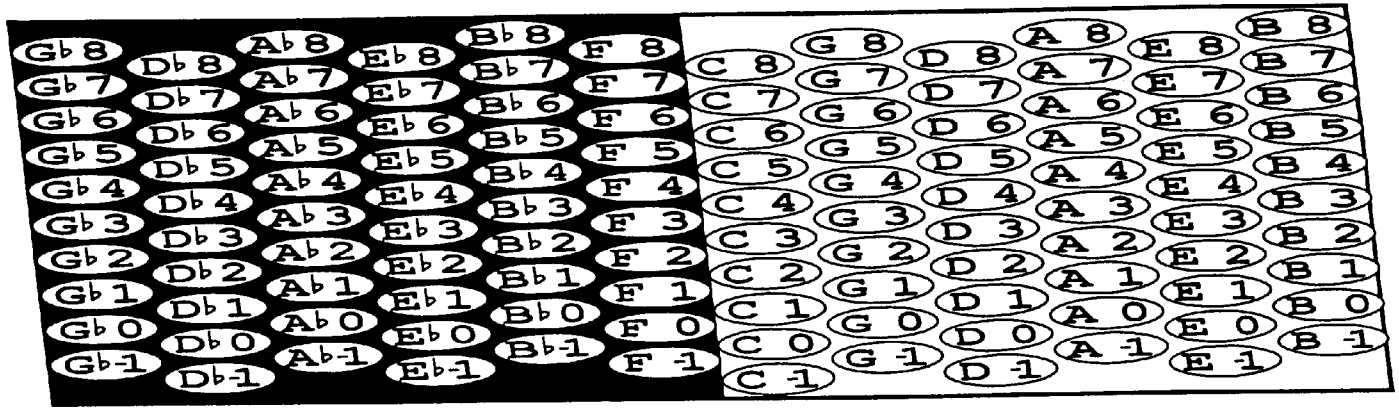
FIG. 14 is a diagram of one chromatic matrix of a right-hand sensorboard with a table listing the terms that relate to the notes of the major diatonic scale, shown in the key of C, above their respective positions on the sensorboard.
Figure 15:
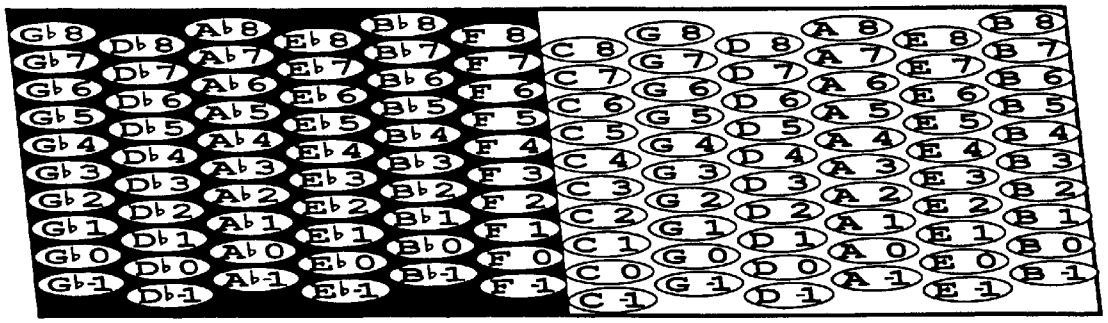
FIG. 15 is a diagram of one chromatic matrix of a right-hand sensorboard with a table listing in the leftmost column the most commonly used chords, shown with a root of C. In the boxes to the right of any given chord, the notes that make up the chord are shown above their respective positions on the sensorboard.
Figure 16:
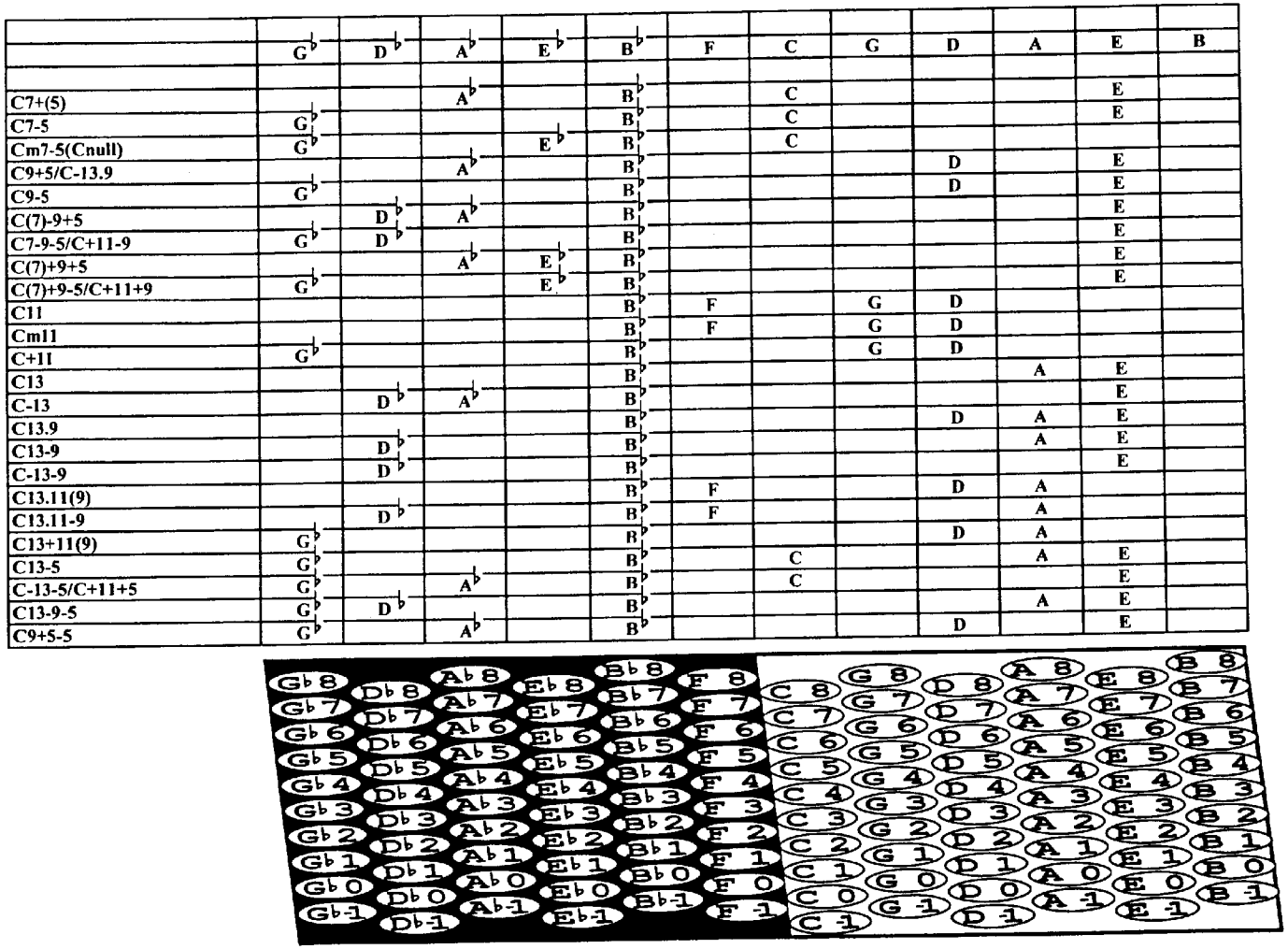
FIG. 16 is a diagram of one chromatic matrix of a right-hand sensorboard with a table listing in the leftmost column the less commonly used chords, shown with a root of C. In the boxes to the right of any given chord, the notes that make up the chord are shown above their respective positions on the sensorboard.
Figure 18:
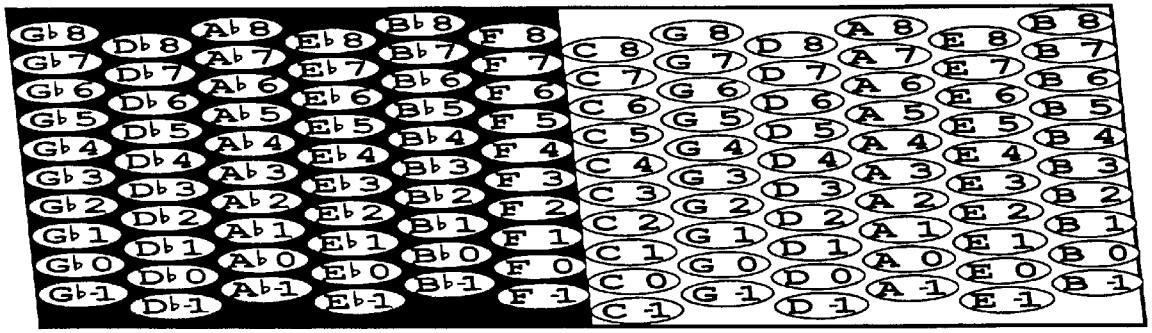
FIG. 18 is a diagram of one chromatic matrix of a right-hand sensorboard with a table listing in the leftmost column the less commonly used scales, shown in the key of C. In the boxes to the right of any given scale are the numbers that indicate the sequence of notes that need to be played on the sensorboard so as to produce the ascending scale.
Figure 19:
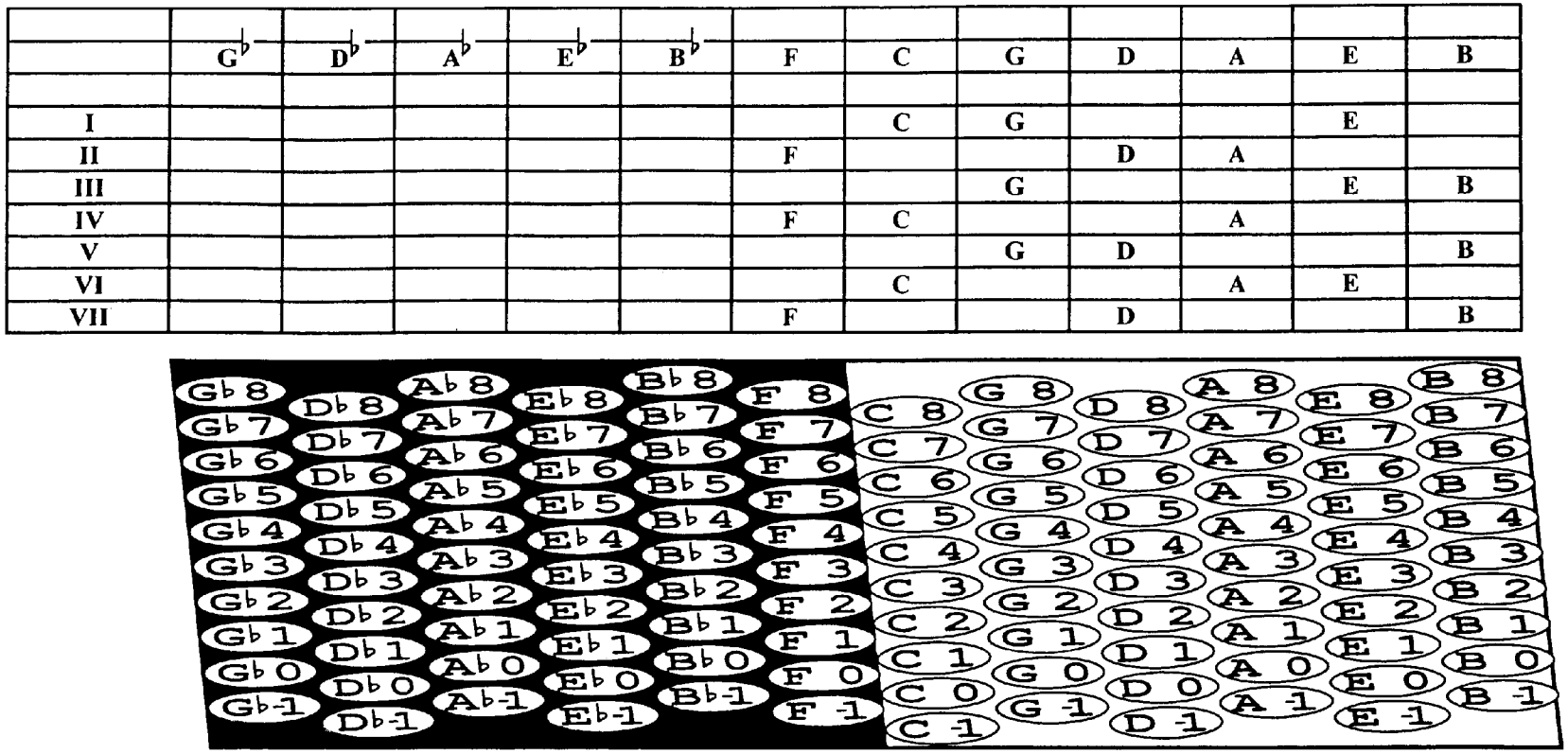
FIG. 19 is a diagram of one chromatic matrix of a right-hand sensorboard with a table listing in the leftmost column Roman numerals associated with the seven degrees of the diatonic major scale. In the boxes to the right of any given Roman numeral are the notes that make up the given chord in the key of C major above their locations on the sensorboard
Figure 20:
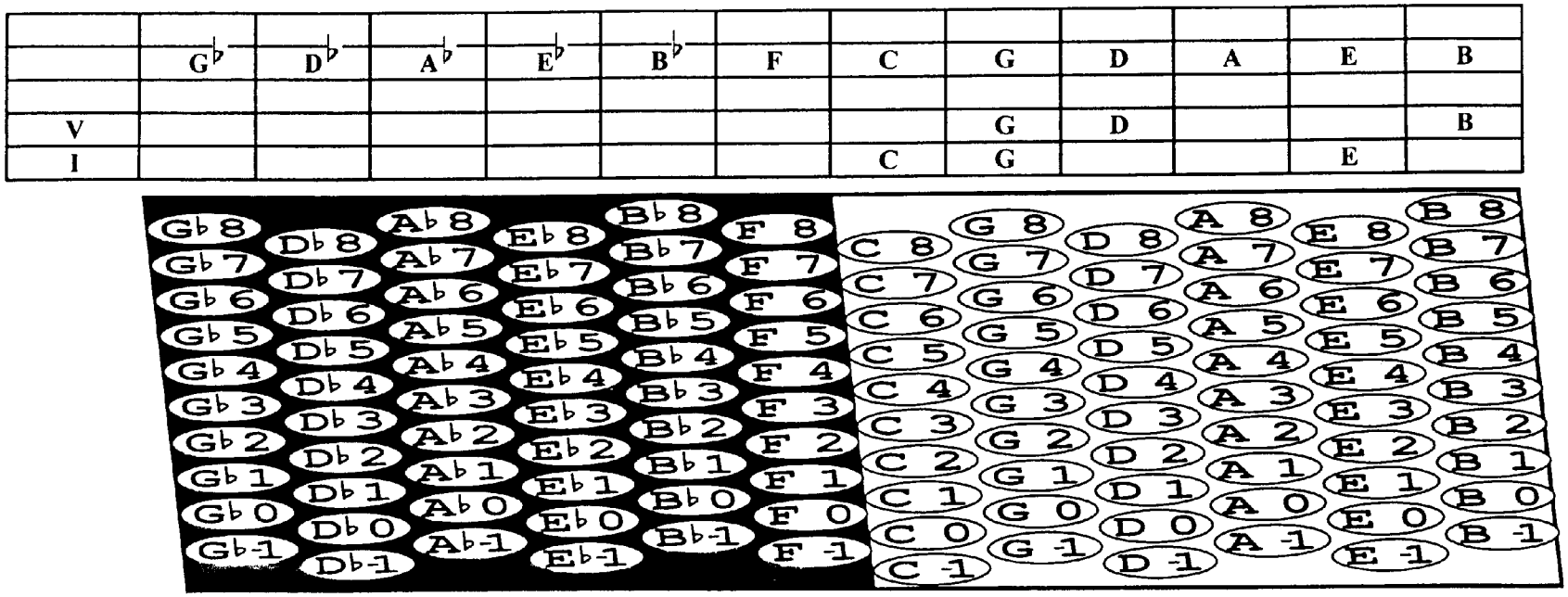
FIG. 20 is a diagram of one chromatic matrix of a right-hand sensorboard with a table listing in the leftmost column Roman numerals associated with the two chords of the perfect authentic cadence. In the boxes to the right of either Roman numeral are the notes that make up the given chord in the key of C major above their respective locations on the sensorboard.
Figure 21:
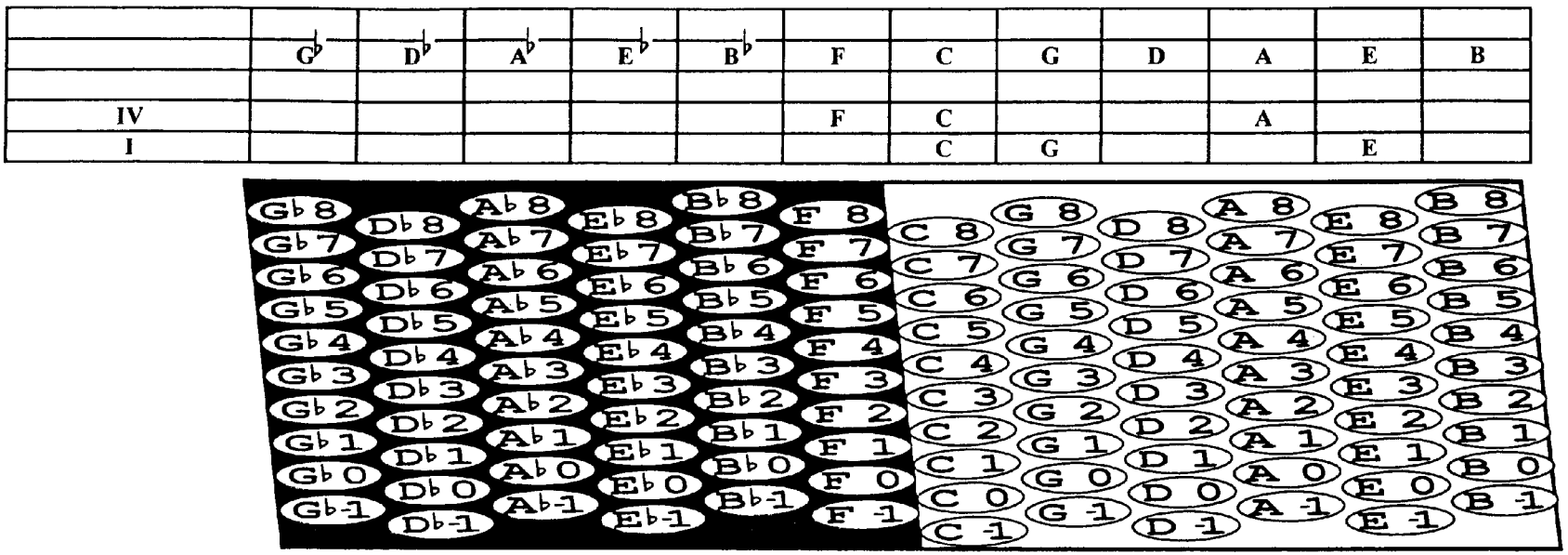
FIG. 21 is a diagram of one chromatic matrix of a right-hand sensorboard with a table listing in the leftmost column Roman numerals associated with the perfect Plagal cadence. In the boxes to the right of either Roman numeral are the notes that make up the given chord in the key of C major above their locations on the sensorboard.

It is important to notice that the greater the distance a button is from the edge of the sensorboard which (edge) is closest to the button accessing MIDI number 0 (zero), the greater the value of the MIDI number and the higher the pitch of the note it accesses, as shown in FIGS. 13, 13A, and 13B. (Notice that the edge of the right-hand sensorboard in FIG. 13 that is at the bottom of the diagram corresponds to the edge of the left-hand sensorboard in FIG. 13 that is at the top of the diagram.)

In the following discussion the terms, "up", "down", "left", and "right" are used in reference to FIG. 13 and are used as such terms are understood in reference to a map or chart; but also it should be noticed that "up" in reference to the right-hand board in FIG. 13 means "down" in reference to the left-hand board in FIG. 13 for the reason that the two sensorboards are mirror images of each other. (Right-hand sensorboards are shown below left-hand sensorboards in all of the drawings showing two sensorboards.)

The following examples of the most basic moves a player can make on adjacent buttons on a right-hand sensorboard (FIGS. 13.13A) provide a description of the relationship between the various MIDI numbers assigned to the various buttons.

1. A movement up and to the right along the diagonal one step to the next, closest location results in a net increase of seven MIDI numbers.
2. A movement down and to the left along the diagonal one step to the next, closest location results in a net decrease of seven MIDI numbers.
3. A movement up and to the left along the diagonal one step to the next closest location results in a net increase of five MIDI numbers.
4. A movement down and to the right along the diagonal one step to the next closest location results in a net decrease of five MIDI numbers.
5. A movement vertically up one step to the next, closest location along the vertical plane results in a net increase of twelve MIDI numbers.
6. A movement vertically down one step to the next, closest location along the vertical plane results in a net decrease of twelve MIDI numbers.
7. A movement horizontally to the right one step to the next, closest location in the horizontal plane results in a net increase of two MIDI numbers.
8. A movement horizontally to the left one step to the next, closest location in the horizontal plane results in a net decrease of two MIDI numbers.

Starting From MIDI Number 60

The following examples illustrate how the MIDI numbers change as a result of various movements relative to MIDI number 60 on a right-hand sensorboard (FIG. 13). MIDI number 60 is particularly significant because it (usually) controls the note of middle C. As previously said, moving away from the edge of a sensorboard which (edge) is closest to MIDI location 0 (zero) results in an increase in the MIDI number. Starting at MIDI number 60

1. A movement up and to the right along the diagonal one step to the next, closest location results in a net increase of seven MIDI numbers to MIDI number 67.
2. A movement down and to the left along the diagonal one step to the next, closest location results in a net decrease of seven MIDI numbers to MIDI number 53.
3. A movement up and to the left along the diagonal one step to the next, closest location results in a net increase of five MIDI numbers to MIDI number 65.
4. A movement down and to the right along the diagonal one step to the next, closest location results in a net decrease of five MIDI numbers to MIDI number 55.
5. A movement vertically up one step to the next, closest location along the vertical plane results in a net increase of twelve MIDI numbers to MIDI number 72.
6. A movement vertically down one step to the next, closest location along the vertical plane results in a net decrease of twelve MIDI numbers to MIDI number 48.
7. A movement horizontally to the right one step to the next, closest location along the horizontal plane results in a net increase of two MIDI numbers to MIDI number 62.
8. A movement horizontally to the left one step to the next, closest location along that horizontal plane results in a net decrease of two MIDI numbers to MIDI number 58.

Starting From MIDI Number 66

Another set of examples illustrates how MIDI numbers change as a result of various described movements relative to MIDI location 66 on a right-hand sensorboard (FIG. 13).

1. A movement up and to the right along the diagonal one step to the next, closest location results in a net increase of seven MIDI numbers to MIDI number 73.
2. A movement down and to the left along the diagonal one step to the next, closest location results in a net decrease of seven MIDI numbers to MIDI number 59.
3. A movement up and to the left along the diagonal one step to the next, closest location results in a net increase of five MIDI numbers to MIDI number 71.
4. A movement down and to the right along the diagonal one step to the next, closest location results in a net decrease of five MIDI numbers to MIDI number 61.

5. A movement vertically up one step to the next, closest location in the vertical plane results in a net increase of 12 MIDI numbers to MIDI number 78.
6. A movement vertically down one step to the next, closest location in the vertical plane results in a net decrease of 12 MIDI numbers to MIDI number 54.
7. A movement horizontally to the right one step to the next, closest location in the horizontal plane results in a net increase of 2 MIDI numbers to MIDI number 68.
8. A movement horizontally to the left one step to the next, closest location in the horizontal plane results in a net decrease of 2 MIDI numbers to MIDI number 64.

THE ASSIGNMENT OF MIDI NUMBERS

It is important to note that some MIDI modules have the capacity to be programmed to assign any note to any MIDI number. This kind of MIDI module need not assign progressively higher notes to progressively higher MIDI numbers. It may be possible, for example, to program the MIDI module to assign progressively lower notes to progressively higher MIDI numbers.

Figure 2:
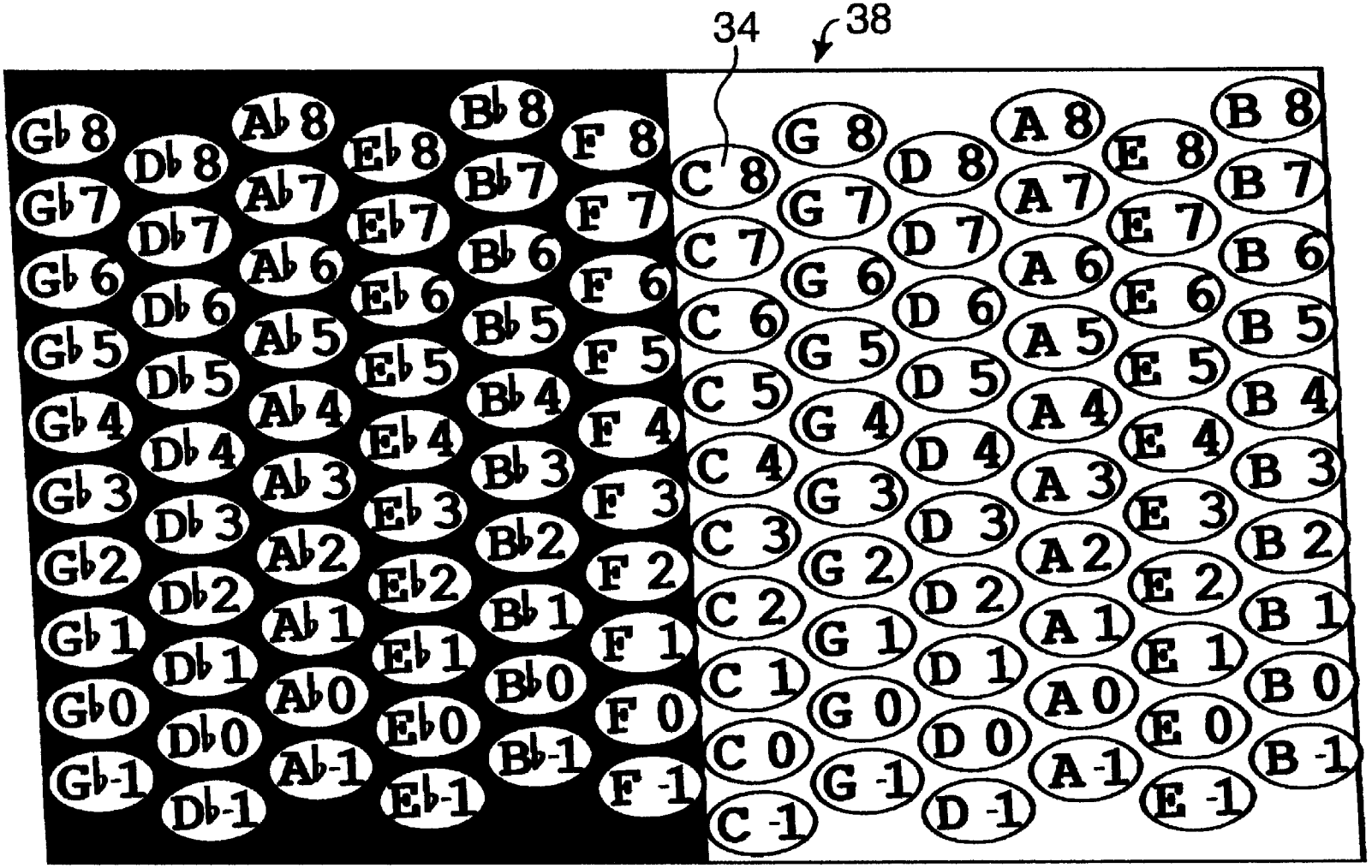
FIG. 2 is a diagram of the right-hand array of buttons shown in FIG. 1 affixed to a rigid surface and forming a right-hand chromatic matrix of buttons labeled with their associated notes.
Figure 2A:
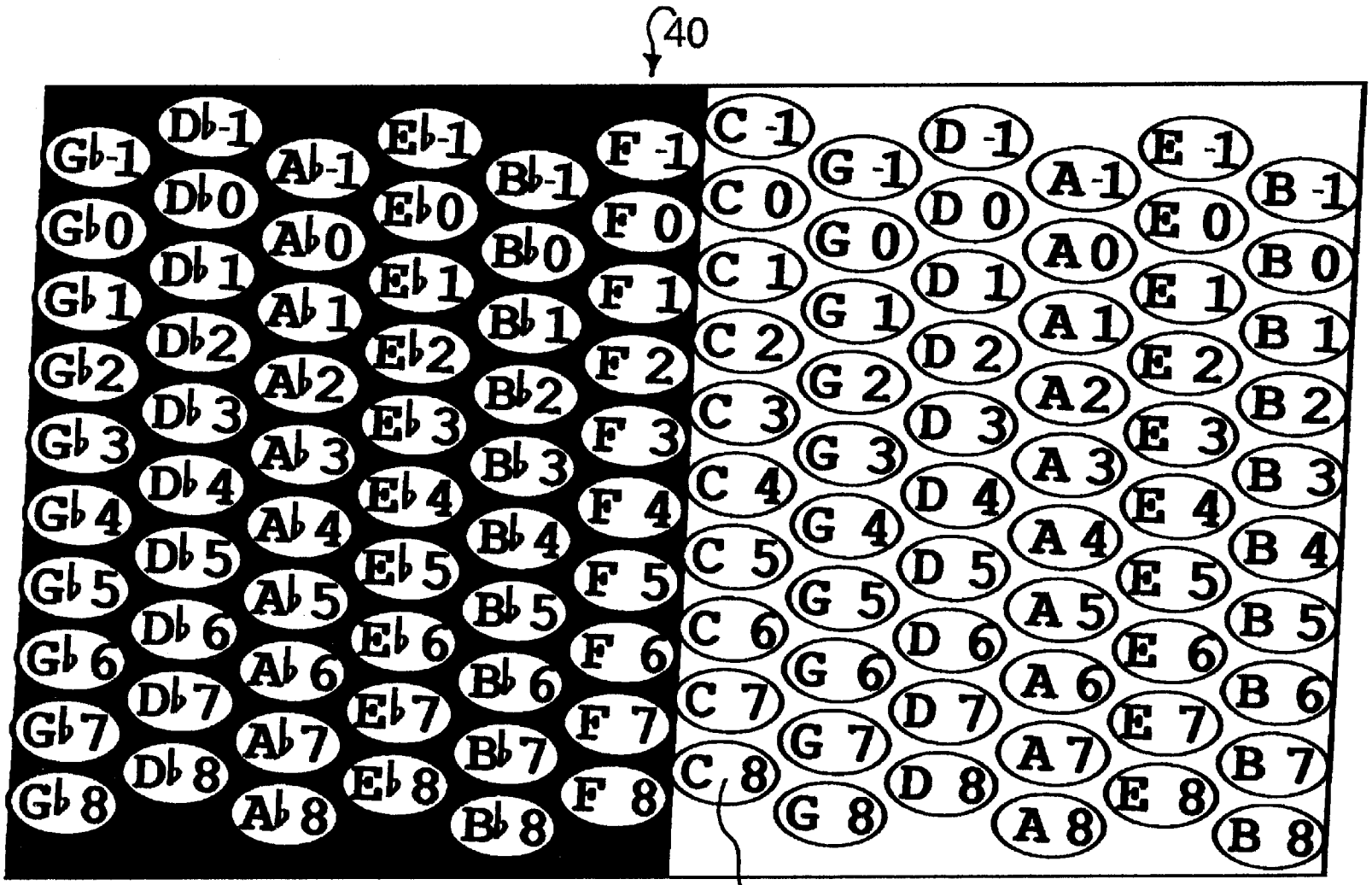
FIG. 2A is a diagram of the left-hand array of buttons shown in FIG. 1A affixed to a rigid surface and forming a left-hand chromatic matrix of buttons labeled with their associated notes.

It is important to note that it would be possible to program the scanner of the Sensor Array to assign the MIDI numbers to the sensors of the chromatic matrix in a different arrangement from that which is shown in FIGS. 13A and 13B. It would then be possible to program the MIDI module to reassign the notes commanded by the MIDI numbers such that the pattern of notes within a chromatic matrix, as shown in FIGS. 2 and 2A, remains the same.

TUNING AS IT APPLIES TO THE SENSOR ARRAY MIDI CONTROLLER

The right-hand and left-hand sensorboards may be played simultaneously; and if one is located to the player's right and the other is located at the player's left, so that they form mirror images of each other, any fingering may be mirrored between the player's two hands to play the same scale or chord on both or each of the sensorboards. The programming of the MIDI module may be adjusted so that all the notes controlled by the buttons on one of the boards are tuned uniformly higher or lower in pitch than the notes controlled by the buttons on the other sensorboard. If this tuning difference is less than 50 cents, a chord or scale may be given the equivalent of alternative tunings, depending on which hand fingers which notes of the scale or chord, and without changing the identities of the notes or the intervals they form. This provides the player with a microtonal system that allows playing technique to determine the nuances of tuning.

The user of the Sensor Array is free to tune the notes provided by the sound module into any intonation the sound module is capable of producing, so long as the number of notes required by an intonation does not exceed the number of buttons available on the sensorboard. The Sensor Array gives the player advantages when a generalized implementation of intonation is employed; but benefit is also given with a wide range of possible non-generalized implementations of intonation.

In any generalized implementation of intonation, only the tuning of two defining intervals need be specified in order to calculate the tuning of every other interval produced by the notes controlled by the sensorboard. In all generalized implementations of an intonation, the larger defining interval may be produced by the notes controlled by any two adjacent buttons whose associated MIDI numbers differ by seven, as is the case throughout this specification; and the smaller defining interval may be produced by the notes controlled by any two adjacent buttons whose associated MIDI numbers differ by five, as is also the case throughout this specification. (FIGS. 13,13A,13B)

Figure 28:
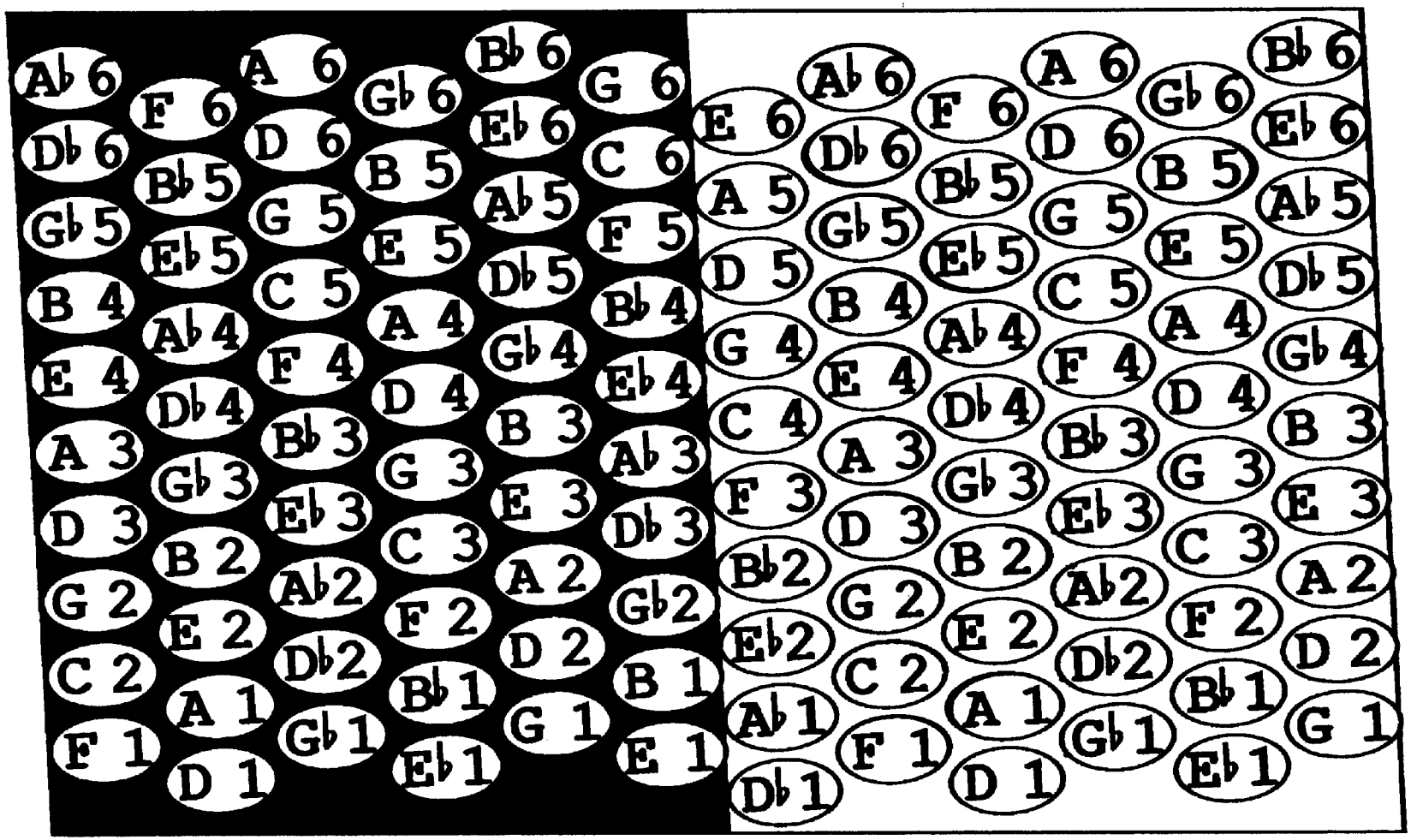
FIG. 28 is a diagram of a right-hand chromatic matrix of buttons labeled with the notes which are associated with these buttons if MIDI number 60 controls a C, with a standard intonation major third as the large defining interval, and a standard intonation minor third as the small defining interval.

The same intonation can have different generalized implementations, depending on which two intervals are used that will suffice as the defining intervals. As an example, the particular generalized implementation of standard intonation (FIG. 2) which has been extensively described in this specification has a large defining interval of a standard intonation fifth and a small defining interval of a standard intonation fourth. A completely different generalized implementation of standard intonation may be implemented if the large defining interval is the standard intonation major third and the small defining interval is the standard intonation minor third (FIG. 28). Using these two intervals as defining intervals produces a generalized implementation of standard intonation which provides all the requisite notes, but in a completely different arrangement than is shown in FIG. 2 on the playing surface of the sensorboard, which (arrangement) is characterized by a greater number of unisons and a lesser number of octaves, as is shown in FIG. 28. Scales and chords are fingered completely differently in this alternative generalized implementation of standard intonation.

The Optimum Implementation of Intonation

A generalized implementation of intonation that allows the major scale, and the modes of the major scale, to be fingered on the buttons of a sensorboard in the ways described in this specification, I define as an optimum implementation of intonation. An optimum implementation of intonation requires that two conditions be met, one of which is that all adjacently placed buttons controlling notes related to each other by the interval of the fifth have-these notes tuned such that a number between 1.49111 and 1.50554 multiplied times the cycles per second of the note lower in pitch will give the cycles per second of the note higher in pitch, or divided into the cycles per second of the note higher in pitch will give the cycle per second of the note lower in pitch. The other condition to be met is that all adjacently placed buttons controlling notes related to each other by the interval of the fourth have these notes tuned such that a number between 1.32843 and 1.34128 multiplied times the cycles per second of the note lower in pitch will give the cycles per second of the note higher in pitch, or divided into the cycles per second of the note higher in pitch will give the cycles per second of the note lower in pitch.

The tuning of all other intervals will be contingent upon the tuning of the defining fifths and fourths, such that only the tuning of these two intervals need be specified in order to be able to calculate the tuning of any other interval available on the sensorboard.

An optimum implementation of intonation will provide notes at equivalently positioned buttons in adjacent chromatic matrices which (notes) are offset in pitch such that an intonation comma between 1 and 1.05946 multiplied times the cycles per second of the note lower in pitch will give the cycles per second of the note higher in pitch, or divided into the cycles per second of the note higher in pitch will give the cycles per second of the note lower in pitch.

An optimum implementation of intonation requires the use of a separate MIDI channel and tuning for each chromatic matrix, which gives the player of the Sensor Array control over as many frequencies as there are buttons on the playing surface, allowing the player opportunities for microtonal musical expression.

Standard Intonation

An optimum implementation of standard intonation (FIGS. 22,30) on the sensorboard requires two conditions to be met, one of which is that all adjacently placed buttons controlling notes related to each other by the interval of the fifth have these notes tuned such that 1.49831 multiplied times the cycles per second of the note lower in pitch will give the cycles per second of the note higher in pitch, or divided into the cycles per second of the note higher in pitch will give the cycles per second of the note lower in pitch. The other condition to be met is that all adjacently placed buttons controlling notes related to each other by the interval of the fourth have these notes tuned such that 1.33484 multiplied times the cycles per second of the note lower in pitch will give the cycles per second of the note higher in pitch, or divided into the cycles per second of the note higher in pitch will give the cycles per second of the note lower in pitch. The tuning of all other intervals will be contingent upon the tuning of the defining fifths and fourths, such that only the tuning of these two intervals need be specified in order to be able to calculate the tuning of any other intervals available on the board.

A sensorboard in which the notes are tuned in an optimum implementation of standard intonation will provide notes of identical pitch at equivalently positioned buttons in each chromatic matrix. The use of a separate MIDI channel for each chromatic matrix makes it possible to play unisons in which discrete notes of the same pitch may be independently activated, giving a multiple instrument effect.

Pythagorean Intonation

An optimum implementation of Pythagorean intonation on the sensorboard requires two conditions to be met, one of which is that all adjacently placed buttons controlling notes related to each other by the interval of the fifth have these notes tuned such that 1.5 multiplied times the cycles per second of the note lower in pitch will give the cycles per second of the note higher in pitch, or divided into the cycles per second of the note higher in pitch will give the cycles per second of the note lower in pitch. The other condition to be met is that all adjacently placed button controlling notes related to each other by the interval of the fourth have these notes tuned such that 1.33333 multiplied times the cycles per second of the note lower in pitch will give the cycles per second of the note higher in pitch, or divided into the cycles per second of the note higher in pitch will give the cycles per second of the note lower in pitch. The tuning of all other intervals will be contingent upon the tuning of the defining fifths and fourths, such that only the tuning of these two intervals need be specified in order to be able to calculate the tuning of any other interval available on the sensorboard.

A sensorboard in which notes are tuned in an optimum implementation of Pythagorean intonation will provide notes at equivalently positioned buttons in adjacent chromatic matrices which are offset in pitch such that a Pythagorean comma of 1.01364 multiplied times the cycles per second of the note lower in pitch will give the cycles per second of the note higher in pitch, or divided into the cycles per second of the note higher in pitch will give the cycles per second of the note lower in pitch. Generalized Pythagorean intonation requires the use of a separate MIDI channel and tuning for each chromatic matrix, which gives the player of the Sensor Array control over as many frequencies as there are buttons on the playing surface, allowing the player opportunities for microtonal musical expression.

Mean Tone Intonation

An optimum implementation of mean tone intonation on the sensorboard requires two conditions to be met, one of which is that all adjacently placed buttons controlling notes related to each other by the interval of the fifth have these notes tuned such that 1.49535 multiplied times the cycles per second of the note lower in pitch will give the cycles per second of the note higher in pitch, or divided into the cycles per second of the note higher in pitch will give the cycles per second of the note lower in pitch. The other condition to be met is that all adjacently placed buttons controlling notes related to each other by the interval of the fourth have these notes tuned such that 1.33748 multiplied times the cycles per second of the note lower in pitch will give the cycles per second of the note higher in pitch, or divided into the cycles per second of the note higher in pitch will give the cycles per second of the note lower in pitch. The tuning of all other intervals will be contingent upon the tuning of the defining fifths and fourths, such that only the tuning of these two intervals need be specified in order to be able to calculate the tuning of any other interval available on the sensorboard.

A sensorboard on which notes are tuned in an optimum implementation of mean tone intonation will provide notes at equivalently positioned buttons in adjacent chromatic matrices which (notes) are offset in pitch such that a mean tone comma of 1.024 multiplied times the cycles per second of the note lower in pitch will give the cycles per second of the note higher in pitch, or divided into the cycles per second of the note higher in pitch will give the cycles per second of the note lower in pitch. An optimum implementation of mean tone intonation requires the use of a separate MIDI channel and tuning for each chromatic matrix, which gives the player of the Sensor Array control over as many frequencies as there are buttons on the sensorboard, allowing the player opportunities for microtonal musical expression.

Seventeen Equal Intonation

An optimum implementation of seventeen equal intonation on the sensorboard requires two conditions to be met, one of which is that all adjacently placed buttons controlling notes related to each other by the interval of the fifth have these notes tunes such that 1.50341 multiplied times the cycles per second of the note lower in pitch will give the cycles per second of the note higher in pitch, or divided into the cycles per second of the note higher in pitch will give the cycles per second of the note lower in pitch. The other condition to be met is that all adjacently placed buttons controlling notes related to each other by the interval of the fourth have these notes tuned such that 1.33031 multiplied times the cycles per second of the note lower in pitch will give the cycles per second of the note higher in pitch, or divided into the cycles per second of the note higher in pitch will give the cycles per second of the note lower in pitch. The tuning of all other intervals will be contingent upon the tuning of the defining fifths and fourths, such that only the tuning of these two intervals need be specified in order to be able to calculate the tuning of any other interval available on the sensorboard.

A sensorboard in which notes are tuned in an optimum implementation of seventeen equal intonation will provide notes at equivalently positioned buttons in adjacent chromatic matrices which (notes) are offset in pitch such that a seventeen equal comma of 1.04162 multiplied times the cycles per second of the note lower in pitch will give the cycles per second of the note higher in pitch, or divided into the cycles per second of the note higher in pitch will give the cycles per second of the note lower in pitch. An optimum implementation of seventeen equal intonation requires the use of a separate MIDI channel and tuning for each chromatic matrix, which gives the player of the Sensor Array control over as many frequencies as there are buttons on the playing surface, allowing the player opportunities for microtonal musical expression.

Nineteen Equal Intonation

An optimum implementation of nineteen equal intonation on the sensorboard requires two conditions to be met. First, all adjacently placed buttons controlling notes related to each other by the interval of the fifth have these notes tuned such that 1.49376 multiplied times the cycles per second of the note lower in pitch will give the cycles per second of the note higher in pitch, or divided into the cycles per second of the note higher in pitch will give the cycles per second of the note lower in pitch. Second, all adjacently placed buttons controlling notes related to each other by the interval of the fourth have these notes tuned such that 1.3389 multiplied time the cycles per second of the note lower in pitch will give the cycles per second of the note higher in pitch, or divided into the cycles per second of the note higher in pitch will give the cycles per second of the note lower in pitch. The tuning of all other intervals will be contingent upon the tuning of the defining fifths and fourths, such that only the tuning of these two intervals need be specified in order to be able to calculate the tuning of any other interval available on the sensorboard.

A sensorboard on which notes are tuned in an optimum implementation of nineteen equal intonation will provide notes at equivalently positioned buttons in adjacent chromatic matrices which (notes) are offset in pitch such that a nineteen equal comma of 1.03716 multiplied times the cycles per second of the note lower in pitch will give the cycles per second of the note higher in pitch, or divided into the cycles per second of the note higher in pitch will give the cycles per second of the note lower in pitch. An optimum implementation of nineteen equal intonation requires the use of a separate MIDI channel and tuning for each chromatic matrix, which gives the player of the Sensor Array control over as many frequencies as there are buttons on the sensorboard, allowing the player opportunities for microtonal musical expression.

Waveform, Tuning, and the Perception of Pitch and Tempo

Figure 29:
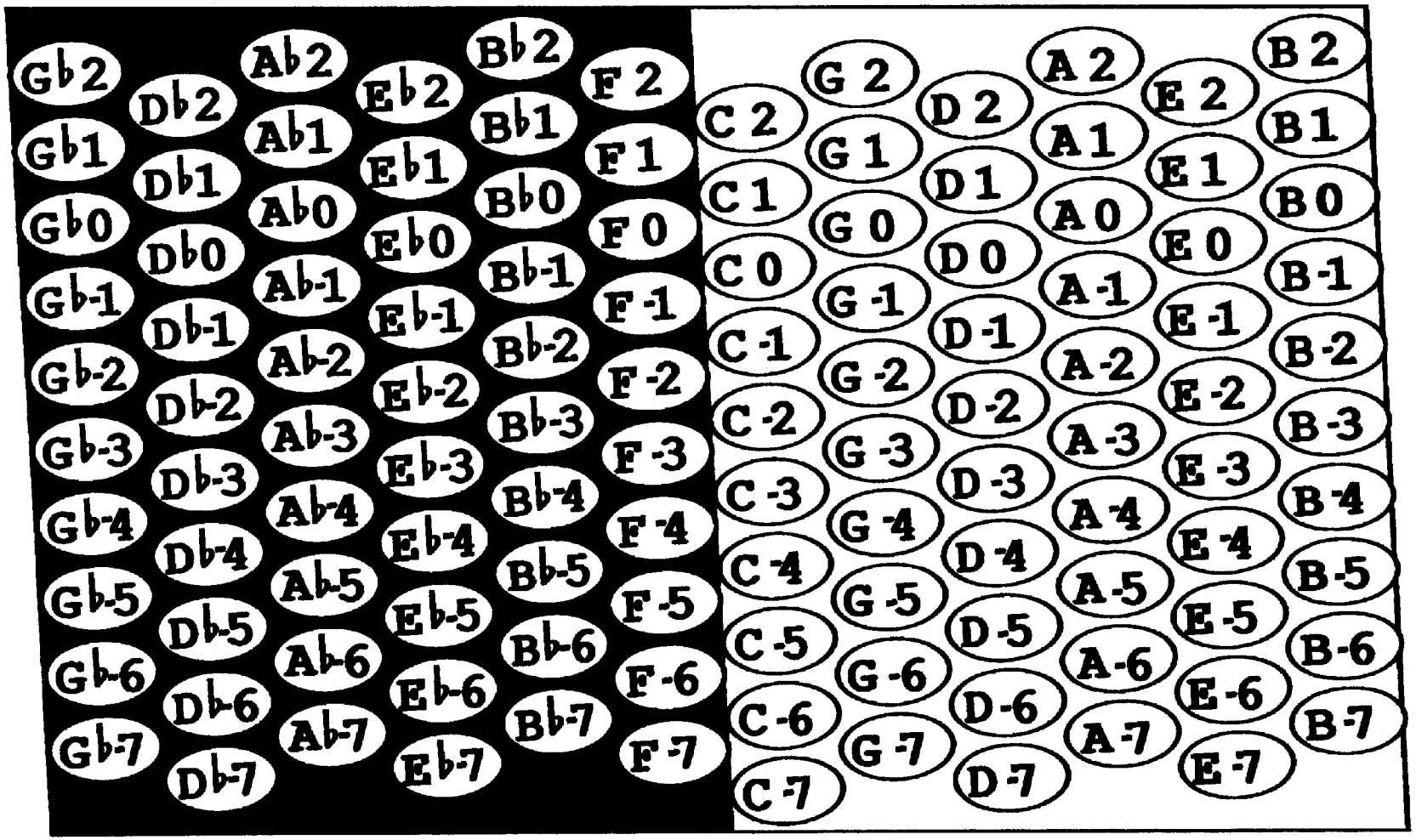
FIG. 29 is a diagram of a right-hand chromatic matrix showing at each button the notes within the frequency range of rhythm.
Figure 30:
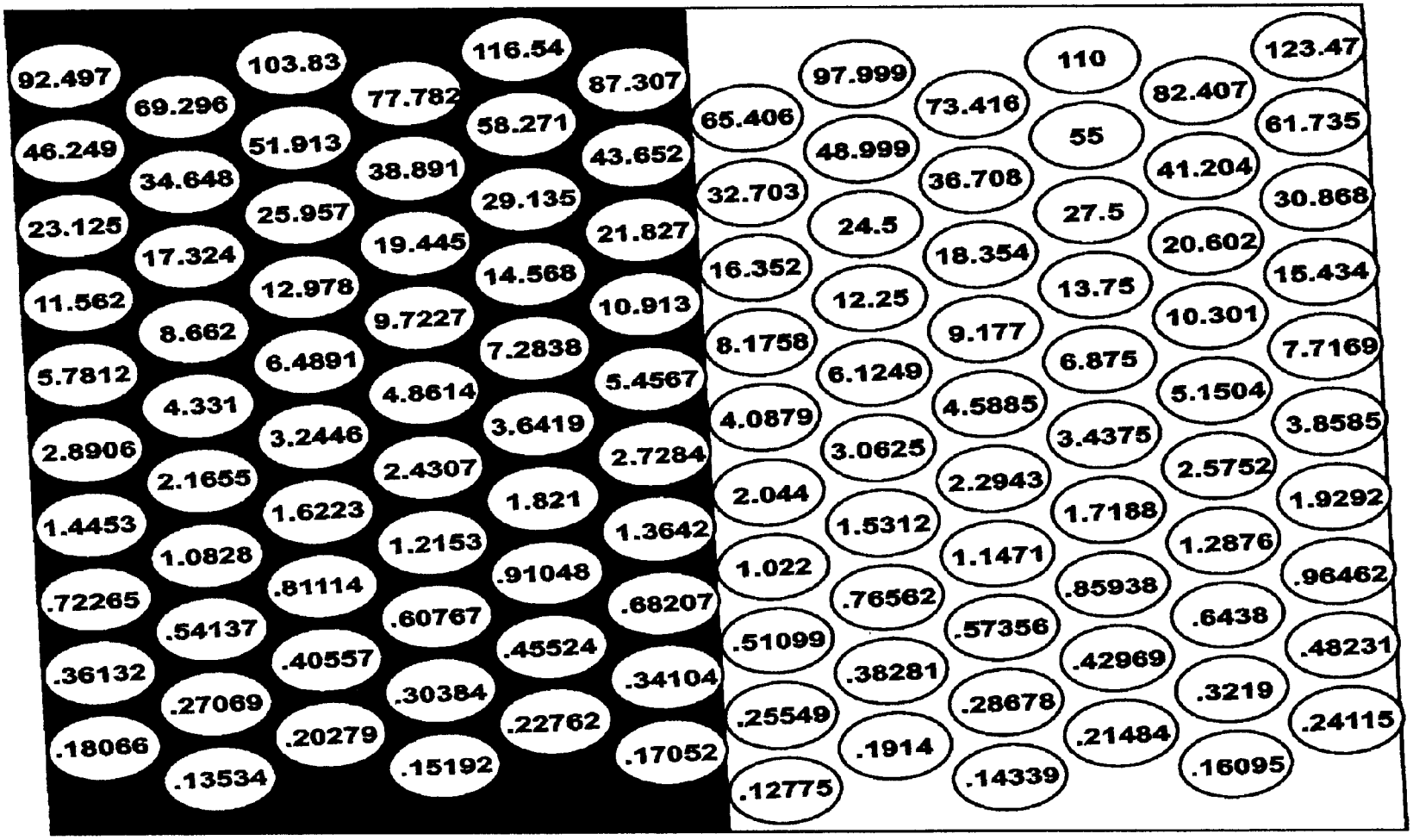
FIG. 30 is a diagram of the right-hand chromatic matrix showing at each button the number of cycles per second produced by the waveforms of the notes within the frequency range of rhythm if the MIDI module is tuned to standard intonation.
Figure 31:
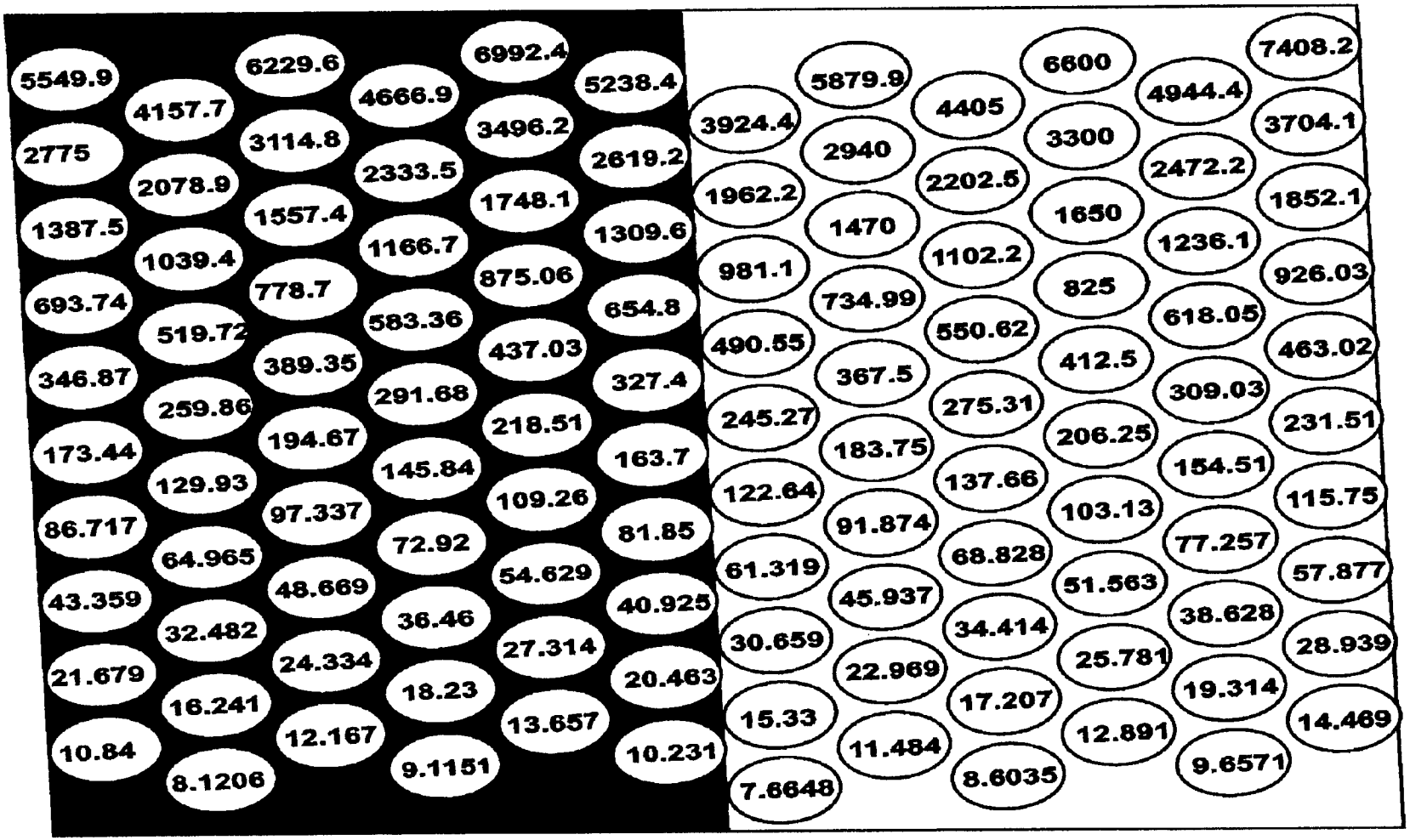
FIG. 31 is a diagram of a right-hand chromatic matrix showing at each button the number of repetitions per minute produced by the waveforms of the notes within the frequency range of rhythm if the MIDI module is tuned to standard intonation.

Some MIDI modules used in conjunction with the Sensor Array may be tuned to produce notes of very low frequency such that the fundamental frequency of the waveform is in the subaudio range (FIG. 29). The tunings for the subaudio (or rhythm) range of waveform frequencies may be arrived at by dividing the waveform frequencies of the audio (or harmony) range by 64 (FIG. 30). A waveform that is heard as a pitch with a particular timbre when it is tuned to the harmony range will be heard as a tempo with a particular meter when it is tuned to the rhythm range. When the MIDI module is tuned to the harmony range each button controls a specific pitch; and when the MIDI module is tuned to the rhythm range each button controls a specific tempo. Fingering sequences of button combinations produces harmonic progressions when the MIDI module is tuned to the harmony range, while fingering sequences of button combinations produces rhythmic progressions when the MIDI module is tuned to the rhythmic range. All the same techniques apply to the player's performance regardless of whether the MIDI module is tuned to the harmony range or the rhythm range. The rate at which a rhythm waveform repeats its cycle may be expressed as "repetitions per minute", which is arrived at by multiplying its fundamental frequency by 60 (FIG. 31). There is a range of tuning for waveforms centering at a fundamental frequency of approximately 23 cycles per second, which may also be expressed as approximately 1380 repetitions per minute, at which a waveform may be heard as a very low pitch and as a very fast tempo.

CONCLUSION, RAMIFICATIONS, AND SCOPE

The Sensor Array is inexpensive to manufacture. Its internal components are not prone to breakage or deterioration. It is versatile in terms of form and playing technique or stance. Relatively small and lightweight, it can be carried, set on an adjustable stand, or laid flat. It can have more than one playing surface, facing in different directions, on the same instrument. It can be tuned in many ways. Any musical composition that can be played on a standard keyboard can be played on it. It is approachable and playable from any side of the playing surface, and allows two or more players to play together on one instrument, each player having available the full range of notes. It provides an arrangement of notes which is relatively easy to master and which is relatively error-avoidant or error-masking. It adds significantly to a player's repertoire of musical effects, some of these effects being impossible to achieve on any other musical instrument. The design gives the player real time control over large numbers of notes and makes electronic sequencers and automated performance enhancement optional. It affords the player an ergonomic design that minimizes "travel time", strenuous and awkward reaching, difficult crossing over of hands and arms, and stressful contortion of the human torso. It accommodates the special needs of left-handed, and physically challenged, and musically untrained, and very small persons, including children. It affords the player relief from having to memorize multiple fingering patterns for the different key signatures, and provides a note arrangement with geometric and logical simplicity and comprehensibility. Generally, the Sensor Array is a significant improvement over other MIDI controllers for purposes of learning, teaching, reciting, and improvising music. In addition, it can be used in non-musical applications, as well, as a controller for any function commanded by MIDI, which (function) is controllable by a MIDI keyboard-type controller.

As discussed at length above, possible variations, ramifications, and improvements of the Sensor Array include, but are not limited to: alternative tunings; different sizes or colors or shapes or labeling of buttons; different sensor capabilities; different shapes or sizes or relative dimensions or degrees of flexibility of housings and playing surfaces; different numbers of chromatic matrices per instrument; additional dynamic functions and corresponding controls; varying uniform distances between buttons; varying non-uniform distances between buttons; added hardware such as stands, straps, harnesses, and hand grips; different means of communication between various components of the total music system; different kinds of sensors; alternatives to electrical wiring; longer or shorter rows of buttons; different degrees of convexivity of the playing surface, including near zero degrees of convexivity; faster-reacting or otherwise improved scanner; additional music-related applications; and additional non-music-related applications.

While we have shown and described in this specification and its appended drawing figures only selected embodiments in accordance with the present invention, it is understood that the invention is not limited thereto, but is susceptible to numerous changes and modifications as would be known to one having ordinary skill in the art; and we therefore do not wish to be limited to the details shown and described herein, but intend to cover all such modifications, changes, eliminations, and hybrids as are encompassed by the scope of the appended claims and their legal equivalents.

I claim:

1. A Sensor Array with a single right-hand sensorboard, said sensorboard having buttons arranged on its convex top surface, for controlling musical notes, the arrangement of said buttons essentially comprising a plurality of chromatic matrices with said chromatic matrices each having a plurality of octaves in each row of eighths, and wherein said right-hand sensorboard has an optimum implementation of intonation, which requires that two conditions be met:

i. all adjacently placed buttons that control notes related to each other by the interval of the fifth have these notes tuned such that a number between 1.49111 and 1.50554 multiplied times the cycles per second of the note lower in pitch will give the cycles per second of the note higher in pitch, and ii. all adjacently placed buttons that control notes related to each other by the interval of the fourth have these notes tuned such that a number between 1.32843 and 1.34128 multiplied times the cycles per second of the note lower in pitch will give the cycles per second of the note higher in pitch.

2. A Sensor Array as recited in claim 1, wherein said right-hand sensorboard has an optimum implementation of standard intonation, which requires that two conditions be met:

i. all adjacently placed buttons that control notes related to each other by the interval of a fifth have these notes tuned such that 1.49831 multiplied times the cycles per second of the note lower in pitch will give the cycles per second of the note higher in pitch, and ii. all adjacently placed buttons that control notes related to each other by the interval of the fourth have these notes tuned such that 1.33484 multiplied times the cycles per second of the note lower in pitch will give the cycles per second of the note higher in pitch.

3. A Sensor Array as recited in claim 1, wherein said right-hand sensorboard has an optimum implementation of Pythagorean intonation, which requires that two conditions be met.

i. all adjacently placed buttons that produce notes related to each other by the interval to the fifth have these notes tuned such that 1.5 multiplied times the cycles per second of the note lower in pitch will give the cycles per second of the note higher in pitch, and ii. all adjacently placed buttons that produce notes related to each other by the interval of the fourth have these notes tuned such that 1.33333 multiplied times the cycles per second of the note lower in pitch will give the cycles per second of the note higher in pitch.

4. A Sensor Array as recited in claim 1, wherein said right-hand sensorboard has an optimum implementation of mean tone intonation, which requires that two conditions be met:

i. all adjacently placed buttons that control notes related to each other by the interval of the fifth have these notes tuned such that 1.49535 multiplied times the cycles per second of the note lower in pitch will give the cycles per second of the note higher in pitch, and ii. all adjacently placed buttons that control notes related to each other by the interval of the fourth have these notes tuned such that 1.33748 multiplied times the cycles per second of the note lower in pitch will give the cycles per second of the note higher in pitch.

5. A Sensor Array as recited in claim 1, wherein said right-hand sensorboard has anoptimum implementation of seventeen equal intonation, which requires that two conditions be met:

i. all adjacently placed buttons that control notes related to each other by the interval of the fifth have these notes tuned such that 1.50341 multiplied times the cycles per second of the note lower in pitch will give the cycles per second of the note higher in pitch, and ii. all adjacently placed buttons that control notes related to each other by the interval of the fourth have these notes tuned such that 1.33031 multiplied times the cycles per second of the note lower in pitch will give the cycles per second of the note higher in pitch.

6. A Sensor Array as recited in claim 1, wherein said right-hand sensorboard has an optimum implementation of nineteen equal intonation, which requires that two conditions be met:

i. all adjacently placed buttons that control notes related to each other by the interval of the fifth have these notes tuned such that 1.49376 multiplied times the cycles per second of the note lower in pitch will give the cycles per second of the note higher in pitch, and ii. all adjacently placed buttons that control notes related to each other by the interval of the fourth have these notes tuned such that 1.3389 multiplied times the cycles per second of the note lower in pitch will give the cycles per second of the note higher in pitch.

7. A Sensor Array with a single left-hand sensorboard, said sensorboard having buttons arranged on its convex top surface, for controlling musical notes, the arrangement of said buttons essentially comprising:

a plurality of chromatic matrices, with said chromatic matrices each having a plurality of octaves in each row of eighths, and wherein said left-handed sensorboard has an optimum implementation of intonation, which requires that two conditions be met:

i. all adjacently placed buttons that control notes related to each other by the interval of the fifth have these notes tuned such that a number between 1.49111 and 1.50554 multiplied times the cycles per second of the note lower in pitch will give the cycles per second of the note higher in pitch, and ii. all adjacently placed buttons that control notes related to each other by the interval of the fourth have these notes tuned such that a number between 1.32843 and 1.34128 multiplied times the cycles per second of the note lower in pitch will give the cycles per second of the note higher in pitch.

8. A Sensor Array as recited in claim 7, wherein said left-hand sensorboard has an optimum implementation of standard intonation, which requires that two conditions be met:

i. all adjacently placed buttons that control notes related to each other by the interval of the fifth have these notes tuned such that 1.498.31 multiplied times the cycles per second of the note lower in pitch will give the cycles per second of the note higher in pitch, and ii. all adjacently placed buttons that control notes related to each other by the interval of the fourth have these notes tuned such that 1.33484 multiplied times the cycles per second of the note lower in pitch will give the cycles per second of the note higher in pitch.

9. A Sensor Array as recited in claim 7, wherein said left-hand sensorboard has an optimum implementation of Pythagorean intonation, which requires that two conditions be met;

i. all adjacently placed buttons that control notes related to each other by the interval of the fifth have these notes tuned such that 1.5 multiplied times the cycles per second of the note lower in pitch will give the cycles per second of the note in higher in pitch, and ii. all adjacently placed buttons that control notes related to each other by the interval of the fourth have these notes tuned such that 1.33333 multiplied times the cycles per second of the note lower in pitch will give the cycles per second of the note in higher in pitch.

10. A Sensor Array as recited in claim 7, wherein said left-hand sensorboard has an optimum implementation of mean tone intonation, which requires that two conditions be met:

i. all adjacently placed buttons that control notes related to each other by the interval of the fifth have these notes tuned such that 1.49535 multiplied times the cycles per second of the note lower in pitch will give the cycles per second of the note in higher in pitch, and ii. all adjacently placed buttons that control notes related to each other by the interval of the fourth have these notes tuned such that 1.33748 multiplied times the cycles per second of the note lower in pitch will give the cycles per second of the note in higher in pitch.

11. A Sensor Array as recited in claim 7, wherein said left-hand sensorboard has an optimum implementation of seventeen equal intonation, which requires that two conditions be met:

i. all adjacently placed buttons that control notes related to each other by the interval of the fifth have these notes tuned such that 1.50341 multiplied times the cycles per second of the note lower in pitch will give the cycles per second of the note in higher in pitch, and ii. all adjacently placed buttons that control notes related to each other by the interval of the fourth have these notes tuned such that 1.33031 multiplied times the cycles per second of the note lower in pitch will give the cycles per second of the note in higher in pitch.

12. A Sensor Array as recited in claim 7, wherein said left-hand sensorboard has an optimum implementation of nineteen equal intonation, which requires that two conditions be met:

i. all adjacently placed buttons that control notes related to each other by the interval of the fifth have these notes tuned such that 1.49376 multiplied times the cycles per second of the note lower in pitch will give the cycles per second of the note in higher in pitch, and ii. all adjacently placed buttons that control notes related to each other by the interval of the fourth have these notes tuned such that 1.3389 multiplied times the cycles per second of the note lower in pitch will give the cycles per second of the note in higher in pitch.

13. A Sensor Array with a single right-hand and a single left-hand sensorboard, said sensorboards each having buttons arranged on their convex top surfaces, for controlling musical notes, the arrangement of said buttons on each sensorboard essentially comprising: a plurality of chromatic matrices, with said chromatic matrices each having a plurality of octaves in each row of eighths, and wherein each of said right-hand and left-hand sensorboards has an optimum implementation of intonation, which requires that two conditions be met:

i. all adjacently placed buttons that control notes related to each other by the interval of the fifth have these notes tuned such that a number between 1.49111 and 1.50554 multiplied times the cycles per second of the note lower in pitch will give the cycles per second of the note higher in pitch, and ii. all adjacently placed buttons that control notes related to each other by the interval of the fourth have these notes tuned such that a number between 1.32843 and 1.34128 multiplied times the cycles per second of the note lower in pitch will give the cycles per second of the note higher in pitch.

14. A Sensor Array as recited in claim 13, wherein said right-hand and left-hand sensorboards have an optimum implementation of standard intonation, which requires that two conditions be met:

i. all adjacently placed buttons that control notes related to each other by the interval of the fifth have these notes tuned such that 1.49831 multiplied times the cycles per second of the note lower in pitch will give the cycles per second of the note higher in pitch, and ii. all adjacently placed buttons that control notes related to each other by the interval of the fourth have these notes tuned such that 1.33484 multiplied times the cycles per second of the note lower in pitch will give the cycles per second of the note higher in pitch.

15. A Sensor Array as recited in claim 13, wherein said right-hand and left-hand sensorboards have an optimum implementation of Pythagorean intonation, which requires that two conditions be met:

i. all adjacently placed buttons that control notes related to each other by the interval of the fifth have these notes tuned such that 1.5 multiplied times the cycles per second of the note lower in pitch will give the cycles per second of the note higher in pitch, and ii. all adjacently placed buttons that control notes related to each other by the interval of the fourth have these notes tuned such that 1.33333 multiplied times the cycles per second of the note lower in pitch will give the cycles per second of the note higher in. pitch.

16. A Sensor Array as recited in claim 13, wherein said right-hand and left-hand sensorboards have an optimum implementation of mean tone intonation, which requires that two conditions be met:

i. all adjacently placed buttons that control notes related to each other by the interval of the fifth have these notes tuned such that 1.49535 multiplied times the cycles per second of the note lower in pitch will give the cycles per second of the note higher in pitch, and ii. all adjacently placed buttons that control notes related to each other by the interval of the fourth have these notes tuned such that 1.33748 multiplied times the cycles per second of the note lower in pitch will give the cycles per second of the note higher in pitch.

17. A Sensor Array as recited in claim 13, wherein said right-hand and left-hand sensorboards have an optimum implementation of seventeen equal intonation, which requires that two conditions be met:

i. all adjacently placed buttons that control notes related to each other by the interval of the fifth have these notes tuned such that 1.50341 multiplied times the cycles per second of the note lower in pitch will give the cycles per second of the note higher in pitch, and ii. all adjacently placed buttons that control notes related to each,other by the interval of the fourth have these notes tuned such that 1.33031 multiplied times the cycles per second of the note lower in pitch will give the cycles per second of the note higher in pitch.

18. A Sensor Array as recited in claim 13, wherein said right-hand and left-hand sensorboards have an optimum implementation of nineteen equal intonation, which requires that two conditions be met:

i. all adjacently placed buttons that control notes related to each other by the interval of the fifth have these notes tuned such that 1.49376 multiplied times the cycles per second of the note lower in pitch will give the cycles per second of the note higher in pitch, and ii. all adjacently placed buttons that control notes related to each other by the interval of the fourth have these notes tuned such that 1.3389 multiplied times the cycles per second of the note lower in pitch will give the cycles per second of the note higher in pitch.

* * * * *